US007297214B2

(12) United States Patent
Ishida et al.

(10) Patent No.: US 7,297,214 B2
(45) Date of Patent: Nov. 20, 2007

(54) FREE CUTTING ALLOY

(75) Inventors: Kiyohito Ishida, 5-20, Kamisugi 3-chome, Aoba-ku, Sendai-shi, Miyagi 980-0011 (JP); Katsunari Oikawa, 4-1-34, Nishifunabasama, Shibata-cho, Shibata-gun, Miyagi 989-1622 (JP); Takashi Ebata, Miyagi (JP); Takayuki Inoguchi, Tokai (JP); Tetsuya Shimizu, Nagoya (JP); Michio Okabe, Chita (JP)

(73) Assignees: Kiyohito Ishida, Sendai-shi (JP); Katsunari Oikawa, Shibata-gun (JP); Daido Tokushuko Kabushiki Kaisha, Nagoya-shi (JP); Tohoku Tokushuko Kabushiki Kaisha, Shibata-gun (JP); Japan Industrial Technology Association, Tokyo (JP); Tohoku Technoarch Co., Ltd., Sendai-shi (JP)

( * ) Notice: Subject to any disclaimer, the term of this patent is extended or adjusted under 35 U.S.C. 154(b) by 277 days.

(21) Appl. No.: 10/847,524

(22) Filed: May 18, 2004

(65) Prior Publication Data

US 2005/0011589 A1 Jan. 20, 2005

Related U.S. Application Data

(63) Continuation-in-part of application No. 10/242,768, filed on Sep. 13, 2002, now abandoned, which is a continuation-in-part of application No. 09/653,344, filed on Aug. 31, 2000, now abandoned.

(30) Foreign Application Priority Data

| | | |
|---|---|---|
| Sep. 3, 1999 | (JP) | 11-250902 |
| Mar. 14, 2000 | (JP) | 2000-070257 |
| Jul. 21, 2000 | (JP) | 2000-221433 |
| Aug. 22, 2000 | (JP) | 2000-251602 |
| Aug. 22, 2000 | (JP) | 2000-251626 |

(51) Int. Cl.

| | |
|---|---|
| ***C22C 19/05*** | (2006.01) |
| ***C22C 30/00*** | (2006.01) |
| ***C22C 38/30*** | (2006.01) |
| ***C22C 38/22*** | (2006.01) |
| ***H01F 1/147*** | (2006.01) |

(52) U.S. Cl. ..... 148/427; 148/310; 148/312; 148/442; 148/451; 420/36; 420/37; 420/41; 420/42; 420/67; 420/68; 420/69; 420/70

(58) Field of Classification Search ..... None
See application file for complete search history.

(56) References Cited

U.S. PATENT DOCUMENTS 3,645,722 A 2/1972 Aulenbach et al.

(Continued)

FOREIGN PATENT DOCUMENTS

EP 0767 247 A1 4/1997

(Continued)

OTHER PUBLICATIONS

Kaneko, Hideo et al., "Sulfide forming Tendency of Alloying Elements in Steel," *Journal of the Japan Institute of Metals*, 1963, pp. 299-304, vol. 27.

(Continued)

*Primary Examiner*—John P. Sheehan
(74) *Attorney, Agent, or Firm*—Snider & Associates; Ronald R. Snider

(57) ABSTRACT

Provided is free cutting alloy excellent in machinability, preserving various characteristics as alloy. The free cutting alloy contains: one or more of Ti and Zr as a metal element component; and C being an indispensable element as a bonding component with the metal element component, wherein a (Ti,Zr) based compound including one or more of S, Se and Te is formed in a matrix metal phase. The free cutting alloy is more excellent in machinability, preserving various characteristics as alloy at similar levels to a conventional case. The effect is especially conspicuous, for example, when a compound expressed in a chemical form of $(Ti,Zr)_4C_2(S,Se,Te)_2$ as the (Ti,Zr) based compound is formed at least in a dispersed state in the alloy structure.

21 Claims, 17 Drawing Sheets

U.S. PATENT DOCUMENTS

| | | | |
|---|---|---|---|
| 4,705,581 | A | 11/1987 | Honkura et al. |
| 4,969,963 | A | 11/1990 | Honkura et al. |
| 6,033,625 | A | 3/2000 | Nagashima et al. |

FOREIGN PATENT DOCUMENTS

| | | |
|---|---|---|
| EP | 0 903 418 A1 | 3/1999 |
| JP | 33-7060 | 8/1958 |
| JP | 49-33243 | 9/1974 |
| JP | 54-17567 | 6/1979 |
| JP | 56-16653 | 2/1981 |
| JP | 60-155653 | 8/1985 |
| JP | 62-267455 | 10/1987 |
| JP | 63-65055 | 3/1988 |
| JP | 63-86848 | 4/1988 |
| JP | 63-093843 | 4/1988 |
| JP | 64-8258 | 1/1989 |
| JP | 2-163348 | 6/1990 |
| JP | 2-170948 | 7/1990 |
| JP | 2-179855 | 7/1990 |
| JP | 2-258955 | 10/1990 |
| JP | 3-44448 | 2/1991 |
| JP | 3-173749 | 7/1991 |
| JP | 3-180449 | 8/1991 |
| JP | 4-318153 | 11/1992 |
| JP | 5-117792 | 5/1993 |
| JP | 5-171364 | 7/1993 |
| JP | 6-10102 | 1/1994 |
| JP | 6-200355 | 7/1994 |
| JP | 7-233449 | 9/1995 |
| JP | 7-233452 | 9/1995 |
| JP | 2521479 | 5/1996 |
| JP | 9-49053 | 2/1997 |
| JP | 10-8219 | 1/1998 |
| JP | 10-046292 | 2/1998 |
| JP | 2742578 | 2/1998 |
| JP | 10-130794 | 5/1998 |
| JP | 10-140289 | 5/1998 |
| JP | 10-195605 | 7/1998 |
| JP | 10-237603 | 9/1998 |
| JP | 2805808 | 9/1998 |
| JP | 11-1743 | 1/1999 |
| JP | 11-229032 | 8/1999 |
| JP | 11-229082 | 8/1999 |
| JP | 11-279717 | 10/1999 |
| JP | 11-293390 | 10/1999 |
| JP | 11-323487 | 11/1999 |
| JP | 11-140597 | 3/2000 |
| JP | 2000-192202 | 7/2000 |
| JP | 3197573 | 6/2001 |
| SE | 1 519 313 | 7/1978 |

OTHER PUBLICATIONS

Narita, Kiichi et al., "Carbo-Nitrogen Sulphide in Steel Containing Titanium," *Tetsu-to-Hagane* (*Transactions of the Iron and Steel Institute of Japan*), 1972, pp. 140-142, vol. 9.

Kiessling, Roland, "Sulfide Inclusions: A Summary and Study of Sulfides in Resulfurized Ferritic Eli-Steels of the 18:2 Type," *Metal Working Technol.*, 1975, pp. 104-122, Ser. No. 6.

Kiessling, Roland, "Influence of Sulfide Composition on the Machinability and Corrosion Properties of a Resulferized Ferritic 18:2 Steel," *International Symposium on Influence of Metallurgy on Machinability of Steel*, Sep. 26-28, 1977, pp. 253-261.

Kaneko, Hideo et al, *Magnetic Material*, The Japan Institute of Metals, Nov. 20, 1977, pp. 142-149.

Kiessling, R. et al., "Non-metallic inclusions in steel," 1978, pp. 137-139, 144-145, and 157-159, London, GB: The Institute of Materials, XP002155733.

Japanese Institute of Metals, ed., *Revised Third Version Kinzoku* (*Metal*) *Data Book*, Maruzen, p. 223 Jun. 30, 1995, 3rd Version.

Tsuge, Shinji et al., "Effects of S Addition on the Formability and Corrosion Resistance of SUH409L Stainless Steel," *Sumitomo Kinzoku*, 1997, pp. 65-72, vol. 49, No. 4.

Nakama, Kazuo et al., "Effect of Mn/S ratio on Properties of Free Machining Ferritic Stainless Steels," *Sanyo Technical Report*, 1997, pp. 55-59, vol. 4, No. 1.

Japanese Industrial Standards, G 4304, "Hot Rolled Stainless Steel Plates, Sheets and Strip," 1999, pp. 670-684.

Japanese Industrial Standards, Z 2245, "Rockwell Hardness Test—Test method," 1998, pp. 191-196.

Japanese Industrial Standards, B 0601, "Surface Roughness—Definitions and Designation", 1994, pp. 15-26.

Japanese Industrial Standards, G 4311, "Heat-Resisting Steel Bars," 1991, pp. 712-717.

Japanese Industrial Standards, G 4312, "Heat-Resisting Steel Plates and Sheets," 1991, pp. 720-728.

50 μm

No. 13

50 μm

No. 2 magnification 400 x

PS=0. 25PG structure of stainless steel deposited metals

FREE CUTTING ALLOY

RELATED APPLICATION

This application claims the priority of Japanese Patent Application Nos. 11-250902 filed on Sep. 3, 1999, 2000-070257 filed on Mar. 14, 2000, 2000-221433 filed on Jul. 21, 2000, 2000-251602 filed on Aug. 22, 2000, and 2000-251626 filed on Aug. 22, 2000, which are incorporated herein by reference. This application is a continuation-in-part application of U.S. patent application Ser. No. 10/242,768, filed Sep. 13, 2002 (now abandoned), which is a continuation-in-part application of U.S. patent application Ser. No. 09/653,344, filed Aug. 31, 2000, now abandoned.

BACKGROUND ART

The present invention relates to free cutting alloy excellent in machinability.

Alloy has widespread applications because of a variety of characteristics thereof. A free cutting alloy excellent in machinability is, in a case, selected for improvement of productivity. In order to improve machinability, for example, free cutting alloy containing an element improving machinability such as S, Pb, Se or Bi (hereinafter referred to as machinability-improving element) is widely used. Especially in a case where machinability is particularly required because of precise finishing in machining or for other reasons, not only is a content of such a machinability-improving element increased in an alloy, but the elements are also added to an alloy in combination.

While S, which has widelybeen used for improvement of machinability, is in many cases added in the form of MnS, addition thereof in an alloy in a large content is causes for degrading corrosion resistivity, hot workability and cold workability of the alloy. Moreover, when the alloy is exposed to the air, a sulfur component included in the alloy is released into the air in the form of a sulfur containing gas, which causes sulfur contamination in peripheral areas of parts with ease. Therefore, there arises a necessity of suppressing release of sulfur containing gas (hereinafter referred to as improvement on out-gas resistivity). Elements such as S. Se and Te, however, deteriorate magnetic properties to a great extent in an electromagnetic stainless steel and the like.

Therefore, various proposals have been made: a Mn content is limited, a Cr content in sulfide is increased or in a case where S is contained, Ti is added in combination with S in order to disperse sulfide in the shape of a sphere (for example, see JP-A-98-46292 or JP-A-81-16653). To increase a Cr content in sulfide, however, tends to greatly decrease in machinability and hot workability and therefore, such an alloy has been restricted on its application in many cases.

Although such prior arts as JP11-140597 ('597), JP10-130794 ('794), JP2-170948 ('948), JP63-93843 ('843), JP60-155653 ('653) and U.S. Pat. No. 4,969,963 (Honkura et al.) disclose various free cutting alloys, these alloys are not satisfactory in machinability, sulfur out-gassing characteristics and elimination of Pb content.

It is accordingly an object of the present invention is to provide free cutting alloy excellent in machinability, showing outstanding characteristics as an alloy such as corrosion resistivity, hot workability and cold workability or specific magnetic characteristics, which are comparable to those of conventional alloys.

SUMMARY OF THE INVENTION

In order to achieve the above described object, a free cutting alloy of the present invention is characterized by that the free cutting alloy contains: one or more of Ti and Zr as a metal element component; and C being an indispensable element as a bonding component with the metal element component, wherein a (Ti,Zr) based compound including one or more of S, Se and Te is formed in a matrix metal phase.

Machinability of an alloy can be improved by forming the above described (Ti, Zr) based compound in a matrix metal phase of the alloy. Furthermore, by forming this compound in the alloy, formation of compounds such as MnS and (Mn,Cr)S, easy to reduce corrosion resistivity and hot workability of the alloy, can be prevented or suppressed, thereby enabling corrosion resistivity, hot workability and cold workability to be retained at good levels. That is, according to the present invention, a free cutting alloy excellent in machinability can be realized without any degradation in useful characteristics as an alloy such as hardness, corrosion resistivity, hot workability, cold workability and specific magnetic characteristics.

Further, a (Ti,Zr) based compound formed in a free cutting alloy of the present invention can be dispersed in the alloy structure. Especially dispersing the compound in an alloy structure can further increase machinability of an alloy. In order to increase the effect, a particle size of the (Ti,Zr) based compound as observed in the structure of a polished section of the alloy is preferably, for example, approximately in the range of 0.1 to 30 μm on the average and further, an area ratio of the compound in the structure is preferably in the range of 1 to 20%, wherein the particle size is defined by the maximum distance between two parallel lines circumscribing a particle in observation when parallel lines are drawn intersecting on a region including the particle in observation while changing a direction of the parallel lines.

The above described (Ti,Zr) based alloy can include at least a compound expressed in a composition formula $(Ti,Zr)_4(S,Se,Te)_2C_2$ (hereinafter also referred to as carbosulfide/selenide), wherein one or more of Ti and Zr may be included in the compound and one or more of S, Se and Te may be included in the compound. By forming a compound in the form of the above described composition formula, not only can machinability of an alloy be improved, but corrosion resistivity is also improved.

It should be appreciated that identification of a (Ti,Zr) based compound in an alloy can be performed by X-ray diffraction (for example, a diffractometer method), an electron probe microanalysis method (EPMA) and the like technique. For example, the presence or absence of the compound of $(Ti,Zr)_4(S,Se,Te)_2C_2$ can be confirmed according to whether or not a peak corresponding to the compound appear in a diffraction chart measured by an X-ray diffractometer. Further, a region in the alloy structure in which the compound is formed can also be specified by comparison between two-dimensional mapping results on characteristic X-ray intensities of Ti, Zr, S, Se or C obtained from a surface analysis by EPMA conducted on a section structure of the alloy.

PREFERRED EMBODIMENTS OF THE INVENTION

Figure 1:
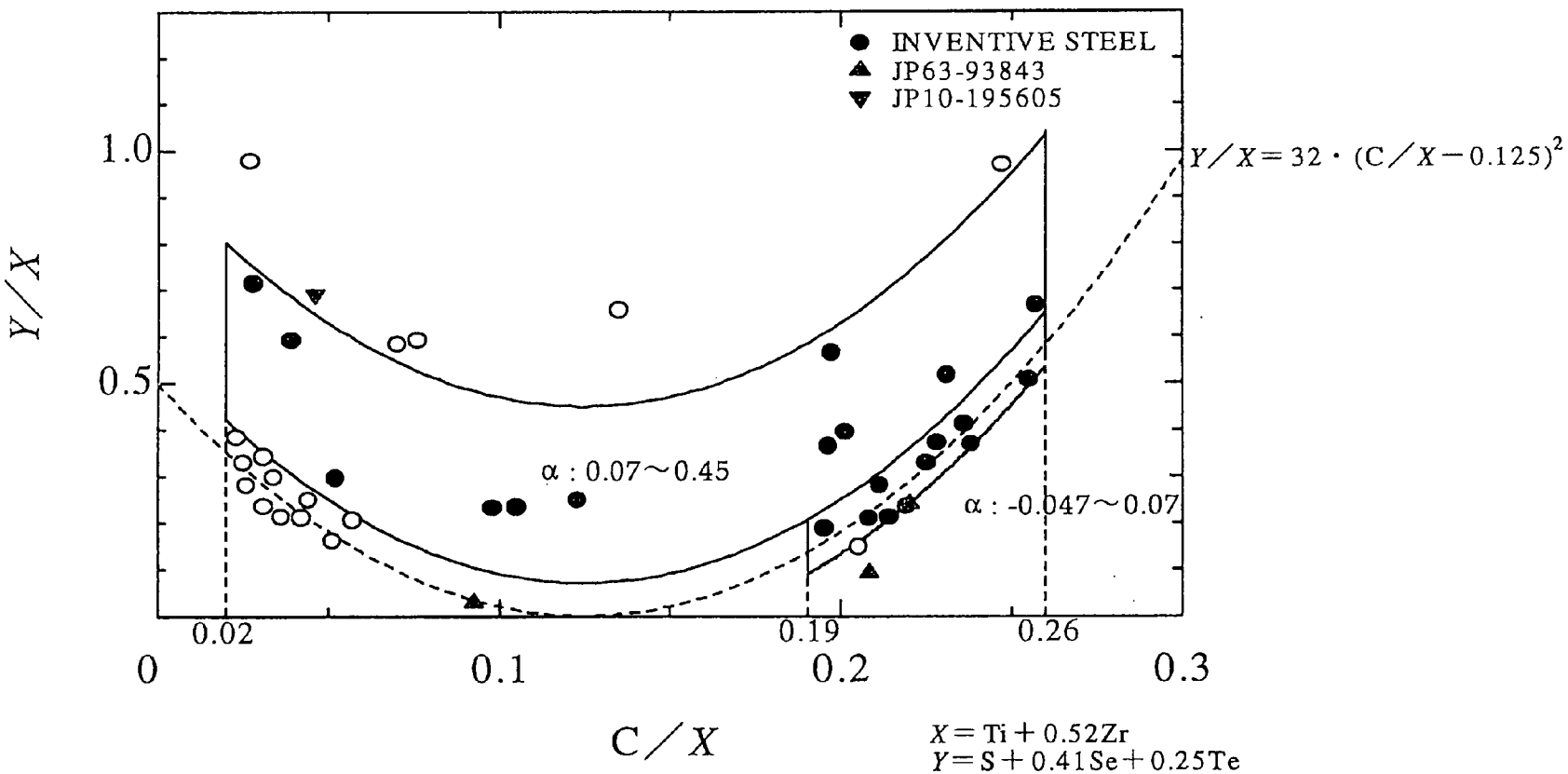
FIG. 1 is a graph showing compositional regions in combination of a content of one or more of Ti and Zr, a content of C and a content of one or more of S, Se and Te in a free cutting alloy of the present invention constituted as electromagnetic stainless alloy.

A free cutting alloy constituted as stainless steel of the present invention can be, to be more detailed, ferrite containing stainless steel (hereinafter referred to as a first selection invention). In this case, a composition of the free cutting alloy of the present invention is as follows:

free cutting alloy constituted as ferrite containing stainless steel containing:

2 mass % or lower, including zero, Ni; 12 to 35 mass % Cr; and 0.021 to 0.4 mass % C;

one or more of Ti and Zr such that $W_{Ti}+0.52W_{Zr}=0.14$ to 3.5 mass %, wherein $W_{Ti}$ and $W_{Zr}$ denote respective contents in mass % of Ti and Zr; and one or more of S and Se in the respective ranges of 0.01 to 1 mass % for S and 0.01 to 0.8 mass % for Se so that a total content in mass % of S and Se is set to a value higher than two times a C content in mass %;

wherein S content is determined such that a value of $W_S/(W_{Ti}+0.52W_{Zr})$ is 0.45 or less, wherein $W_S$ denotes a S content;

wherein $(W_{Ti}+0.52W_{Zr})/W_c=6.7$ to 20, wherein $W_c$ donates content in mass % of C;

and wherein a (Ti,Zr) based compound containing one or more of Ti and Zr as a metal element component, C being an indispensable element as a bonding component with the metal element component, and one or more of S, Se and Te is dispersed in a matrix metal phase.

The reason why the constituting elements and contents thereof in the first selection invention constituted as ferrite containing stainless steel are determined is as follows:

(1) The Ti Content Being Defined such that $W_{Ti}+0.52W_{Zr}=0.14$ to 3.5 Mass %, wherein $W_{Ti}$ and $W_{Zr}$ Denote Respective Contents in Mass % of Ti and Z Ti and Zr are indispensable elements for forming a (Ti,Zr) based compound playing a central role in exerting the effect of improving machinability of a free cutting alloy of the present invention. In the ferrite containing stainless steel as the first selection of this invention, when a value of $W_{Ti}+0.52W_{Zr}$ is lower than 0.14 mass %, the (Ti,Zr) based compound is insufficiently formed in amount, thereby disabling the effect of improving machinability to be satisfactorily exerted. On the other hand, when in excess of the value, machinability is reduced on the contrary. For this reason, the value of $W_{Ti}+0.52W_{Zr}$ is required to be suppressed to 3.5 mass % or lower. The above effect exerted when Ti and Zr are added into an alloy is determined by the sum of the numbers of atoms (or the sum of the numbers of values in mol), regardless of kinds of metals, Ti or Zr. Since a ratio between atomic weights is almost 1:0.52, Ti of a smaller atomic weight exerts a larger effect with a smaller mass. Thus, a value of $W_{Ti}+0.52W_{Zr}$ is said to be compositional parameter reflects the sum of the numbers of atoms of Zr and Ti included in an alloy.

(2) One or More of S and Se in the Respective Ranges of 0.01 to 1.0 Mass % for S and 0.01 to 0.8 Mass % for Se S and Se are elements for useful in improving machinability. By adding S and Se into an alloy, in an alloy structure, formed is a compound useful for improving machinability (for example, a (Ti,Zr) based compound expressed in the form of a composition formula $(Ti,Zr)_4(S,Se)_2C_2$). Therefore, contents of S and Se are specified 0.01 mass % as the lower limit. When the contents are excessively large, there arises a chance to cause a problem of deteriorating hot workability and therefore, there have to be the upper limits: It is preferable that a S content is set to 1 mass % and a Se content is set to 0.8 mass % as the respective upper limits. Further, S and Se are both desirably added into an alloy in a necessary and sufficient amount in order to form a compound improving machinability of the alloy, such as the above described (Ti,Zr) based compound, and from this viewpoint, a total content in mass % of S and Se is preferably set to a value higher than two times a C content in mass %. An excessive addition of S results in deterioration of the out-gas resistivity.

(3) 0.021 to 0.4 Mass % C

C is an important element forming a compound improving machinability. When a content thereof is lower than 0.021 mass %, however, an effect exerting sufficient machinability can not be imparted to the alloy, while when in excess of 0.4 mass %, much of a single carbide not effective for improving machinability is formed. Addition of C is preferably set in the range of 0.021 to 0.1 mass %, wherein it is preferable that addition of C is adjusted so properly that the effect of imparting machinability on the alloy is optimized depending on an amount of a constituting element of a compound improving machinability such as a (Ti,Zr) based compound.

(4) 2 Mass % or Lower Ni

Ni can be added according to a necessity since the element is effective for improving corrosion resistivity, particularly in an environment of a reducing acid. Excessive addition, however, not only reduce stability of a ferrite phase, but also causes cost-up and therefore, a content thereof has the upper limit of 2 mass %, wherein a case of no addition of Ni may be included.

(5) 12 to 35 Mass % Cr

Cr is an indispensable element for ensure corrosion resistivity and is added in the range of 12 mass % or higher. On the other hand, excessive addition is not only harmful to hot workability but also causes reduction in toughness and therefore the upper limit is set to 35 mass %.

While a factor determining out-gas resistivity of a material mainly is a composition of the material, since a S component dissolved in an Fe based matrix constituting stainless steel tends to gather at grain boundaries, it is desirable to fix S as carbo-sulfides of Ti and Zr for improvement on out-gas resistivity of the material. For the purpose, an S content should be determined such that a value of $W_S/(W_{Ti}+0.52W_{Zr})$ is 0.45 or less, or alternatively a value of $W_S/W_C$ is 0.4 or less and $W_S/(W_{Ti}+0.52W_{Zr})$ is 0.45 or less, wherein $W_S$ and $W_C$ demote an S content and a C content, respectively. With such a range of components adopted, an S content dispersed in the matrix metal phase (Fe-based matrix phase) can be limited and thereby, the out-gas resistivity of the matrix metal phase of stainless steel is improved.

A free cutting alloy of the present invention constituted as stainless steel can be martensite containing stainless steel (hereinafter referred to a second selection invention). In this case a composition of the free cutting alloy of the present invention is as follows:

2 mass % or lower, including zero, Ni; 9 to 17 mass % Cr; 0.03 mass % or lower 0; 0.05 mass % or lower N;

one or more of Ti and Zr such that $W_{Ti}+0.52W_{Zr}=0.10$ to 3.5 mass %, wherein $W_{Ti}$ and $W_{Zr}$ denote respective contents in mass % of Ti and Zr; and one or more of S and Se in the respective ranges of 0.03 to 1 mass % for S and 0.01 to 0.8 mass % for Se;

and 0.19 mass % or more of C so as to satisfy the following formulae:

$$0.375(W_S+0.4W_{Se})<W_C\leqq 1.5 \quad \text{(Formula A)}$$

$$0.125(W_{Ti}+0.52W_{Zr})<W_C\leqq 1.5 \quad \text{(Formula B)},$$

wherein $W_{Ti}$, $W_{Zr}$ $W_C$, $W_S$ and $W_{Se}$ denote respective contents of Ti, Zr, C, S and Se, all in mass %;

and wherein a (Ti,Zr) based compound containing one or more of Ti and Zr as a metal element component, C being an indispensable element as a bonding component with the metal element component, and one or more of S, Se and Te is dispersed in a matrix metal phase.

Martensitic stainless steel is in more of cases used in equipment and parts requiring hardness and corrosion resistivity as performances. Since martensitic stainless steel increases hardness thereof by a quenching heat treatment, there was a case where machining was performed in an annealed state and thereafter, quenching and tempering were performed, such that workability was improved. However, in the case, strain was produced in stainless steel by a quenching heat treatment and thereby, machining had to be, in a case, performed after a quenching heat treatment when precision processing was intended. Furthermore, when in order to increase machinability, machinability improving elements such as S, Se, Pb and Bi were added into a stainless steel, there arose a problem specific to martensite containing stainless steel since not only corrosion resistivity, hot workability and the like but quenchability were also deteriorated, thereby disabling sufficient hardness to be acquired. It should be appreciated that martensite containing stainless steel is a generic name for stainless steel forming a martensitic phase in the matrix by a quenching heat treatment.

As examples of compositions of the martensite containing stainless steel: there can be named: corresponding kinds of stainless steel, such as SUS 403, SUS 410, SUS 410S, SUS 420J1, SUS 420J2, SUS 429J1, SUS 440A and the like, all shown within JISG4304. Moreover, it should be appreciated that in the present invention, martensitic heat resisting steel is handled as conceptually included in martensite containing stainless steel. As examples of composition of martensitic heat resisting steel, there can be named corresponding kinds of steel whose compositions are defined in JIS G 4311 and G 4312, such as SUS 1, SUS 3, SUS 4, SUS 11, SUS 600 and SUS 616. However, neither of elements Ti, Zr, S and Se as essential features of the present invention is naturally expressed in compositions described in the standard. In this case, it should be understood that part of Fe content of each of the above described kinds of stainless steel is replaced with the above described elements in the respective above described compositions and thereby martensite containing stainless steel of the present invention is obtained. Therefore, while in description of the present specification, the same JIS Nos. are used, those actually means alloys specific to the present invention, which alloys have compositions defined in JIS standards as a base only.

Since martensite containing stainless steel changes a martensitic transformation temperature (Ms point) and quenchability depending on components included therein, attention has to be paid to ranges of the components in content. For this reason, the ranges of components in content of a (Ti,Zr) based compound described above are required to be set considering the following conditions: First, contents of components are desirably determined such that a (Ti,Zr) based compound is not formed so excessively that a martensitic formation temperature (Ms point) and quenchability are affected. Since atoms included in the (Ti,Zr) based compound exerts almost no influence on characteristics of the stainless steel, such as a hardness of the martensitic phase and quenchability thereof, it is considered that the elements left behind by excluding the amount of the elements included in the (Ti,Zr) based compound from the elements added originally in the martensite containing stainless steel (hereinafter referred to as residual elements) are dissolved as solid solution in the matrix phase and the residual elements exert an influence on martensitic transformation. Accordingly, ranges in content of the respective elements are preferably set, considering an influence on martensitic transformation using a continuous cooling transformation diagram of stainless steel having a composition analogous to a composition of the residual elements. Especially, since C has a great influence on martensitic transformation, a C content is adjusted such that the above described formulae A and B are satisfied so as to be 0.19 mass % or more. As a result, not only is machinability is improved, but hardness after quenching, quenchability and the like become compatible with conventional martensite containing stainless steel.

Below, description will be given of the reason why the components and contents thereof in the second selection invention of the present invention constituted as martensite containing stainless steel are selected and limited as follows:

(1)' The Ti Content Being Defined such that $W_{Ti}+0.52W_{Zr}=0.10$ to 3.5 Mass %, wherein $W_{Ti}$ and $W_{Zr}$ Denote Respective Contents in Mass % of Ti and Z In the martensite containing stainless steel as the second selection of this invention, when a value of $W_{Ti}+0.52W_{Zr}$ is lower than 0.10 mass %, the (Ti,Zr) based compound is insufficiently formed in amount, thereby disabling the effect of improving machinability to be satisfactorily exerted. On the other hand, when in excess of the value, machinability is reduced on the contrary. For this reason, the value of $W_{Ti}+0.52W_{Zr}$ is required to be suppressed to 3.5 mass % or lower.

(6) 2 Mass % or Lower Ni

Ni can be added according to a necessity since the element is effective for improving corrosion resistivity, particularly in an environment of a reducing acid. Excessive addition, however, not only reduces a martensitic transformation temperature (Ms temperature), but also increases stability of an austenitic phase of the matrix phase excessively, whereby a case arises in which an amount of martensite necessary to ensure hardness is hard to be obtained. Moreover, hardness after annealing becomes high producing a solid solution hardening effect caused by Ni in excess, which sometimes makes performances such as machinability decrease. For the above described reason, a Ni content has the upper limit of 2 mass %.

(7) 9 to 17 Mass % Cr

Cr is an indispensable element for ensuring corrosion resistivity and added 9 mass % or higher in content. However, when a content is in excess of 17 mass %. Phase stability is deteriorated and thereby high temperature brittleness occurs with ease, leading to poor hot workability. Moreover, it is considered that as the content increases, toughness decreases. Especially, when a stainless steel including Cr in excess receives a long heat treatment at a temperature in the intermediate range of 400 to 450° C., toughness at room temperature is lost with ease. A Cr content is desirably set in the range of 11 to 15 mass % and more desirably in the range of 12 to 14 mass %.

Also in the second selection of this invention, the S content is desirably determined such that a value of $W_S/(W_{Ti}+0.52W_{Zr})$ is 0.45 or less, or alternatively a value of $W_S/W_C$ is 0.4 or less and $W_S/(W_{Ti}+0.52W_{Zr})$ is 0.45 or less. With such a range of components adopted, the out-gas resistivity of the matrix metal phase of stainless steel can be improved.

Further, free cutting alloys of the first and second selection inventions of the present invention constituted as ferrite containing stainless steel and martensite containing stainless steel, respectively, can contain: 2 mass % or lower Si; 2 mass % or lower Mn; 2 mass % or lower Cu; and 2 mass % or lower Co. In addition, the free cutting alloys can further contain one or more of Mo and W in the respective ranges of 0.1 to 4 mass % for Mo and 0.1 to 3 mass % for W.

Description will be given of the reason why the elements and contents thereof are defined as follows:

(8) 2 Mass % or Lower Si

Si is added as a deoxidizing agent for steel. That Si is added in excess, however, is unfavorable because not only cold workability is deteriorated, but formation of a ferrite increases in amount, thereby degrading hot workability of steel. Moreover, an Ms point decreases in excess in a case of martensite containing stainless steel. Consequently, a Si content has the upper limit of 2 mass %. In a case where cold workability is particularly regarded as important, the Si content is preferably set 0.5 mass % or lower.

(9) 2 Mass % or Lower Mn

Mn acts a deoxidizing agent for steel. In addition, since a compound useful for increase in machinability in co-existence with S or Se, there arises a necessity of addition when machinability is highly thought of. On the other hand, since Mn S especially deteriorates corrosion resistivity, affects cold workability adversely and moreover, reduces a Ms point excessively in martensite containing stainless steel, therefore a Mn content has the upper limit of 2 mass %. Especially when cold workability is regarded as important, an Mn content is desirably limited to 0.4 mass % or lower.

(10) 2 Mass % or Lower Cu

Cu can be added according to a necessity since the element is effective for improving corrosion resistivity, particularly in an environment of a reducing acid. It is preferable to contain 0.3 mass % or higher in order to obtain a more conspicuous effect of the kind. When in excess, however, not only does hot workability decrease, but in martensite containing stainless steel, a Ms point decreases and quenchability is also deteriorated, whereby it is preferable for a Cu content to be set 2 mass % or lower. Especially when hot workability is regarded as important, it is more desirably to suppress the Cu content to 0.5 mass % or lower.

(11) 2 Mass % or Lower Co

Co is an element effective for improving corrosion resistivity, particularly in an environment of a reducing acid and in addition, can also be added to martensite containing stainless steel depending on a necessity since Co increases an Ms point and improves quenchability. To contain Co in content equal to 0.3 mass % or higher is preferable in order to obtain more of conspicuousness in the effects. When added in excess, however, not only does hot workability decrease, but a raw material cost increases, and therefore, it is preferable to set a content of Co in the range of 2 mass % or lower. Especially when hot workability and decrease in raw material cost are regarded as important, a content of Co is more desirably suppressed to 0.5 mass % or lower.

(12) One or More of Mo and W in the Respective Ranges of 0.1 to 4 Mass % for Mo and 0.1 to 3 Mass % for W Since Mo and W can further increase corrosion resistivity and strength, the elements may be added according to a necessity. The lower limits are both 0.1%, where the effects there of become clearly recognized. On the other hand, when added in excess, not only is hot workability deteriorated, but in martensite containing stainless steel, a Ms point decrease excessively and further cost increases and therefore, the upper limits of Mo and W are set 4 mass % and 3 mass %, respectively.

Free cutting alloy of the present invention constituted as stainless steel can be austenite containing stainless steel (hereinafter referred to a third selection invention). In this case, the free cutting alloy contains:

2 to 50 mass % Ni; 12 to 50 mass % Cr; 5 to 85.926 mass % Fe; 0.021 to 0.4 mass % C.

one or more of Ti and Zr such that $W_{Ti}+0.52W_{Zr}=0.03$ to 3.5 mass %, wherein $W_{Ti}$ and $W_{Zr}$ denote respective contents in mass % of Ti and Zr; and one or more of S and Se in the respective ranges of 0.01 to 1 mass % for S and 0.01 to 0.8 mass % for Se so that the total amount of S and Se is more than the C content;

and wherein a (Ti,Zr) based compound containing one or more of Ti and Zr as a metal element component, C being an indispensable element as a bonding component with the metal element component, and one or more of S, Se and Te is dispersed in a matrix metal phase.

Herein, austenite containing stainless steel means stainless steel containing not only Fe as a main component, but an austenitic phase in the structure. While there are below exemplified corresponding kinds of steel exhibited in JIS G 4304, neither of elements Ti, Zr, S and Se as essential features of the present invention is naturally expressed in compositions described in the standard. In this case, part of Fe content of each of the above described kinds of stainless steel is replaced with the above described elements in the respective above described compositional ranges and thereby martensite containing stainless steel of the present invention is obtained. Therefore, while in description of the present specification, the same JIS Nos. are used, those actually means alloys specific to the present invention, which alloys have compositions defined in JIS standards as a base only.

(1) Austenitic stainless steel is stainless steel showing an austenitic structure even in room temperature and can be exemplified as follows: SUS201, SUS 202, SUS 301,SUS 301J, SUS 302, SUS 302B, SUS 304, SUS 304N1, SUS 304N2, SUS 305, SUS 309S, SUS 310S, SUS 316, SUS 316N, SUD 316J1, SUS 317, SUS 317J1, SUS 321, SUS 347, SUS XM15J1, SUS 836L, SUS 890L and so on.

(2) Austenitic-ferritic stainless steel is stainless steel showing a dual phase structure of austenite and ferrite and can be exemplified SUS 329J4L and so on.

(3) Precipitation hardening stainless steel is a stainless steel obtained by adding elements such as aluminum and copper, and precipitating a compound with the elements as main components by a heat treatment to harden and can be exemplified SUS 630, SUS 631 and so on. It should be appreciated that a concept of "stainless steel" includes heat resisting steel exemplified below as well:

(4) Austenitic heat resisting steel

Compositions are stipulated in JIS G 4311 and G 4312, for example, and can be exemplified as follows: SUH 31, SUH 35, SUH 36, SUH 37, SUH 38, SUH 309, SUH 310, SUH 330, SUH 660, SUH 661 and so on.

Description will be given of the reason why the constituting elements and preferable ranges in content thereof are defined in the third selection invention of the present invention constituted as austenite containing stainless:

(1)' The Ti Content Being Defined Such that $W_{Ti}+0.52W_{Zr}=0.03$ to 3.5 Mass %, wherein $W_{Ti}$ and $W_{Zr}$ Denote Respective Contents in Mass % of Ti and Z In the austenite containing stainless steel as the third selection of this invention, when a value of $W_{Ti}+0.52W_{Zr}$ is lower than 0.03 mass %, the (Ti,Zr) based compound is insufficiently formed in amount, thereby disabling the effect of improving machinability to be satisfactorily exerted. On the other hand, when in excess of the value, machinability is reduced on the contrary. For this reason, the value of $W_{Ti}+0.52W_{Zr}$ is required to be suppressed to 3.5 mass % or lower.

(2)' One or More of S and Se in the Respective Ranges of 0.01 to 1.0 Mass % for S and 0.01 to 0.8 Mass % for Se (3)' 0.021 to 0.4 Mass % C The same as the first selection of this invention.

(13) 2 to 50 Mass % Ni

Figure 7:
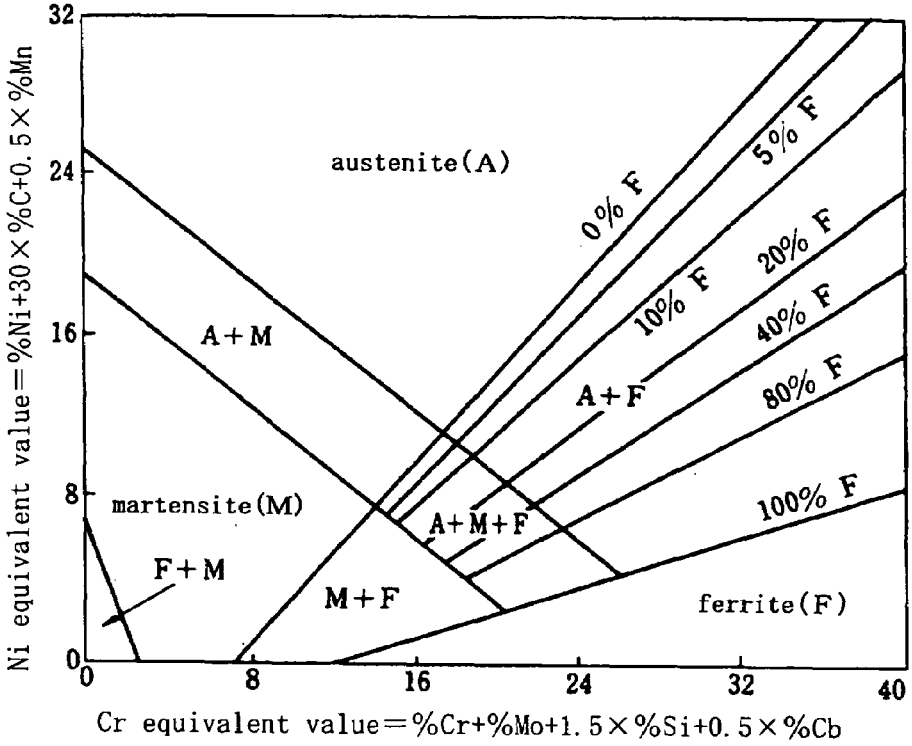
FIG. 7 is a graph showing an example of Schaeffler diagram.

Ni is necessary to be added to stainless steel in a content of at least 2 mass % in order to stabilize an austenitic phase in the stainless steel. Moreover, while Ni has many chances to be added into the matrix since Ni is useful for improving corrosion resistivity in an environment of a reducing acid, it is preferable to add at 2 mass % or higher in content from the viewpoint of improvement on corrosion resistivity. Moreover, when non-magnetism is desired, a necessary amount of Ni is required to be added so as to stabilize an austenitic phase more and thereby obtain an alloy as austenite containing stainless steel, considering connection with contents of other elements such as Cr and Mo. In this case, a Schoeffler diagram shown in FIG. 7 can be utilized for determination of the Ni content. An austenite forming element and a ferrite forming element are converted to equivalents of Ni and Cr amounts and a relationship between the equivalents and the structure is shown in FIG. 7 (see Revised 5$^{th}$ version Kinzoku Binran (Metal HandBook) published by Maruzen in 1990, p. 578). However, it is required to obtain a necessary amount of Ni in consideration of exclusion of an amount in Ti and/or Zr compound from constituting elements of the matrix. Since not only does excessive addition of Ni result in cost-up, but specific characteristics as stainless steel are also degraded, a Ni content is limited to 50 mass % or lower.

(14) 12 to 50 Mass % Cr

Cr is an indispensable element for ensuring corrosion resistivity of stainless steel. Hence, Cr is added in a content equal to 12 mass % or higher. When a Cr content is lower than 12 mass %, corrosion resistivity as stainless steel cannot be ensured due to intergranular corrosion caused by increased sensitivity at grain boundaries. On the other hand, when added in excess, there arises a risk that not only is hot workability degraded, but toughness is also reduced due to formation of a compound such as CrS. Furthermore, a problem occurs since high temperature embrittlement becomes conspicuous. For this reason, a Cr content is preferably set in the range of 12 to 50 mass % and performances specific to stainless steel are, in a case, degraded outside the range in content of Cr. Desirably, a Cr content is set in the range of 15 to 30 mass % and more desirably in the range of 17 to 25 mass %.

(15) 5 to 85.926 Mass % Fe

Fe is an indispensable component for constituting stainless steel. Therefore, a Fe content is at 5 mass % or higher. When an Fe content is lower than 5 mass %, the Fe content is not preferable since no strength specific to stainless steel can be obtained. That an Fe content exceeds 85.95 mass % is impossible in connection with required contents of other components. Consequently, an Fe content is in the range of 5 to 85.926 mass %. An Fe content is desirably set in the range of 15 to 75 mass % and more desirably in the range of 40 to 65 mass %.

(16) 0.021 to 0.4 Mass % C

C is an indispensable component for improvement on machinability and added in a content of 0.021 mass % or higher. With C being included in the matrix, a (Ti,Zr) based compound is formed, and formation of the compound is considered to improves machinability of stainless steel. When a C content is lower than 0.021 mass %, formation of the (Ti,Zr) based compound is insufficient and the effect of improving machinability is not sufficiently attainable. On the other hand, when the content exceeds 0.4 mass %, a carbide not useful for improvement on machinability is excessively formed and therefore, machinability is deteriorated on the contrary. It is considered that residual C not included, as a constituting element, in the (Ti,Zr) based compound contributing to improvement on machinability is dissolved in the matrix phase of stainless steel in a solid state and the residual C in solid solution gives birth to an effect of increasing a hardness of the stainless steel as well. Therefore, a C content is preferably set in a proper manner taking into consideration not only that C is added such that a machinability improvement effect is exerted in best conditions according to an amount of constituting elements of a compound improving machinability, such as the (Ti,Zr) based compound, but also the effect of improving hardness exerted by the residual C dissolved in a solid solution state in the matrix phase. In consideration of the above described circumferences, a C content is desirably in the range of 0.03 to 0.3 mass % and more desirably in the range of 0.05 to 0.25 mass %.

Also in the third selection of this invention, the S content is desirably determined such that a value of $W_S/(W_{Ti}+0.52W_{Zr})$ is 0.45 or less, or alternatively a value of $W_S/W_C$ is 0.4 or less and $W_S/(W_{Ti}+0.52W_{Zr})$ is 0.45 or less. With such a range of components adopted, the out-gas resistivity of the matrix metal phase of stainless steel can be improved.

In a free cutting alloy of the present invention constituted as austenite containing stainless steel, a composition may have the following components and contents thereof in order to achieve better characteristics. That is, the composition can be 4 mass % or lower Si; 4 mass % or lower Mn; 4 mass % or lower Cu; and 4 mass % or lower Co. Description will be given of the reason why the composition has the elements and contents thereof as follows:

(17) 4 Mass % or Lower Si

Si can be added as a deoxidizing agent for steel. However, when a content of Si is excessive high, not only is a hardness after solid solution heat treatment disadvantageously high, which in turn leads to poor cold workability, but an increased amount of a δ-ferrite phase is formed, thereby deteriorating hot workability of the steel. Hence, the upper limit of Si in content is set to 4 mass %. Especially, when cold workability and hot workability are both regarded as important characteristics, a Si content is desirably set to 1 mass % or lower and more desirably to 0.5 mass % or lower.

(18) 4 Mass % or Lower Mn

Mn not only acts as a deoxidizing agent of the steel, but also exerts an effect to suppress formation of a δ-ferrite phase. Furthermore, Mn has an effect to stabilize an austenitic phase. Since Mn forms a compound useful for increase in machinability in co-existence with S and Se, Mn may added to the matrix when machinability is regarded as an important characteristic. When an effect of improving machinability is expected to be conspicuous, a Mn content is preferably set to 0.6 mass % or higher. When Mn is added, MnS is formed with ease. However, since MnS not only degrades corrosion resistivity to a great extent, but also reduces cold workability, formation of MnS is unwelcome. Therefore, the Mn content is set to 4 mass % or lower. Especially, when corrosion resistivity and cold workability are both regarded as important characteristics, the Mn content is desirably set to 1 mass % or lower and more desirably to 0.5 mass % or lower.

(19) 4 Mass % or Lower Cu

Cu is not only useful for increase in corrosion resistivity, particularly for improving corrosion resistivity in an environment of a reducing acid, but also reduces work hardnability and improves moldability. Moreover, since a heat treatment or the like processing can improve an antibacterial property, Cu may added if necessary. However, when Cu is excessively added, hot workability is degraded and therefore, a Cu content is preferably set to 4 mass % or lower. Especially, when hot workability is regarded as an important characteristic, the Cu content is more desirably set to 1 mass % or lower.

(20) Co Equal to 4 Mass % or Lower Co

Co is an element not only useful for improving corrosion resistivity, particularly in an environment of a reducing acid, but to exert an effect of ensuring non-magnetism and therefore, may added to the matrix if necessary. It is preferable to add in content of 1 mass % or higher in order to obtain more of conspicuousness of the effect. However, when Co is added in excess, not only is hot workability reduced but cost-up occurs on raw material. Hence, a Co content is preferably set to 4 mass % or lower. Especially, when hot workability or cost is taken seriously, the Co content is more desirably suppressed to 3 mass % or lower.

In the third selection invention constituted as austenite containing stainless steel, the stainless steel can contain one or more of Mo and W in the respective ranges of 0.1 to 10 mass % for Mo and 0.1 to 10 mass % for W. Addition of Mo and W can improve corrosion resistivity due to strengthened passivation and furthermore attain improved hardness due to second hardening. It is preferable to add Mo and W in each content of 0.1 mass % or higher in order to make the effect exerted clearly. On the otherhand, when in excess, hot workability is reduced and therefore, the content of Mo and W combined is preferably set to 10 mass % as the upper limit.

In the ferrite containing stainless steel, the martensite containing stainless steel and the austenite containing stainless steel, all described above, contents of other elements are as follows: the stainless steels can contain: 0.05 mass % or lower P; and 0.03 mass % O; and 0.05 mass % or lower N. Moreover, the stainless steels can further contain one or more of Te, Bi and Pb in the respective ranges of 0.005 to 0.1 mass % for Te; 0.01 to 0.2 mass % for Bi; and 0.01 to 0.3 mass % for Pb. Description will be given of the reason why the elements and contents thereof are defined as follows:

(21) 0.05 Mass % or Lower P

P is segregated at grain boundaries and not only increases intergranular corrosion sensibility but also sometimes reduces toughness. Therefore, a P content is preferably set as low as possible and to 0.05 mass % or lower. Although the P content is more desirably set to 0.03 mass % or lower, reduction in content more than necessary has a chance to be reflected on increased production cost.

(22) 0.03 Mass % or Lower O

O combines with Ti or Zr both of which are constituting elements of a compound useful for improving machinability and forms oxides not useful for improving machinability. Therefore, an O content should be suppressed as low as possible and is set to 0.03 mass % as the upper limit. The O content is desirably set to 0.01 mass % or lower if allowable in consideration of increase in production cost.

(23) 0.05 Mass % or Lower N

N combines with Ti or Zr both of which are constituting elements of a compound useful for improving machinability and forms nitrides not useful for improving machinability. Therefore, a N content should be suppressed as low as possible and is set to 0.05 mass % as the upper limit. The N content is desirably set to 0.03 mass % or lower and more desirably to 0.01 mass %, if allowable in consideration of increase in production cost.

(24) One or More of Te, Bi and Pb in the Respective Ranges of 0.005 to 0.1 Mass % for Te; 0.01 to 0.2 Mass % for Bi; and 0.01 to 0.3 Mass % for Pb Since Te, Bi and Pb can further improve machinability, the elements may add if necessary. The lower limits thereof at which the respective effects are exerted to clearness are as follows: 0.005 mass % Te; 0.01 mass % Bi and 0.01 mass % Pb, respectively. On the other hand, since excessive addition reduces hot workability, the upper limits are set as follows: 0.1 mass % Te; 0.2 mass % Bi; and 0.3 mass % Pb.

Furthermore, when a free cutting alloy of the present invention is constituted as stainless steel, the alloy can contain one or more selected from the group consisting of Ca, Mg, B and REM (one or more of metal elements classified as Group 3A in the periodic table of elements) in the range of 0.0005 to 0.01 mass % for one element or as a total content in a case of two or more elements. The elements are useful for improving hot workability of steel. The effect of improving hot workability obtainable by addition of the elements is more conspicuously exerted in the range of 0.0005 mass % or higher for one element or as a total content of more than one elements combined. On the other hand, when the elements are added in excess, the effect is saturated and hot workability is then reduced on the contrary. Therefore, the content of a single element or total content of the elements combined is set to 0.01 mass % as the upper limit. As for REM, since low radioactivity elements are easy to be handled when being mainly used, from this viewpoint, it is useful to use one or more selected from the group consisting of Sc, Y, La, Ce, Pr, Nd, Sm, Eu, Gd, Tb, Dy, Ho, Er, Tm, Yb and Lu. It is desirable to use light rare earth elements, especially La or Ce from the viewpoint of conspicuous exertion of the effect and price. However, there arises no trouble with mixing-in of a trace of radioactive rare earth elements such as Th and U inevitably remaining, without being excluded, in a process to separate rare earth elements. Further, from the viewpoint of reduction in raw material cost, there can be used not-separated rare earth elements such as mish metal and didymium.

A free cutting alloy of the present invention constituted as stainless steel can contain one or more selected from the group consisting of Nb, V, Ta and Hf in each range of 0.01 to 0.5 mass %. Since Nb, V, Ta and Hf has an effect of forming carbo-nitrides to miniaturize crystalline particles of steel and increase toughness. Hence, the elements can add in each content up to 0.5 mass % and desirably contain 0.01 mass % or higher in the range.

A free cutting alloy of the present invention constituted as the above described stainless steel can contain 0.035 mass % or lower S in $W_{SO}$ value, wherein $W_{SO}$ is defined as a value obtained in a procedure as follows: An alloy test piece is prepared so as to have the shape of a rectangular prism in size of 15 mm in length, 25 mm in width and 3 mm in thickness with the entire surface being polished with No. 400 emery paper. A silver foil in size of 10 mm in length, 5 mm in width and 0.1 mm in thickness with a purity of 99.9% or higher as a S getter and 0.5 cc of pure water are sealed in a vessel of an inner volume of 250 cc together with the test piece and a temperature in the vessel is raised to 85° C. and said temperature is then kept there for 20 hr; and thereafter, a S content $W_{SO}$ in mass % in the silver foil piece is analyzed.

A (Ti, Zr) based compound being a feature of the present invention is formed and in the course of the formation, added S is included in the stainless steel as a constituting element of the (Ti, Zr) based compound. As a result, a S amount present in the matrix metal phase (Fe based matrix phase) in a dispersed state decreases and therefore, a S amount released into the air from the stainless steel also decreases. Consequently, an out-gas resistivity of the stainless steel can also be improved by formation of the (Ti, Zr) based compound.

In this case, when the out-gas resistivity test is performed, a S component released from the test piece as a sulfur containing gas is forced to be absorbed in the silver foil as a getter and a sulfur content $W_{SO}$ in the silver foil is measured to quantitatively determine the out-gas resistivity of a material. A S content in the stainless steel is defined using the $W_{SO}$ value and set to 0.035 mass % or lower in $W_{SO}$. Stainless steel of the present invention controlled so as to be 0.035 mass % or lower in $W_{SO}$ is hard to cause sulfur contamination in the peripheral parts when exposed to the air since a S component released form the stainless steel into the air is very small and thereby the stainless steel can be preferably used as parts of industrial equipment requiring the out-gas resistivity.

While the composition as stainless steel of the present invention is described above, machinability as an alloy is required not only in the above described stainless steel, but also in an electromagnetic alloy used as a functional material. Although electromagnetic alloys are in many cases poor machinability, not only corrosion resistivity and cold workability but also electromagnetic characteristics were in cases deteriorated when machinability-improving elements such as S and Pb were added for improvement on machinability. Moreover, since characteristics of the alloy are largely changed by subtle shifts in balances between constituting elements, it has been difficult that machinability is improved while retaining excellent electromagnetic characteristics. According to the present invention, an effect of improving machinability can be achieved while the characteristics in the electromagnetic alloy is maintained.

To be concrete, the present invention can be preferably used as an electromagnetic alloy (hereinafter referred to as a fourth selection invention).

The present inventors found out that the machinability of the ferritic electromagnetic alloy can be improved while keeping the soft magnetic characteristics, cold forgeability and corrosion resistance well controllable, and finally completed the fourth selection invention, by adding either or both of Ti and Zr; C; and one or more of S, Se and Te in a combined manner, and by adjusting the individual contents within predetermined ranges, such as (1) content of either or both of Ti and Zr expressed as Ti+0.52×Zr (referred to as "X") is adjusted to 0.05 to 0.5%; content of C is adjusted to 0.19X to 0.26X %; and content of one or more of S, Se and Te expressed as S %+0.41×Se %+0.25×Te % (referred to as "Y") is adjusted to (Z−0.047)X to (Z+0.07)X %; or (2) X is adjusted to 0.05 to 0.5%; content of C is adjusted to 0.02X to 0.26X %; and Y is adjusted to more than (Z+0.07)X to (Z+0.45)X %.

Furthermore, the fourth selection invention includes four composition combinations, and these combinations exhibit excellent machinability without the aid of a significant addition of Pb.

Furthermore, the present inventors also found out that the tool wear or anti-oxidative property were particularly improved by adopting either of the ranges expressed by (A) Si of more than 2.0% and Al of 0.020% or less; or (B) Si of 2.0% or less and Al of 0.030% or more.

Based on the above, the fourth selection includes four combinations described below.

In description of the fourth selection invention, expression of a element symbol with % following such as Ti %, Zr %, S %, Se %, Te % or C % means a content in mass % of a corresponding component indicated by the element symbol. C/X and C %/X in the following description are the same in meaning.

That is, the fourth selection invention of the present invention is constituted as the electromagnetic stainless steel and the first combination containing:

2.0 to 3, the upper and lower limits not included, mass % Si;

2 mass % or lower Mn;

5 to 25 mass % Cr;

0.01 to 0.020, the lower limit not included, mass % Al;

one or more of Ti and Zr so that X defined by the following formula 1 is in the range of 0.05 to 0.5 mass %;

C in the range of 0.19 X to 0.26 X mass %, wherein X is expressed by the following formula 1;

one or more of S, Se and Te so that the value Y is in the range of (Z−0.047)X to (Z+0.07)X mass %, wherein X, Z and Y are values of the respective following formulae 1, 3 and 2;

$$\text{Ti \%}+0.52\text{Zr \%}=X \quad \text{(Formula 1)}$$

$$\text{S \%}+0.41\text{Se \%}+0.25\text{Te \%}=Y \quad \text{(Formula 2)}$$

$$32(\text{C \%}/X-0.125)^2=Z \quad \text{(Formula 3)}$$

Fe being the main component of the alloy;

inevitable impurities;

and wherein a (Ti,Zr) based compound containing one or more of Ti and Zr as a metal element component, C being an indispensable element as a bonding component with the metal element component, and one or more of S, Se and Te is dispersed in a matrix metal phase.

In the first combination, the alloy can further contain one or more selected from the group consisting of Ni, Cu, Mo, Nb and V in the respective ranges of 2 mass % or lower for Ni; 2 mass % or lower for Cu; 2 mass % or lower for Mo; 1 mass % or lower for Nb and 1 mass % or lower for V. The alloy can further contain one or more selected from the group consisting of B and metal elements classified as Group 3A in the periodic table of elements in the respective ranges of 0.01 mass % or lower for B; and 0.1 mass % or lower for one or more of metal elements classified as Group 3A in the periodic table of elements in total.

The second combination contains:

0.01 to 2.0 mass % Si;

2 mass % or lower Mn;

5 to 25 mass % Cr;

0.030 to 5 mass % Al;

one or more of Ti and Zr so that X defined by the following formula 1 is in the range of 0.05 to 0.5 mass %;

C in the range of 0.19 X to 0.26 X mass %, wherein X is expressed by the following formula 1;

one or more of S, Se and Te so that the value Y is in the range of (Z−0.047)X to (Z+0.07)X mass %, wherein X, Z and Y are values of the respective following formulae 1, 3 and 2;

$$\text{Ti \%}+0.52\text{Zr \%}=X \quad \text{(Formula 1)}$$

$$\text{S \%}+0.41\text{Se \%}+0.25\text{Te \%}=Y \quad \text{(Formula 2)}$$

$$32(\text{C \%}/X-0.125)^2=Z \quad \text{(Formula 3)}$$

Fe being the main component of the alloy;

inevitable impurities;

and wherein a (Ti,Zr) based compound containing one or more of Ti and Zr as a metal element component, C being an indispensable element as a bonding component with the metal element component, and one or more of S, Se and Te is dispersed in a matrix metal phase.

In the second combination, the alloy can further contain one or more selected from the group consisting of Ni, Cu, Mo, Nb and V in the respective ranges of 2 mass % or lower for Ni; 2 mass % or lower for Cu; 2 mass % or lower for Mo; 1 mass % or lower for Nb and 1 mass % or lower for V. The alloy can further contain one or more selected from the group consisting of Pb, B and metal elements classified as Group 3A in the periodic table of elements in the respective ranges of 0.15 mass % or lower for Pb, 0.01 mass % or lower for B; and 0.1 mass % or lower for one or more of metal elements classified as Group 3A in the periodic table of elements in total.

The third combination contains:

2.0 to 3, the upper and lower limits not included, mass % Si;

2 mass % or lower Mn;

5 to 25 mass % Cr;

0.01 to 0.020, the lower limit not included, mass % Al;

one or more of Ti and Zr so that X defined by the following formula 1 is in the range of 0.05 to 0.5 mass %;

C in the range of 0.02 X to 0.26 X mass %, wherein X is expressed by the following formula 1;

one or more of S, Se and Te so that the value Y is in the range of (Z+0.07)X to (Z+0.45)X mass %, wherein X, Z and Y are values of the respective following formulae 1, 3 and 2;

$$\text{Ti \%}+0.52\text{Zr \%}=X \quad \text{(Formula 1)}$$

$$\text{S \%}+0.41\text{Se \%}+0.25\text{Te \%}=Y \quad \text{(Formula 2)}$$

$$32(\text{C \%}/X-0.125)^2=Z \quad \text{(Formula 3)}$$

Fe being the main component of the alloy;

inevitable impurities;

wherein Pb content is less than 0.01 mass %;

and wherein a (Ti,Zr) based compound containing one or more of Ti and Zr as a metal element component, C being an indispensable element as a bonding component with the metal element component, and one or more of S, Se and Te is dispersed in a matrix metal phase.

In the third combination, the alloy can further contain one or more selected from the group consisting of Ni, Cu, Mo, Nb and V in the respective ranges of 2 mass % or lower for Ni; 2 mass % or lower for Cu; 2 mass % or lower for Mo; 1 mass % or lower for Nb and 1 mass % or lower for V. The alloy can further contain one or more selected from the group consisting of B and metal elements classified as Group 3A in the periodic table of elements in the respective ranges of 0.01 mass % or lower for B; and 0.1 mass % or lower for one or more of metal elements classified as Group 3A in the periodic table of elements in total.

The fourth combination contains:

0.01 to 2.0 mass % Si;

2 mass % or lower Mn;

5 to 25 mass % Cr;

0.030 to 5 mass % Al;

one or more of Ti and Zr so that X defined by the following formula 1 is in the range of 0.05 to 0.5 mass %;

C in the range of 0.02 X to 0.26 X mass %, wherein X is expressed by the following formula 1;

one or more of S, Se and Te so that the value Y is in the range of (Z+0.07)X to (Z+0.45)X mass %, wherein X, Z and Y are values of the respective following formulae 1, 3 and 2;

$$\text{Ti \%}+0.52\text{Zr \%}=X \quad \text{(Formula 1)}$$

$$\text{S \%}+0.41\text{Se \%}+0.25\text{Te \%}=Y \quad \text{(Formula 2)}$$

$$32(\text{C \%}/X-0.125)^2=Z \quad \text{(Formula 3)}$$

Fe being the main component of the alloy;

inevitable impurities;

wherein Pb content is less than 0.01 mass %;

and wherein a (Ti,Zr) based compound containing one or more of Ti and Zr as a metal element component, C being an indispensable element as a bonding component with the metal element component, and one or more of S, Se and Te is dispersed in a matrix metal phase.

In the fourth combination, the alloy can further contain one or more selected from the group consisting of Ni, Cu, Mo, Nb and V in the respective ranges of 2 mass % or lower for Ni; 2 mass % or lower for Cu; 2 mass % or lower for Mo; 1 mass % or lower for Nb and 1 mass % or lower for V.

Next, the combinations of the ranges in content are described with reference to a graph shown in FIG. 1, where the abscissa is used for plotting C/X and the ordinate is used for plotting Y/X.

(1) A first combination of a content of one or more of Ti and Zr; a content of C and a content of one or more of S, Se and Te is a region enclosed by a straight line perpendicular to the abscissa passing through a position of C/X=0.19, a straight line perpendicular to the abscissa passing through a position of C/X=0.26, and curves of $Y/X=32(C/X-0.125)^2-0.047$ and $Y/X=32(C/X-0.125)^2+0.07$, wherein the formulae of $Y/X=32(C/X-0.125)^2-0.047$ and $Y/X=32(C/X-0.125)^2+0.07$ are obtained by substituting $Z=32(C/X-0.125)^2$ into the above described $(Z-0.047)X \leqq Y/X \leqq (Z+0.07)$, that is $Y/X=(Z-0.047)$ to $(Z+0.07)$. Further, a broken line in FIG. 1, $Y/X=0.32(C/X-0.125)^2$ is a curve circumscribed by the C/X axis (a value on the Y/X axis=0) and α in FIG. 1 is defined by a formula $Y/X-32(C/X-0.125)^2=\alpha$. Further, a mark ○ with a number in FIG. 1 indicates a specimen No. of fourth selection inventive steel of the present invention of Example 4 and a mark ▲ indicates a specimen No. of an inventive steel of Example 4.

(2) A second combination of a content of one or more of Ti and Zr; a content of C and one or more of S, Se and Te is a region enclosed by a straight line perpendicular to the abscissa passing through a position of C/X=0.2, a straight line perpendicular to the abscissa passing through a position of C/X=0.26, and curves of $Y/X=32(C/X-0.125)^2+0.07$ and $Y/X=32(C/X-0.125)^2+0.45$ in FIG. 1.

Next, description will be given of the reason why the elements and contents thereof are selected of a free cutting alloy relating to the fourth selection invention as follows:

(25) (A) Si of More than 2.0%, Al of 0.020% or Less; or (B) Si of 2.0% or Less and Al of 0.030% or More Si and Al individually exhibit effects as described below.

Si is useful not only as a deoxidizing agent, but also for contributing to increase in the maximum magnetic permeability and reduction in coercive force among soft magnetic characteristics as an electromagnetic stainless steel and furthermore, useful for increase in electric resistivity and improvement on responsibility in a high-frequency band.

Al is useful not only as a deoxidizing agent, but for contributing increase in the maximum magnetic permeability and reduction in coercive force and furthermore, useful for increase in electric resistivity and improvement on responsibility in a high-frequency band, similar to Si.

Combination of ranges of Si and Al contents can be determined depending on which of the tool wear and anti-oxidation property should particularly be appreciated.

(A) Si of More than 2.0% and Al of 0.020% or Less

Addition of a sufficient amount of Si makes it possible to obtain embrittlement effect of the matrix, and also to obtain lubricating effect through formation of a low-melting-point oxide $SiO_2$ during the cutting, and to consequently raise the machinability.

(B) Si of 2.0% or Less and Al of 0.030% or More

Addition of a sufficient amount of Al makes it possible to reduce the oxidation rate through formation of a dense and highly protective oxide coating, and to consequently improve the anti-oxidative property.

(26) 2 Mass % or Lower Mn

Mn is an element useful as a deoxidizing agent, but since when a Mn content exceeds 2 mass %, soft magnetic characteristics are degraded, the Mn content is set to 2 mass % or lower.

(27) 5 to 25 Mass % Cr

Cr is useful for improvement on corrosion resistivity and electric resistivity of steel, but for improvement on machinability by forming Cr(S,Se,Te) with S, Se and Te, which will be described later. Therefore, Cr is added for the improvements. Although it is necessary for Cr to be included in the range of 5 mass % or higher, the Cr content in excess of 25 mass % reduces cold workability and accordingly, the Cr content is set to 5 to 25 mass %.

(28) One or More of Ti and Zr in the Range of 0.05 to 0.5 Mass % in Terms of Ti %+0.52Zr %=X Ti and Zr forms $(Ti,Zr)_4C_2(S,Se,Te)_2$ and/or (Ti,Zr) (S,Se, Te) in co-existence with C, S, Se and Te to contribute to increase in machinability and since among the two, $(Ti,Zr)_4C_2(S,Se,Te)_2$ especially deteriorates neither soft magnetic characteristics nor corrosion resistivity and contributes to improvement on machinability without any loss of cold workability, due to fine dispersion thereof, the elements are therefore added for the improvements. Although the content of the elements singly or in combination is required to be 0.05 mass % of higher in terms of X in order to exert the effects, the soft magnetic characteristics are degraded when the content in terms of X exceeds 0.5 mass % and accordingly, the content is set to the range of 0.05 to 0.5 mass % in terms of X.

(29) C in the Range of 0.19 X to 0.26 X Mass % or 0.02 X to 0.26 X Mass %

The reason why a C content is set to 0.19 X to 0.26 X mass % ($0.19 \leqq C/X \leqq 0.26$), wherein $-0.047 \leqq \alpha \leqq 0.07$, and $\alpha=Y/X-32(C/X-1.25)^2$ (see FIG. 1), is that with such compositions adopted, in an electromagnetic stainless steel, soft magnetic characteristics and cold workability are especially excellent, machinability is also good due to dispersion in a fine particle state of $(Ti,Zr)_4C_2(S,Se,Te)_2$ and (Ti,Zr) (S,Se, Te), the latter of which is formed in a small amount, and further, corrosion resistivity is also good, wherein $(Ti,Zr)_4C_2(S,Se,Te)_2$ has a little effect to degrade the soft magnetic characteristics. Excellence in the soft magnetic characteristics in the region of this a is because of extremely low level of the presence of (Ti,Zr)C, (Ti,Zr) (S,Se,Te) and Mn(S,Se, Te).

In the content range of C of C/X<0.19 (a C content less than 0.19 X mass %), formation of $(Ti,Zr)_4C_2(S,Se,Te)_2$ is excessively small in amount, which exerts the effect at a poor level but in the content range of C of C/X>0.26 (C>0.26 mass %), (Ti,Zr)C increases and thereby, the soft magnetic characteristics, cold workability and corrosion resistivity are degraded on the contrary, and accordingly, the C content is limited to the ranges of $0.19 \leqq C/X \leqq 0.26$ (0.19 X to 0.26 X mass %).

Moreover, the reason why the C content is set to the compositional range of 0.2 X to 0.26 X mass % ($0.02 \leqq C/X \leqq 0.26$), wherein $0.07 \leqq \alpha \leqq 0.45$, is that electromagnetic stainless steel with good machinability, good soft magnetic characteristics and good cold workability can be attained by formation of $(Ti,Zr)_4C_2(S,Se,Te)_2$ and (Ti,Zr) (S,Se,Te) excellent in corrosion resistivity, in a slightly increased amount. However, in the range of C<0.02 X mass % (C/X<0.02), the soft magnetic characteristics are degraded due to decrease in formation of $(Ti,Zr)_4C_2(S,Se,Te)_2$ and increase in (Ti,Zr) (S,Se,Te) and in the range of C>0.026 X (C/X>0.26), the soft magnetic characteristics, cold workability and corrosion resistivity are deteriorated due to increase in (Ti,Zr)C. Accordingly, the C content range is limited to C=0.02 X to 0.26 X mass % ($0.02 \leqq C/X \leqq 0.26$).

One or more of S, Se and Te is in the ranges of (Z−0.047)X to (Z+0.07)X mass %, (Z+0.07)X to (Z+0.45)X mass %, the lower limit not included, wherein Y=S %+0.41 Se %+0.25 Te % is indicated by Y and $Z=32(C/X-0.125)^2$.

In a case where Y is in the range of (Z−0.047)X to (Z+0.07)X mass %:

The reason why Y is set to (Z−0.047)X to (Z+0.07)X mass % ($-0.047 \leqq \alpha \leqq 0.07$) and C is set to 0.19 X to 0.26 X mass % ($0.19 \leqq C/X \leqq 0.26$) is that in electromagnetic stainless steel of the composition, the soft magnetic characteristics and cold workability are especially excellent, machinability is good due to dispersion in a fine state of $(Ti,Zr)_4C_2(S,Se,Te)_2$ and (Ti,Zr) (S,Se,Te), the latter of which is formed at a small amount, and moreover, corrosion resistivity is good as well. However, when Y is lower than (Z−0.047)X %, that is when Y/X is lower than $32(C/X-0.125)^2-0.047$, formation of $(Ti,Zr)_4C_2(S,Se,Te)_2$ is excessively small in amount and thereby the effect thereof is poor, while Y is higher than (Z+0.07)X mass %, that is when Y/X is higher than $32(C/X-0.125)^2+0.07$, the soft magnetic characteristics, cold workability and corrosion resistance are degraded on the contrary and therefore, Y is set in the range (Z−0.047)X to (Z+0.07)X mass %.

In a case where Y is in the range of (Z+0.07)X to (Z+0.45)X, the lower limit not included, mass %:

The reason why Y is set in the range of (Z+0.07)X to (Z+0.45)X, the lower limit not included, mass % ($0.07 \leqq \alpha \leqq 0.45$) and C is set in the range of 0.02X to 0.26X mass % ($0.02 \leqq C/X \leqq 0.26$) is that in electromagnetic stainless steel with the composition, there are realized excellent corrosion resistivity and machinability better than when Y is in the range of (Z−0.07)X to (Z+0.07)X mass % and in addition, good soft magnetic characteristics and good workability due to formation of $(Ti,Zr)_4C_2(S,Se,Te)_2$ and (Ti,Zr) (S,Se,Te), slightly increased in amount. However, when Y is higher than (Z+0.45)X mass %, that is when Y/X is higher than$32(C/X-0.125)^2+0.45$, machinability is more excellent due to increase in (Ti,Zr)S, Cr(S,Se,Te) and Mn(S,Se,Te) while cold workability, corrosion resistivity and soft magnetic characteristics are degraded and therefore, Y is set in the range of (Z+0.07)X to (Z+0.45)X mass %.

2 mass % or lower Ni, 2 mass % or lower Cu, 2 mass % or lower Mo, 1 mass % or lower Nb and 1 mass % or lower V:

Ni. Cu, Mo, Nb and V are all useful for more of improvement on corrosion resistivity in a free cutting alloy relating to the fourth selection invention and therefore, the elements are included in the electromagnetic stainless steel. However, when the elements are added in excess of the respective upper limits, soft magnetic characteristics and cold workability are deteriorated. Accordingly, the contents are set as described above.

0.15 mass % or lower Pb; 0.01 mass % or lower B; and 0.1 mass % or lower REM:

Pb is an element included for more of improvement on machinability and since the effect of improving machinability more than in a conventional case can be exerted with a Pb content a half that in the conventional case, the Pb content is set to 0.15 mass % or lower. Particularly, the first and the third combination exhibit excellent machinability despite of the low Pb content less than 0.01 mass %.

Since Band REM are elements useful for improving cold workability more in a steel of a free cutting alloy relating to the fourth selection invention, the elements are added in the steel. However, when the contents exceed the respective above described upper limits, hot and cold workabilities decrease and accordingly, the contents are set as described above. As for REM, since low radioactivity elements are easy to be handled when being mainly used and from this viewpoint, it is useful to use one or more selected from the group consisting of Sc, Y, La, Ce, Pr, Nd, Sm, Eu, Gd, Tb, Dy, Ho, Er, Tm, Yb and Lu. It is desirable to use light rare earth elements, especially La or Ce from the viewpoint of conspicuous exertion of the effect and price. However, there arises no trouble in mixing-in of a trace of radioactive rare earth elements such as Th and U inevitably remaining in a process to separate rare earth elements. Further, from the viewpoint of reduction in raw material cost, there can be used not-separated rare earth elements such as mish metal and didymium.

Description will be given of a production method for free cutting alloy relating to the fourth selection invention constituted as electromagnetic stainless steel as follows:

Free cutting alloy relating to the fourth selection invention has a composition with a content of one or more of Ti and Zr, a content of C and a content of one or more of S, Se and Te, the elements being included in conventional electromagnetic stainless steel, wherein the contents are individually specified and the elements in combinations of the contents are included in the alloy and therefore, electromagnetic stainless steel of the fourth selection invention can be produced by a production method similar to a conventional production method for electromagnetic stainless steel.

Further, the present invention can be preferably applied for (Fe, Ni) based electromagnetic alloy, (Fe, Ni) based heat resisting alloy and (Fe,Ni) based alloy such as Invar alloy, Elinvar alloy and the like with a small thermal expansion coefficient, a small thermal coefficient of an elastic modulus, for use in precision machine parts (hereinafter referred to as a fifth selection invention). In Ni based electromagnetic alloy, the alloy including 20 to 80 mass % Ni is generally used, and there can be exemplified as the alloy; for example, alloys called Permalloy or Perminver. Ni heat resisting alloy including 40 to 80 mass % Ni is widely used.

The fifth selection invention of the present invention containing 20 to 82 mass % Ni and the part except for Ni of which is mainly constituted by one or more of Fe and Cr, (Fe, Ni) based heat resisting alloy or the like. It further contains:

one or more of Ti and Zr so that X defined by the following formula 1 in the range satisfying a relation of $0.05 \leqq X \leqq 3$;

one or more of S, Se and Te so that Y defined by the following formula 2 in the range satisfying a relation of $0.014 \leqq Y \leqq 0.5$ X;

C in the range satisfying a relation of $0.2\ Y \leqq W_C \leqq 0.3$, wherein when a Ti content is indicated by $W_{Ti}$ in mass %, a Zr content by $W_{Zr}$ in mass %, a C content by $W_C$ in mass %, a S content by $W_S$ in mass %, a Se content by $W_{Se}$ in mass % and a Te content by $W_{Te}$ in mass %, the following formulae 1 and 2 are given in order to define X and Y:

$$X(\text{mass }\%)=W_{Ti}+0.52W_{Zr} \quad \text{(formula 1)}$$

$$Y(\text{mass }\%)=W_S+0.41W_{Se}+0.25W_{Te} \quad \text{(formula 2);}$$

one or more of Si, Mn and Al in the respective ranges of 1 mass % for Si, 1 mass % for Mn and 1 mass % for Al;

wherein a (Ti,Zr) based compound containing one or more of Ti and Zr as a metal element component, C being an indispensable element as a bonding component with the metal element component, and one or more of S, Se and Te is dispersed in a matrix metal phase.

The present inventors had findings that in (Fe, Ni) based alloy for use in electromagnetic material and/or heat resistant material (for example Ni or Fe based heat resistant alloy of a solid solution strengthening type), (Ti,Zr) based compound (for example, a compound in the form of $(Ti,Zr)_4(S,Se,Te)_2C_2$)) is formed and thereby, machinability of the alloy is improved. Further findings were added thereto that while some of indispensable elements constituting the (Ti, Zr) based compound acts a harmful influence, such as degradation in performances of electromagnetic material and/or heat resistant material, on the alloy, such a harmful influence can be deleted if a prescribed condition is imposed on contents of the indispensable elements of the (Ti,Zr) based compound, thereby enabling machinability to improve while maintaining excellent performances as the electromagnetic material and/or the heat resistant material.

That is, a free cutting alloy of the present invention with the following composition is excellent in machinability and hot workability without deterioration in excellent performances as electromagnetic material and/or heat resistant material, the composition being:

one or more of Ti and Zr in the range satisfying a relation of $0.05 \leqq X \leqq 3$ (hereinafter referred to as a condition formula (1)), one or more of S, Se and Te in the range satisfying a relation of $0.014 \leqq Y \leqq 0.5\ X$ (hereinafter referred to as a condition formula (2)), C in the range satisfying a relation of $0.2\ Y \leqq W_C \leqq 0.3$ (hereinafter referred to as a condition formula (3)), wherein when a Ti content is indicated by $W_{Ti}$ in mass %, a Zr content by $W_{Zr}$ in mass %, a C content by $W_C$ in mass %, a S content by $W_S$ mass %, a Se content by $W_{Se}$ and a Te content by $W_{Te}$, the following formulae (1) and (2) are given in order to define X and Y:

$$X(\text{mass }\%)=W_{Ti}+0.52W_{Zr} \quad \text{(hereinafter referred to as Formula (1)) and}$$

$$Y(\text{mass }\%)=W_S+0.41W_{Se}+0.25W_{Te} \quad \text{(hereinafter referred to as Formula (2)).}$$

Description will be given of the reason why the elements, contents thereof and condition formulae are selected or determined as follows: (30) 20 to 82 mass % Ni A free cutting alloy of the fifth selection invention of the present invention includes (Fe,Ni) based electromagnetic alloy and (Fe,Ni) based heat resisting alloy. Accordingly, Ni is an indispensable element for the free cutting alloy of the present invention. Further, (Fe,Ni) based electromagnetic alloy and (Fe,Ni) based heat resisting alloy are widely employed with content of the range of 20 to 82 mass % for Ni and since the alloys including Ni in content of this range are particularly required improvement on machinability, the Ni content is limited to the range.

(31) One or more of Ti and Zr in Content Satisfying a Relation of $0.05 \leqq X \leqq 3$ (Hereinafter Referred to as a Condition Formula (1))

When Ti and Zr are added in the above described range together with C, S, Se and Te, (Ti,Zr) based compounds, for example, mainly $(Ti,Zr)_4(S,Se,Te)_2C_2$and/or a small amount of (Ti,Zr) (S,Se,Te), are formed and therefore, Ti and Zr are useful for improvement on machinability. Moreover, since formation of (Mn,Cr,Ni)S, especially NiS, is suppressed, Ti and Zr are also useful for prevention of cracking in hot working and the free cutting alloy of the fifth selection invention can maintain excellent characteristics as (Fe,Ni) based electromagnetic alloy or (Fe,Ni) based heat resisting alloy such as a thermal expansion coefficient, an elastic constant, magnetic characteristics or a high temperature strength. While Ti and Zr is required to be included in the range of 0.05 mass % or higher in X of a compositional parameter in order to attain an effect of improving machinability, X in excess of 3 mass % is not preferable since when X is in excess of 3 mass %, a specific refining method is required, being accompanied with poor productivity. Accordingly, the range of the parameter X is preferably set in the range of 0.5 to 3 mass % and more preferably in the range of 0.1 to 0.5. Further, when Ti and Zr are included in the range satisfying the condition formula (1), either one of Ti and Zr or both Ti and Zr may be included.

(32) One or more of S, Se and Te in Contents Satisfying a Relation of $0.014 \leqq Y \leqq 0.5\ X$ (hereinafter Referred to as a Condition Formula (2))

S, Se and Te are indispensable elements for formation of the above described (Ti, Zr) based compound. Therefore, the elements are indispensable components for improvement on machinability and are required to be included in the range of 0.014 mass % or higher in terms of the parameter Y. When the elements are added in excess, a compound not useful for improving machinability is formed and in a case, performances of the alloy are deteriorated. Therefore, when the parameters X and Y are related so as to satisfy the above described condition formula (2), that is when the parameter Y corresponding to a total number of S, Se and Te atoms is half the parameter X corresponding to a total number of Ti and Zr atoms, an additive amount of one or more of S, Se and Te is not excessive but falls within the proper range in amount and therefore, formation of a compound not useful for improvement on machinability can be suppressed and deterioration in performances of the alloy can be prevented or suppressed. As far as S, Se and Te are included in the ranges to satisfy the condition formula (2), either only one of them or two or more of them may be included in the alloy.

(33) C in Content Satisfying a Relation of $0.2\ Y \leqq W_C \leqq 0.3$ (hereinafter Referred to as a Condition Formula (3))

C forms (Ti,Zr) based compound in co-existence with Ti and Zr, and S, Se and Te and, it is an indispensable element for improvement on machinability. Moreover, C acts usefully for prevention of cracking occurrence in hot workability. Especially, since C accelerates formation of $(Ti,Zr)_4(S,Se,Te)_2C_2$ more stable than (Ti,Zr) (S,Se,Te), improvement by C on machinability is more effective. It is necessary to include C so as to satisfy the condition formula (3) for achievement of the effects. That is, C is required to be included in the range of at least more than 0.2 times the parameter Y(a parameter on which a total number of S, Se and Te atoms is reflected). When a C content $W_C$ is $W_C<Y/5$, the C content is excessively small, the effect of improving machinability cannot be acquired. On the other hand, an excessive addition of C is not preferable since such a C content causes deterioration in performances of Ni based electromagnetic alloy and Ni based heat resisting alloy. Accordingly, the C content $W_C$ is preferably limited to 0.3 mass % or lower. When the C content exceeds 0.3 mass %, loss of performances of Ni based alloy becomes large. The C content is desirably set in the range of Y/4 to 0.2 mass % and more desirably in the range of Y/4 to Y/2 mass %.

The fifth selection invention of the present invention constituted as (Fe,Ni) based alloy can contain one or more of Si, Mn and Al in the respective ranges of 1 mass % or lower for Si; 1 mass % or lower for Mn; and 1 mass % or lower for Al. Description will be given of the reason why the elements and contents thereof are selected as follows:

(34) 1 Mass % or Lower Si

Si is an element useful as a deoxidizing agent and in addition, for adjustment of hardness and electric resistivity and accordingly, added depending on a necessity. However, when an additive amount of Si is in excess, hardness after heat treatment for solid solution is excessively high, which disadvantageously brings poor workability. Characteristics such as thermal expansion, an elastic constant, magnetic characteristics, heat resistance (high temperature strength) and the like are degraded in some cases. Accordingly, the Si content is limited to 1 mass % as the upper limit and when cold workability is regarded as an important requirement, the Si content is preferably set to 0.5 mass % or lower.

(35) 1 Mass % or Lower Mn

Mn is an element useful as an deoxidizing agent and further, since Mn forms a compound excellent in machinability in co-existence with S and Se, Mn is added to alloy according to a requirement especially when machinability is regarded as important. The Mn content is desirably set to 0.1 mass % or higher in order to attain more conspicuousness of the effect. On the other hand, when added in excess, corrosion resistivity and cold workability are degraded and deterioration sometimes occurs in characteristics such as thermal expansion, an elastic constant, magnetic characteristics, heat resistivity (high temperature strength) and the like as well. Accordingly, the Mn content is preferably limited to 1 mass % or lower and more desirably to 0.5 mass % or lower.

(36) 1 Mass % or Lower Al

Al is an element useful as a deoxidizing agent and added to alloy in necessary since Al is effective for adjustment for hardness and electric resistivity. However, when added in excess, deterioration sometimes occurs in characteristics such as thermal expansion, an elastic constant, magnetic characteristics, heat resistivity (high temperature strength) and the like. Accordingly, the Al content is limited to 1 mass % or lower.

Further, the above described free cutting alloy using (Fe,Ni) based alloy as base can contain Mo or Cu in the ranges of 7 mass % or lower for Mo; and 7 mass % or lower for Cu. Description will be given of the reason why the elements and contents thereof are selected as follows:

(37) 7 Mass % or Lower Mo

Mo is an element useful for improvement on corrosion resistivity and strength. When the effects are desired to be conspicuous, Mo is preferably included in the range of 0.2 mass % or higher. On the other hand, when added in excess, not only is hot workability deteriorated, but cost-up also occurs and furthermore, deterioration sometimes occurs in characteristics such as thermal expansion, an elastic constant, magnetic characteristics, heat resistivity (high temperature strength) and the like. Accordingly, the Mo content is preferably limited to 1 mass % or lower and more desirably to 0.7 mass % or lower.

(38) 7 Mass % or Lower Cu

C is not only useful for improvement on corrosion resistivity, especially in an environment of a reducing acid, but effective for improvement on moldability, decreasing work hardnability. Moreover, since heat treatment or the like processing can also improve an antibacterial property, Cu may be added to the alloy according to a necessity. However, since when added in excess, hot workability decreases, the Cu content is preferably set to 7 mass % or lower and especially when hot workability is regarded as important, the Cu content is desirably suppressed to 4 mass % or lower.

Further, a free cutting alloy of the present invention can contain 12 mass % or lower Cr and moreover, 18 mass % or lower Co. For example, in 30~40 Ni—Fe alloy, magnetostriction acts so as reduce a volume in company with reduction in spontaneous magnetization, which cancels thermal expansion in the ordinary sense. Especially, 36 at % Ni—Fe alloy is generally called Invar alloy and a thermal expansion coefficient in the vicinity of environment temperature is very small, which makes the alloy find a practically important application. The alloy is in many cases used in precision machine material such as of a spring for a measuring instrument. By adding Cr or Co to such an alloy, it is possible to effectively control a thermal expansion coefficient and an elastic constant and thereby, desired performances to match with an intended application can be attained. While Cr is more effective for control of an elastic constant and Co is more effective for control of a thermal expansion coefficient, the elements are not limited to the use in the controls. When Cr or Co are added in excess of the respective above described ranges, an unfavorably large change occurs in compositional conditions on the elements of Ti, Zr, S, Se, Te and C associated with formation of $(Ti,Zr)_4(S,Se,Te)_2C_2$. Accordingly, the Cr and Co contents are set to 12 mass % or lower and 18 mass % or lower, respectively.

Materials to which the present invention can be applied are in a concrete manner exemplified in trade names among Permalloy generally used as high permeability material, Perminvar used as iso-permeability magnetic material and functional material such as alloy excellent in invar characteristics represented by Invar, and in addition solid-solution strengthening type heat resisting material. It should be appreciated that in the case of stainless steel, an alloy composition means a composition in which part of Fe and Ni as main components is replaced with the elements of Ti, Zr, S, Se, C and the like effective for improvement on machinability in the compositional ranges defined in the present invention. Accordingly, while trade names are employed, alloys under the trade names mean alloys specific to the present invention composed with the alloys of compositions under product specifications as a base only (it should be appreciated that the alloy compositions inherent in products under respective trade names are described in a literature (Revised 3rd Version Kinzoku (Metal) Data Book published by Maruzen, p 223), therefore detailed description thereof is omitted):

(1) High permeability materials including 78-Permalloy, 45-Permalloy, Hipernik, Monimax, Sinimax, Radiometal, 1040 Alloy, Mumetal, Cr-Permalloy, Mo-Permalloy, Supermalloy, Hardperm, 36-Permalloy and Deltamax;

(2) Iso-permeability alloy including 25-45 Perminvar, 7-70 Perminvar, 7-25-45 Perminvar, Isoperm and Senperm;

(3) Invar alloy including Invar, Superinvar, Stainlessinvar, Nobinite alloy and LEX alloy;

(4) Elinvar alloy including Elinvar, EL-1, EL-3, Iso-elastic, Metelinvar, Elinvar Extra, Ni-Span C-902, Y Nic, Vibralloy, Nivarox CT, Durinval I, Co-Elinvar and Elcoloy IV;

(5) Fe based super heat resisting alloy including Haynes 556, Incoloy 802, S-590, 16-25-6 and 20-CB3; and (6) Ni basedheat resisting alloy including Hastelloy-C22, Hastelloy-C276, Hastelloy-G30, Hasteolloy X, Inconel 600 and KSN.

EXAMPLES

The following experiments were performed in order to confirm the effects of the present invention. It should be appreciated that in the following description, test alloy relating to the present invention is referred to as inventive steel or inventive alloy, and test alloy relating to each of the selection inventions is referred to as a selection inventive steel or a selection inventive alloy.

Example 1

Ferrite Containing Stainless Steel (Corresponding to the First Selection Invention)

The effects of a free cutting alloy constituted as ferrite containing stainless steel (a first selection inventive steel) were confirmed by the following experiment. First, 50 kg steel blocks with respective compositions in mass % shown in Table 1 were molten in a high frequency induction furnace and ingots prepared from the molten blocks were heated at a temperature in the range of from 1050 to 1100° C. and the ingots were forged in a hot state into rods with a circular section of 20 mm diameter and the rods were further heated at 800° C. for 1 hr, followed by air cooling (annealing) as a source for test pieces.

Figure 2:
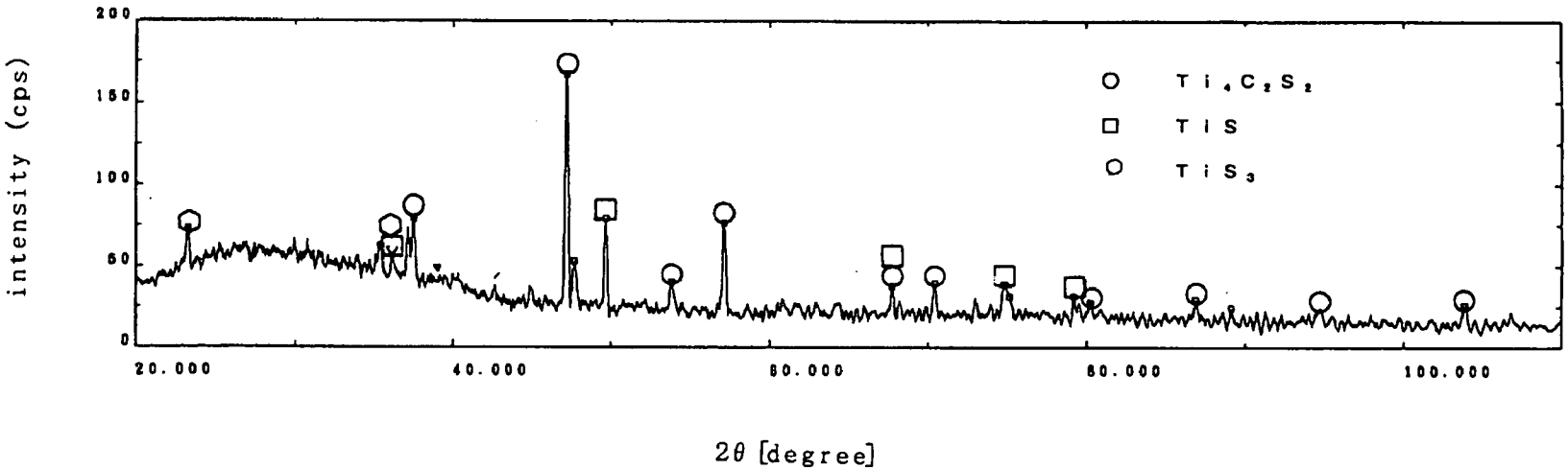
FIG. 2 is a graph showing an X-ray diffraction chart of an inventive steel specimen No. 5 in experiment of Example 1.
Figure 3:
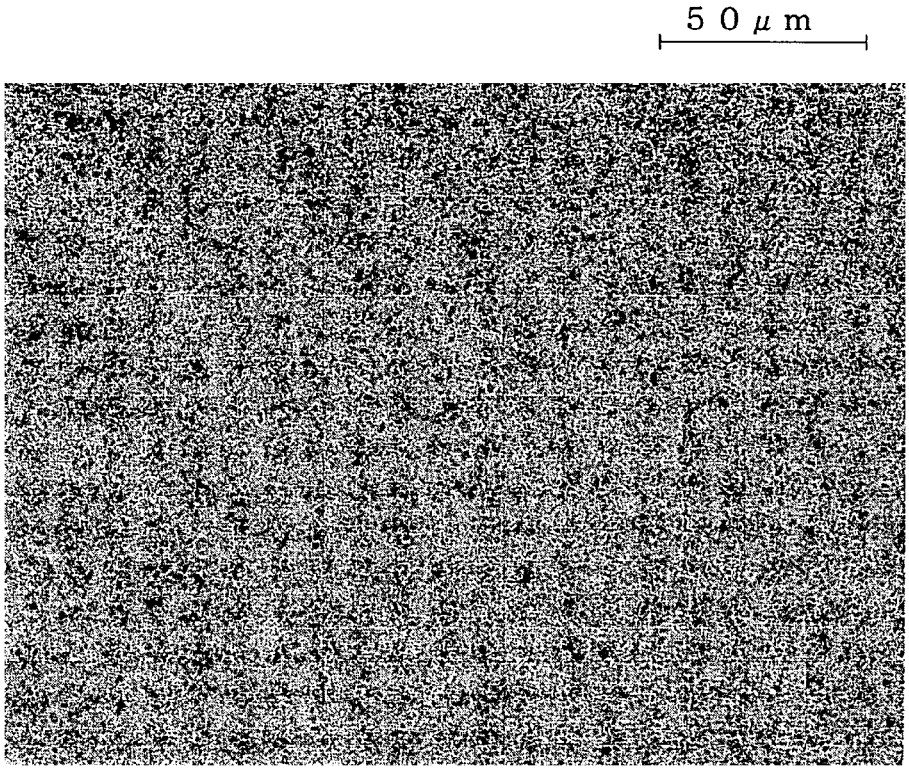
FIG. 3 is an optical microphotograph of the inventive steel specimen No. 5 in Example 1.

While main inclusions of an inventive steel of the present invention was $(Ti,Zr)_4(S,Se)_2C_2$, other inclusions such as (Ti,Zr)S and $(Ti,Zr)S_3$ are locally recognized in the matrix. Further, in a specimen No. 7 high in Mn content, (Mn, Cr)S is recognized, though in a trace amount. An identification method for inclusions was performed in the following way: A test piece in a proper amount was sampled from each of the rods. A metal matrix portion of the test piece was dissolved by electrolysis using a methanol solution including tetramethylammonium chloride and acetylaceton at 10% as a electrolytic solution. The electrolytic solution after the electrolysis was subjected to filtration and compounds not dissolved in steel were extracted from the filtrate. The extract was dried and subjected to chemical analysis by an X-ray diffraction method with a diffractometer. A compound was identified based on peaks of a diffraction chart. A composition of a compound particle in the steel structure was separately analyzed by EMA and a compound with a composition corresponding to a compound observed by X-ray diffraction was confirmed based on formation from two dimensional mapping results. FIG. 2 shows an X-ray diffraction chart of an inventive steel No. 5 by a diffractometer and FIG. 3 is an optical microphotograph of an inventive steel specimen No. 5 shot on a surface thereof in a magnification 400×. Further, specimens Nos. 1 to 14 in Table 1 are kinds of steel corresponding to the first selection inventive steel and specimens Nos. 15 to 24 are of kinds of steel as comparative examples.

The following experiments were performed on the above described test pieces:

1) Hot Workability Test

Evaluation of hot workability was effected based on visual observation of whether or not defects such as cracks occur in hot forging. (○) indicates that substantially no defect occurred in hot forging, (x) indicates that large scale cracks were recognized in hot forging and Δ indicates that small cracks occurred in hot forging.

2) Evaluation of Machinability

Evaluation of machinability was collectively effected based on cutting resistance in machining, finished surface roughness and chip shapes. A cutting tool made of cermet was used to perform machining under a dry condition at a circumferential speed of 150 m/min, a depth of cutting per revolution of 0.1 mm and a feed rate per revolution of 0.05 mm. A cutting resistance in N as a unit was determined by measuring a cutting force generating in the machining. The finished surface roughness was measured by a method stipulated in JIS B 0601 and a value thereof was an arithmetic average roughness (in μn Ra) on a test piece surface after the machining. Moreover, chip shapes were visually observed and when friability was good, the result is indicated by (G) and when friability is bad and all chips are not separated but partly connected, the result is indicated by (B).

3) Evaluation of Out-Gas Resistivity

Evaluation of out-gas resistivity was performed by determining an amount of released S. To be concrete, test pieces in use each had the shape of a rectangular prism of 15 mm in length, 25 mm in width and 3 mm in thickness and the entire surface of each were polished with an emery paper. A test piece was placed in a sealed vessel having an inner volume of 250 cc together with a silver foil having a size of 10 mm in length, 5 mm in width and 0.1 mm in thickness and 0.5 cc of pure water, and a temperature in the vessel was maintained at 85° C. for 20 hr. A S content $W_{SO}$ in the silver foil after the process for the test was measured by a combustion type infrared absorbing analysis method.

4) Cold Workability Test

Evaluation of cold workability was performed by measuring a threshold compressive stain in a compression test on specimens Nos. 1 to 5 and 13. Test pieces for compression each had the shape of a cylinder of 15 mm in diameter and 22.5 mm in height and each piece was compressed by a 600 t oil hydraulic press to obtain a threshold compressive strain, wherein the threshold compressive strain is defined as ln (H0/H) or a natural logarithm of H0/H, H0 being an initial height of the test piece and H being a threshold height which is a maximum height at which no cracking has occurred. First selection inventive alloys of the specimens Nos. 1 to 5 were confirmed to have high threshold compressive ratios almost equal to comparative steel specimen No. 15 and higher than comparative steel specimen No. 16 by about 20%, and have a good cold workability as well.

5) Evaluation of Corrosion Resistivity

Evaluation of corrosion resistivity was performed by a salt spray test. Test pieces each were prepared so to have the shape of a cylinder of 10 mm in diameter and 50 mm in height. The entire surface of each test piece was polished with #400 emery paper and cleaned. A test piece was exposed to a fog atmosphere of 5mass % NaCl aqueous solution at 35° C. for 96 hr. Final evaluation was visually performed with the naked eye. As a result, the inventive steel of the present invention was confirmed to maintain good corrosion resistivity. The results are shown in Table 2.

6) Evaluation of Tool Wear

Cutting test was performed using an NCl a the equipped with a cemented carbide (JIS:M10) chip as a cutting tool according to the conditions listed below, and thereafter the amount of wear of the tool (μm) was measured.

Cutting speed: 100 m/min;
Depth of cutting per revolution: 0.3 mm;
Feed rate per revolution: 0.050 mm;
Cutting oil: water-insoluble; and
Cutting time: 90 min.

It is found from Table 2 that first selection inventive steel of the present invention is comparable with conventional ferrite containing stainless steel in hot workability, cold workability and corrosion resistivity and moreover, is better in machinability than the conventional ferrite containing stainless steel. Further, it is found from Table 2 when comparing with comparative steel specimens Nos. 16 and 18 that the first selection inventive steel of the present invention is smaller in $W_{SO}$ and better in out-gas resistivity. The reason why kinds of steel of comparative alloy specimens Nos. 16 and 18 each have a high $W_{SO}$ is considered that since the steel of the kinds has neither Ti nor Zr, carbo-sulfide is hard to be formed, whereby a S amount in the matrix is excessively high. In comparative alloy specimen No. 18, hot workability is poor and therefore, evaluation of machinability was not performed.

As compared with comparative steel specimen No. 19, it is found that the first selection inventive steel of the present invention causes only a less amount of wear of the tool. The larger amount of wear of tool shown by the comparative steel specimen No. 19 is supposed to be ascribable to lack of S content, and consequent formation of carbides (e.g., TiC) in the steel.

As compared with comparative examples 20 and 21, it is found that the first selection inventive steel of the present invention is small in cutting resistance. The larger cutting resistance shown by comparative examples 20 and 21 is supposed to be ascribable to an insufficient amount of formation of (Ti, Zr)-base compound in the steel due to lack of C or Ti content, and an insufficient crush of the chip.

As compared with comparative example 22, the first selection inventive steel of the present invention is excellent in machinability and out-gas resistivity and causes only a small amount of wear of tool. Inferiority of comparative example 22 in these properties is supposed to be ascribable to lack of Ti content, and this failed in formation of (Ti, Zr)-base compound in the steel but, instead, resulted in formation of MnS and $Cr_{23}C_6$.

As compared with comparative examples 23 and 24, it is found that the first selection inventive steel of the present invention is excellent in corrosion resistance and out-gas resistivity. Inferiority of comparative examples 23 and 24 in these properties is supposed to be ascribable to lack of Ti and C contents, which resulted in formation, in the steel, of MnS by S which does not contribute to formation of the (Ti, Zr)-base compound.

It is to be noted that the ranges of Ti, S and C contents described in the claims of Japanese Patent Document No. 11-140597, No. 10-130794, No. 6-200355 and No. 2-179855 partially overlap the scope of the first selection inventive steel of the present invention. These references, however, give no specific disclosure at all as for satisfying the ranges of $W_S/(W_{Ti}+0.52W_{Zr})$, $(W_{Ti}+0.52W_{Zr})/W_c$ and $(W_S+W_{Se})/W_c$, which are essential features of the first selective inventive steel of the present invention. For example, reference will be made on examples No. 11-15 in Japanese Patent Document No. 10-130794, and example Nos.1-11 in Japanese Patent Document No. 6-200355.

It is obvious from the above-described results that the machinability, corrosion resistance, out-gas resistivity and tool wear resistance are excellent within the ranges of $W_S/(W_{Ti}+0.52W_{Zr})$, $(W_{Ti}+0.52W_{Zr})/W_C$ and $(W_S+W_{Se})/W_C$ as specified by the first selection inventive steel of the present invention, whereas any of these properties goes bad out of these ranges.

The prior arts publications, i.e., JP11-140597 ('597) and JP10-130794 ('794) seem to disclose alloy composition having composition overlapping for several elements. Table 16 presents the ferrite containing stainless steel of this invention in contrast to these publications.

Although '597 coincides with the ferrite containing stainless steel of this invention in some of the components, the ratio WS/(WTi+0.52WZr) of the content of S (WS) to the content of Ti/Zr (WTi+0.52WZr) is not specifically defined in '597. As a specific alloy composition by adding S and Ti, No. 13 in Table 1 of '597 is presented as only one example, but when WS/(WTi+0.52WZr) is calculated, it is 2.33, which is out of the range (0.45 or less) defined in the ferrite containing stainless steel of this invention. When WS/(WTi+0.52WZr) exceeds 0.45, the out-gas resistivity cannot be assured sufficiently. In these tables, results of reference alloys 19 and 20 tested are presented in Table 2. Alloy 20 has a same composition as in '597, and WS/(WTi+0.52WZr) is 2.33. On the other hand, alloys 1 to 14 are compositions corresponding to the ferrite containing stainless steel of this invention, and WS/(WTi+0.52WZr) is 0.45 or less in all of them. Reference alloy 20 has a considerably large value of W0S as the index of out-gas resistivity, whereas alloys 1 to 14 in the ferrite containing stainless steel of this invention are small in the value of W0S, and are hence known to be excellent in out-gas resistivity.

On the other hand, in '794, the content of C is defined at 0.03 mass % or less. This C content overlaps with that of the ferrite containing stainless steel of this invention, i.e., 0.021-0.4 mass %. However, all specific alloy examples in '794 are compositions with C content of 0.02 mass % or less as shown in Table 1 of '794. The reason limiting is as follows according to paragraph 0007 of the publication: "Although C is a representative solid solution reinforcing element, its content is preferred to be lower because it has adverse effects of lowering the corrosion resistance and toughness at ordinary temperature. However, if decreased extremely, the manufacturing cost is raised, and hence considering the refining technology, its upper limit is defined at 0.03%." This purpose is completely different from enhancement of machinability relating to the ferrite containing stainless steel of this invention. Of course, nothing is mentioned in '794 about the effect of enhancement of machinability by sufficient formation of (Ti, Zr) based compound by selecting the C content of 0.021 mass % or more in the wide C content range up to 0.03 mass % in '794.

In experimental data in Tables 1 and 2, in reference alloy 19 of which C content is lower than 0.021 mass %, the cutting resistance is high, whereas the cutting resistance is lower than 25 N in alloys 1 to 14 in the ferrite containing stainless steel of this invention, and a favorable machinability is realized.

Thus, the ferrite containing stainless steel of this invention achieves, in a composition range more limited than in '597 and '794, evident and unpredictable effects not disclosed in these publications.

Example 2

Martensite Containing Stainless Steel (Corresponding to the Second Selection Invention)

The following experiment was performed on martensite containing stainless steel and second selection inventive steel of the present invention. First, 50 kg steel blocks of compositions in mass % shown in Table 3 were molten in a high frequency induction furnace to form respective ingots. The ingots were heated at temperature in the range of from 1050 to 1100° C. to be forged in a hot state and be formed into rods each with a circular section, of a diameter of 20 mm. The rods were further heated at 750° C. for 1 hr, followed by air cooling to be applied to the test.

In Table 3, specimens Nos. 1 to 19 are second selection inventive steels of the present invention constituted as martensite containing stainless steel. Further, in comparative examples, specimens correspond to stainless steel: a specimen No. 20 corresponds to SUS 410, a specimen No. 21 to SUS 416, a specimen No. 22 to SUS 420F and a specimen No. 23 to SUS 440F. Further, specimens Nos. 24 to 26 are of stainless steel, wherein a C content of each does not satisfy the formulae A and B, and although alloy of the specimens is outside the scope of the second selection invention, the alloy still falls within the scope of the present invention.

Figure 4:
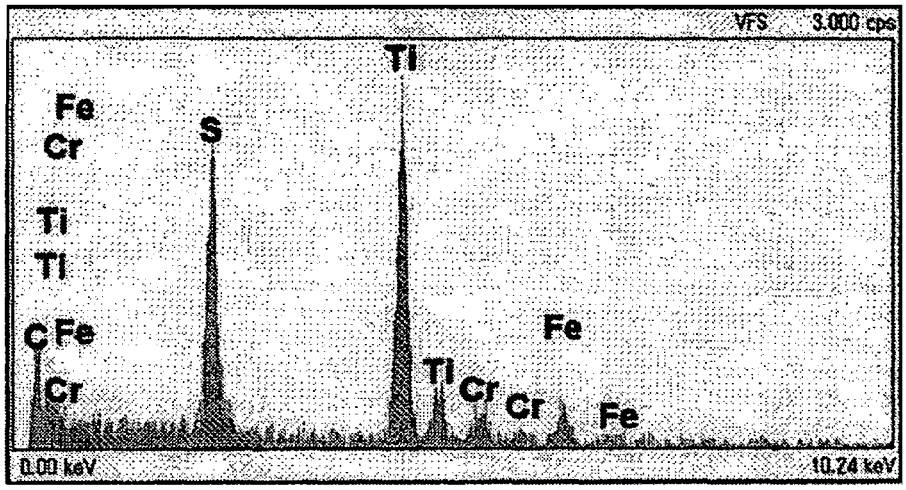
FIG. 4 is a graph showing EDX analytical results of a second selection inventive specimen No. 2 in Example 2.
Figure 5A:
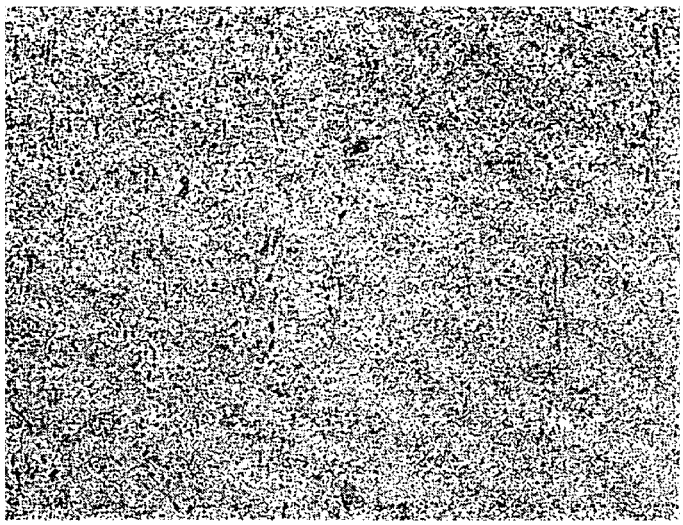
FIGS. 5A and 5B are optical microphotograph of second selection inventive steels specimen Nos. 2 and 13 in Example 2.
Figure 5B:
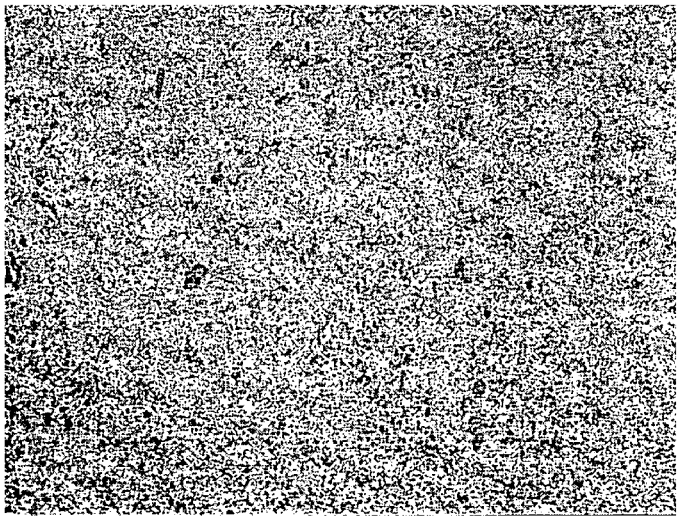
Figure 6:
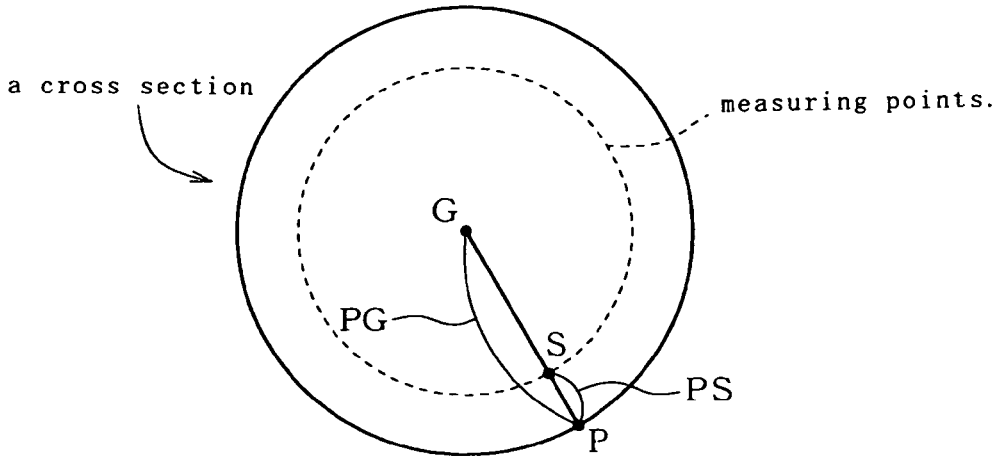
FIG. 6 is a representation describing measuring points for a hardness test in Example 2.

While main inclusions of the inventive steel of the present invention was of $(Ti,Zr)_4(S,Se)_2C_2$, other inclusions such as (Ti,Zr)S and (Ti, Zr)$S_3$ are locally recognized in the matrix. Further, in a specimen No. 9 high in a Mn content and the like, (Mn,Cr)S was recognized, though in a small amount. An identification of inclusions was performed similar to in Example 1. FIG. 4 shows EDX (Energy Dispersive X-ray spectrometer) analytical results of inclusions in a second selection inventive steel specimen No. 2 and from the results, formation of (Ti,Zr) based compound can be recognized. Further, FIGS. 5A and 5B show optical microphotograph of second selection inventive steel specimens Nos. 2 and 13 shot under a magnification of 400×.

The following experiment was performed on the above described test pieces.

1) Hot Workability Test

Evaluation of hot workability was effected based on visual observation of whether or not defects such as cracks occur in hot forging. While workability in hot forging was at levels at which processing can be performed with no problem, as not only inclusions but an amount of alloy elements increase, deterioration in the workability was a tendency observed in the test. It was found that kinds of steel of the present invention in which one or more of Ca, B, Mg and REM was included had good hot workability when comparing with a kind of steel in which none of the elements was included.

2) Evaluation of Machinability

Evaluation of machinability was collectively effected based on tool ware loss in machining, finished surface roughness and ship shapes. A cutting tool made of cermet was used to perform machining under a wet condition by water-soluble cutting oil at a circumferential speed of 120 m/min, a depth of cutting per revolution of 0.1 mm and a feed rate per revolution of 0.05 mm. The tool ware loss was measured at a flank of the cutting tool after 60 min machining with μm as a unit of the tool wear loss. The finished surface roughness was measured by a method similar to that in Example 1.

The following evaluations were performed using material subjected to treatments in which the material is kept at 980 to 1050° C. for 30 min, thereafter subjected to a quenching heat treatment and still further subjected to a tempering treatment of holding at 180° C. for 1 hr, followed by air cooling.

3) Hardness Test

Measurement of hardness on a test piece was performed on a C scale Rockwell hardness by the Rockwell hardness test stipulated in JIS Z 2245. The Rockwell hardness was obtained as the average of measurements at arbitrary 5 measuring points S on a circle drawn on a cross section of a rod test piece having a circular section, the circle drawn on the cross section being a circle satisfying a relation of PS=0.25 PG, wherein G denotes a point almost coinciding with a center of the circular section, P denotes an arbitrary point on the outer periphery of the test piece and a point S is on a line segment PG.

4) Evaluation of Out-Gas Resistivity

Evaluation of out-gas resistivity was performed similar to in Example 1.

5) Evaluation of Corrosion Resistivity

Evaluation of corrosion resistivity was performed by a method similar to in Example 1. Test pieces each were prepared so to have the shape of a cylinder of 15 mm in diameter and 50 mm in height. The entire surface of each test piece was polished. Each test piece was polished and thereafter, a test piece was held in a thermohygrostatat a temperature of 60° C. and a relative humidity of 90% RH for 168 hr. An evaluation method was such that when no rust was confirmed, the test piece was evaluated (A), when dot-like stains were recognized at several points on a test piece, the test piece was evaluated (B), when red rust was recognized in an area of an area ratio of 5% or less, the test piece was evaluated (C) and when red rust was recognized in an area wider than an area ratio of 5%, the test piece was evaluated (D). The results are shown in Table 4.

It is found from Table 4 that while in stainless steel of comparative specimens Nos. 20 to 23, hardness is sufficiently ensured, machinability is poor. It is further found that specimens Nos. 21 to 23 are inferior in corrosion resistivity and out-gas resistivity. When an inventive steel is compared with a second selection inventive steel, it is found that the inventive steel has improved machinability, while the second selection inventive steel has improved hardness, improved corrosion resistivity and improved out-gas resistivity. The reason why the second selection inventive steel was improved in hardness as compared with the inventive steel is considered that a C content satisfies the formulae A and B and thereby, a C content constituting a (Ti,Zr) based compound and a C content as additive establishes an adjusted balance and thereby, a C component is sufficiently dispersed in a Fe based matrix phase. Further, the reason why out-gas resistivity was improved is considered that S is added excessively relative to an amount of a (Ti,Zr) based compound that can be formed.

As compared with comparative examples 24 and 25, it is found that the second selection inventive steel of the present invention is excellent in machinability. The undesirable machinability shown by the comparative steel specimens No. 24 and 25 is supposed to be ascribable to lack of S content, and consequent formation of carbides (e.g., TiC) in the steel.

As compared with comparative example 26, it is found that the second selection inventive steel of the present invention is excellent in hardness. The small hardness shown by comparative example 26 is supposed to be ascribable to lack of C content, and consequent lack of C in the matrix.

As compared with comparative example 27, it is found that the second selection inventive steel of the present invention is excellent in hardness and machinability. The small hardness shown by comparative example 27 is supposed to be ascribable to lack of C and S contents, and consequent lack of C in the matrix, and consequent formation of carbide (e.g., TiC) in the steel.

As compared with comparative example 28, it is found that the second selection inventive steel of the present invention is excellent in hardness, corrosion resistance and out-gas resistivity. Inferiority of comparative example 28 in these properties is supposed to be ascribable to lack of Ti and C contents which resulted in formation, in the steel, of MnS by S which does not contribute to formation of the (Ti, Zr)-base compound.

As compared with comparative examples 29 to 32, it is found that the second selection inventive steel of the present invention is excellent in hardness, machinability and tool wear resistance. Inferiority of comparative examples 29 to 32 in these properties is supposed to be ascribable to lack of Ti, C and S contents which resulted in formation of only an insufficient amount of (Ti, Zr)-base compound.

It is to be noted that the ranges of Ti and C contents described in the claims of Japanese Patent Document No. 5-171364, No. 63-93843 and Honkura et al. partially overlap the scope of the second selection inventive steel of the present invention. These references, however, give no specific disclosure at all as for satisfying other ranges of the second selection inventive steel of the present invention.

It is obvious from the above-described results that the machinability, corrosion resistance, out-gas resistivity and hardness are excellent within the ranges of the second selection inventive steel of the present invention, whereas any of these properties goes bad out of these ranges.

The prior arts publications, i.e., U.S. Pat. No. 4,969,963 (Honkura), JP2-170948 ('948) and JP63-93843 ('843) seem to disclose alloy composition having composition overlapping for several elements. Table 17 presents the martensite containing stainless steel of this invention in contrast to these publications.

Specifically, in the martensite containing stainless steel of this invention, the content of C is defined at 0.19 mass % or more, but as shown in Table 17, the content of C is 0.15 mass % or less in all publications. For example, in line 59 of column 2 of Honkura, the content of C is indicated to be less than 0.15%.

According to the martensite containing stainless steel of this invention, if the content of C is less than 0.19 mass %, quench-hardening is not sufficient, and the hardness of steel tends to be insufficient. As specifically described in the specification, aside from sufficient hardness by hardening, in order to enhance the machinability by forming (Ti, Zr) based compound, the composition ranges of Ti/Zr and S/Se/Te are defined.

According to Table 3 and Table 4 attached to the specification, numbers 25 and 26 show results when the content of C is less than 0.19 mass %, and the hardness after hardening is as low as 21 or 28 in HRC. On the other hand, in numbers 1 to 19 corresponding to the martensite containing stainless steel of this invention, the content of C is 0.19 mass % or more, and the hardness is 32 or higher.

Thus, the martensite containing stainless steel of this invention achieves, in a composition range more limited than in Honkura, '948 and '843, evident and unpredictable effects not disclosed in these publications.

Example 3

Austenite Containing Stainless Steel (Corresponding to the Third Selection Invention)

An experiment was performed on a free cutting alloy of the present invention constituted as austenite containing stainless steel (a third selection inventive steel). 50 kg blocks of compositions in mass % shown in Table 5 were molten in a high frequency induction furnace to form ingots. The ingots were heated at a temperature in the range from 1050 to 1100° C. and hot forging was applied on the ingot at the same temperature to be formed into rods each having a circular section, of a diameter of 20 mm. Specimens Nos. 1 to 18 and 22 to 26 are steel corresponding to third selection inventive steels and specimens Nos. 19 to 21 and 27 to 29 are of comparative steels. The specimen No. 19 corresponds to SUS 304, the specimen No. 20 to SUS 303, the specimen No. 27 to SUS 329J4L. Among them, the specimens Nos. 1 to 21 are kinds of steel for use in application of a non-magnetism and the specimens Nos. 22 to 29 are kinds of steel for use in application other than non-magnetism. Among them, the specimens Nos. 1 to 24 and 27 were heated at 1050° C. for 1 hr and thereafter water-cooled, while the other kinds of steel were heated at 750° C. for 1 hr and thereafter water-cooled. Thereafter, both group of kinds of steel were further heated at 650° C. for 2 hr and thereafter water-cooled, followed by tests. All the test pieces of inventive steels obtained each had a main phase in which at least an austenitic phase was formed. Main phases of third selection inventive steels are shown in Table 5, wherein A denotes an austenitic phase, B a ferritic phase and C a martensitic phase.

Figure 8A:
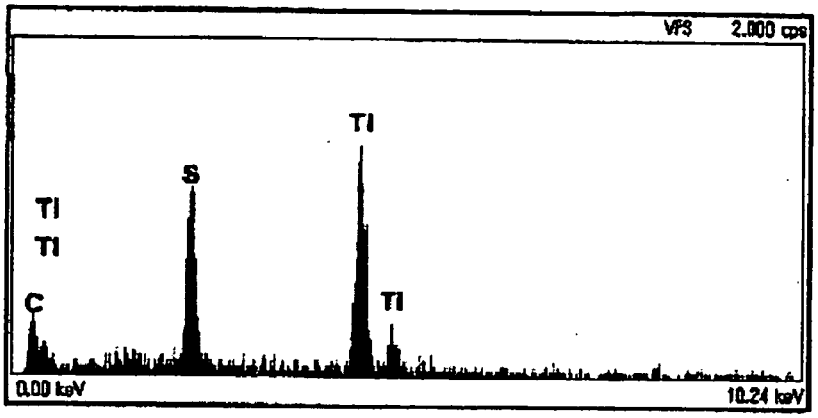
FIGS. 8A and 8B are graphs showing EDX analytical results of a third selection inventive steel specimen No. 2 in experiment of Example 3.
Figure 8B:
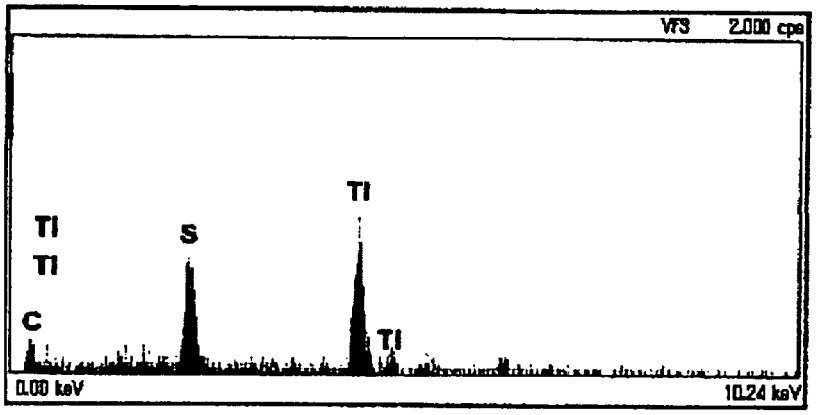
Figure 9:
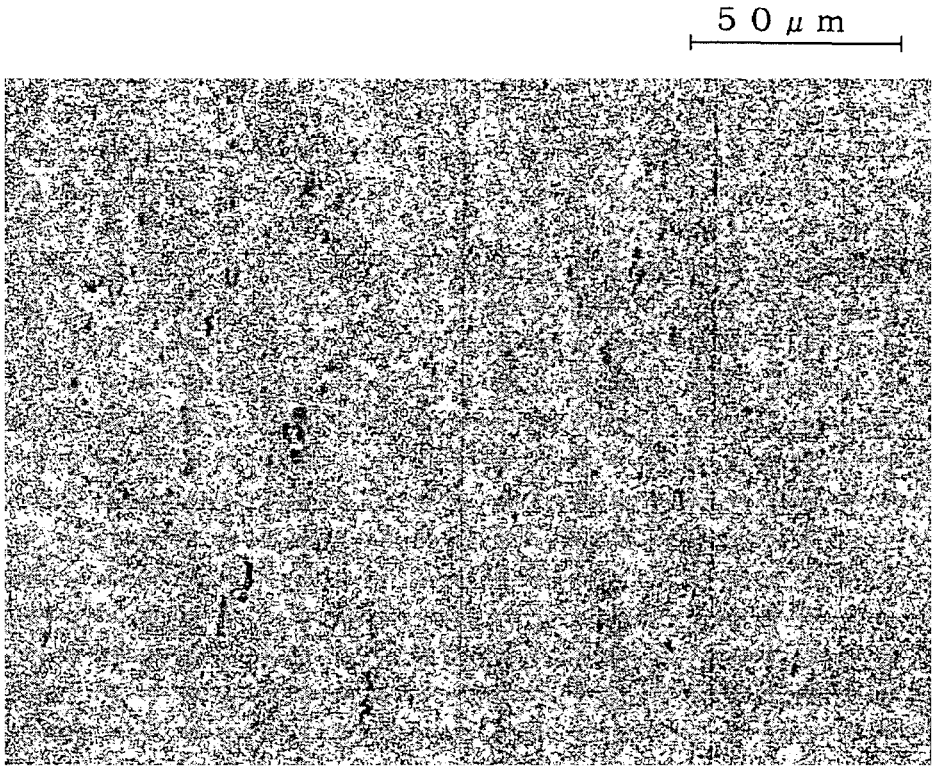
FIG. 9 is an optical microphotograph of the third selection inventive steel No. 2 in Example 3.

While main inclusions of the inventive steel of the present invention was of $(Ti,Zr)_4(S,Se)_2C_2$, other inclusions such as (Ti,Zr)S and $(Ti,Zr)S_3$ are locally recognized. Further, in specimens Nos. 9, 10 and 13 high in a Mn content and the like, (Mn,Cr) S was recognized, though in a small amount. Identification of inclusions was performed similar to in Example 1. FIGS. 8A and 8B show EDX analytical results of inclusions in the third selection inventive steel specimen No. 2 and from the results, formation of (Ti,Zr) based compound can be recognized. Further, FIG. 9 shows an optical microphotograph of the third selection inventive steels specimen Nos. 2 and 13 shot under a magnification of 400×.

The following experiments were performed on the above described test pieces for 1) hot workability test, 2) evaluation of machinability, 3) evaluation of out-gas resistivity, 4) cold workability test and 5) evaluation of corrosion resistivity by methods similar to those in Example 1. The experiment on the evaluation of machinability adopted a circumferential speed of a cutting tool of cermet at 120 m/min. The results obtained are shown in Table 6.

It is found from Table 6 that a free cutting alloy constituted as austenite containing stainless steel of the present invention is comparable with conventional stainless steel in hot workability, cold workability and corrosion resistivity and moreover, is improved in machinability compared with conventional stainless steel. Further, it is found that when comparing with comparative steel of the specimen No. 19, third selection inventive steels of the specimens Nos. 1 to 18 are improved in machinability. Further it is found that when comparing with comparative steel specimen No. 20, the specimens Nos. 1 to 18 are smaller in $W_{SO}$ and excellent in out-gas resistivity. Further, when comparing with comparative steel specimens Nos. 27 to 29, it is found that third selection inventive steel Nos. 22 to 26 are improved on machinability. That is, the third selection inventive steel is comparable with the comparative steel in corrosion resistivity and hot workability and in addition, improved on machinability and out-gas resistivity.

The prior art publication, i.e., JP60-155653 ('653) seems to disclose alloy composition having composition overlapping for several elements. Table 18 presents the austenite iron containing alloy of this invention in contrast to the publication. However, in the alloy composition of '653, the total content of S and Se is lower than C, but in the austenite iron containing alloy of this invention, the total content of S and Se is higher than the content of C. This is intended to enhance the machinability by sufficiently forming (Ti, Zr) based compound. Meanwhile, since the machinability also depends on the matrix composition (the composition of the remaining components excluding the components relating to the (Ti, Zr) based compound such as Ti, Zr, C, S, Se, Te), it is important to compare the effects of forming components of (Ti, Zr) based compound while the matrix composition is kept almost the same, from the viewpoint of checking the effects.

The results, alternately exhibiting the results of alloys (corresponding to the austenite iron containing alloy of this invention) having the total content of S and Se higher than the content of C, in various matrix compositions (Table 5 attached to the specification: 1 to 18), and the results of reference alloys having the total content of S and Se lower than the content of C, in the nearly same matrix compositions are presented in Tables 19 and 20. In all matrix compositions, the alloys of the austenite iron containing alloy of this invention having the total content of S and Se higher than the content of C are substantially lowered in the cutting resistance as compared with the reference alloys, and are enhanced in machinability.

Thus, the austenite iron containing alloy of this invention achieves, in a composition range more limited than in '653, evident and unpredictable effects not disclosed in the publication.

Example 4

Electromagnetic Stainless Steel (Corresponding to the Fourth Selection Invention)

Next, the following experiment was performed on a free cutting alloy relating to the fourth selection inventive steel of the present invention constituted as electromagnetic stainless steel. First, 7 kg blocks of inventive steels of the present invention and comparative steels provided for tests, whose compositions in mass % shown in Tables 7 and 8, were molten in a induction furnace in an Ar stream to obtain ingots of 80 mm in diameter. Then, the ingots were processed in hot forging at a temperature in the range of 1000 to 1050° C. to be formed into rods of a circular section of 22 mm in diameter and thereafter, the rods were each machined into a diameter of 21 mm, followed by cold rolling into a diameter of 18 mm. The rods thus rolled were subjected to tests. In Tables 7 and 8, specimens Nos. 1 to 38 are test rods of fourth selection inventive steels and specimens Nos. 39 to 50 are test rods of comparative steels. It is to be noted that symbols A and B in Tables respectively indicate the groups of (A) Si of more than 2.0% and Al of 0.020% or less; and (B) Si of 2.0% or less and Al of 0.030% or more.

The test rods were measured on magnetic characteristics, electric resistivity, machinability, cold workability and corrosion resistivity by measuring methods described below, which will be described below:

Measuring Methods

1) Magnetic Characteristics

Figure 10:
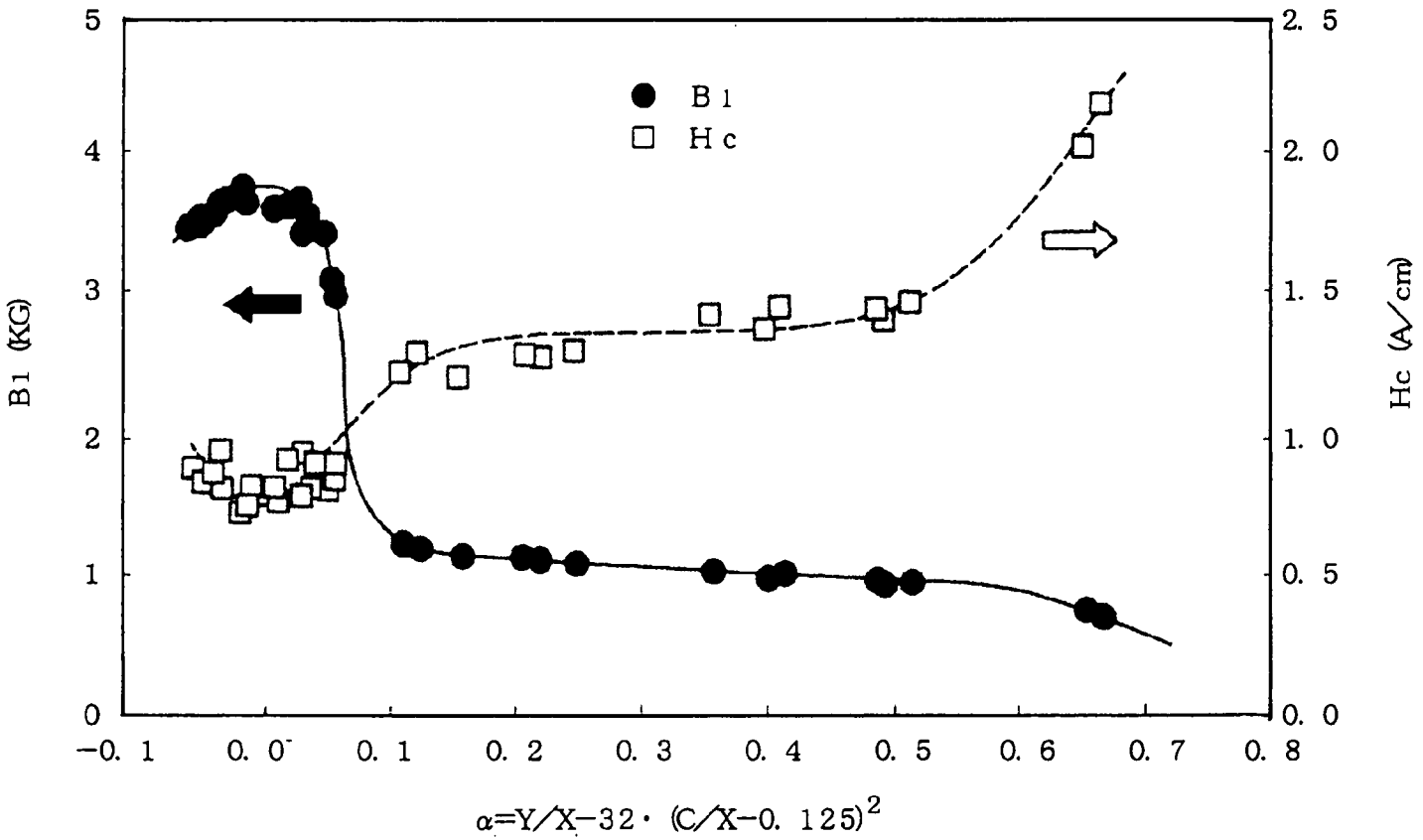
FIG. 10 is a graph showing a relation between B1 or Hc and α in Example 4.

A test piece in the shape of a ring, of 10 mm in outer diameter, 5 mm in inner diameter and 5 mm in thickness was prepared for measurement of magnetic characteristics. The test piece received magnetic annealing at 950° C. and thereafter, direct current magnetic characteristics including a magnetic flux density and a direct current coercive force were measured by a B-H loop tracer: a magnetic flux density B1 (KG) under a magnetic field of 1 Oe and a magnetic flux density B10 (KG) under a magnetic field of 10 Oe and a direct current coercive force Hc (A/cm). Relations between a magnetic flux density B1 or a coercive force Nc and $\alpha$ are shown in FIG. 10.

2) Electric Resistivity

Electric resistivity was measured on test pieces, which were each prepared by subjecting a test rod to cold wire-drawing to obtain a wire of 1 mm in diameter, and then performing vacuum annealing at 950° C. thereon.

3) Machinability

Machinability was evaluated as follows: a SKH 51 drill of 5 mm in diameter was used on a test piece of steel for machining at a number of revolution of 915 rpm under a load of 415 N on a cutting edge thereof and a time in sec consumed for boring a hole of 10 mm in depth was measured. Machinability was evaluated by a length of the time in sec.

4) Cold Workability

Figure 11:
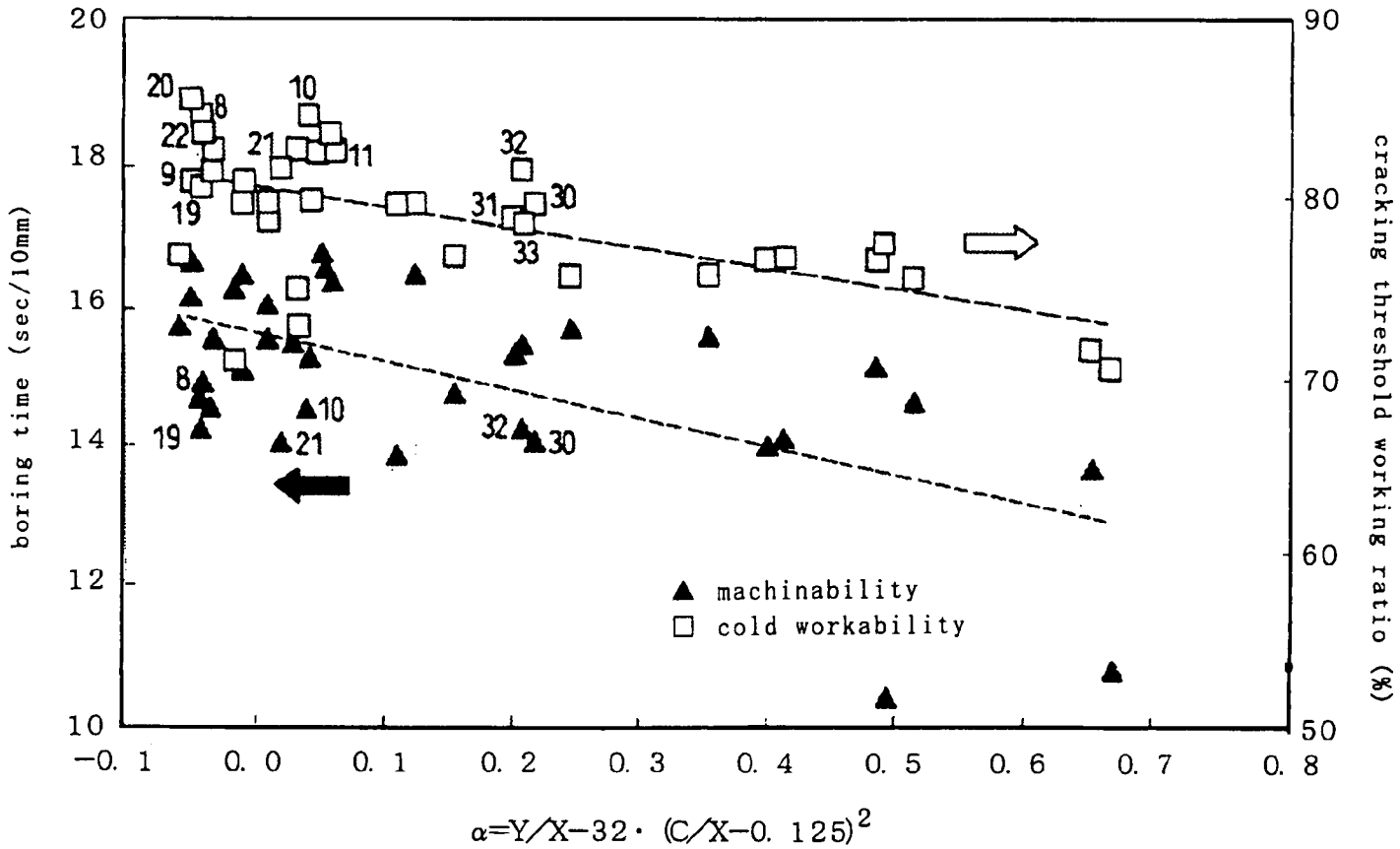
FIG. 11 is a graph showing a relation between a boring time or a cracking threshold working ratio and a in Example 4.

Cold workability was evaluated by a cracking threshold working ratio and a procedure was as follows: a test piece was prepared in the shape of a cylinder, 20 mm in diameter and 30 mm in height. The test piece was annealed at 720° C. and thereafter a compression test was performed on the test piece under a hydraulic pressure of 400 t to evaluate a cracking threshold working ratio. Relations of a boring time or a cracking threshold working ratio and $\alpha$ are shown in FIG. 11.

5) Pitting Potential

Figure 12:
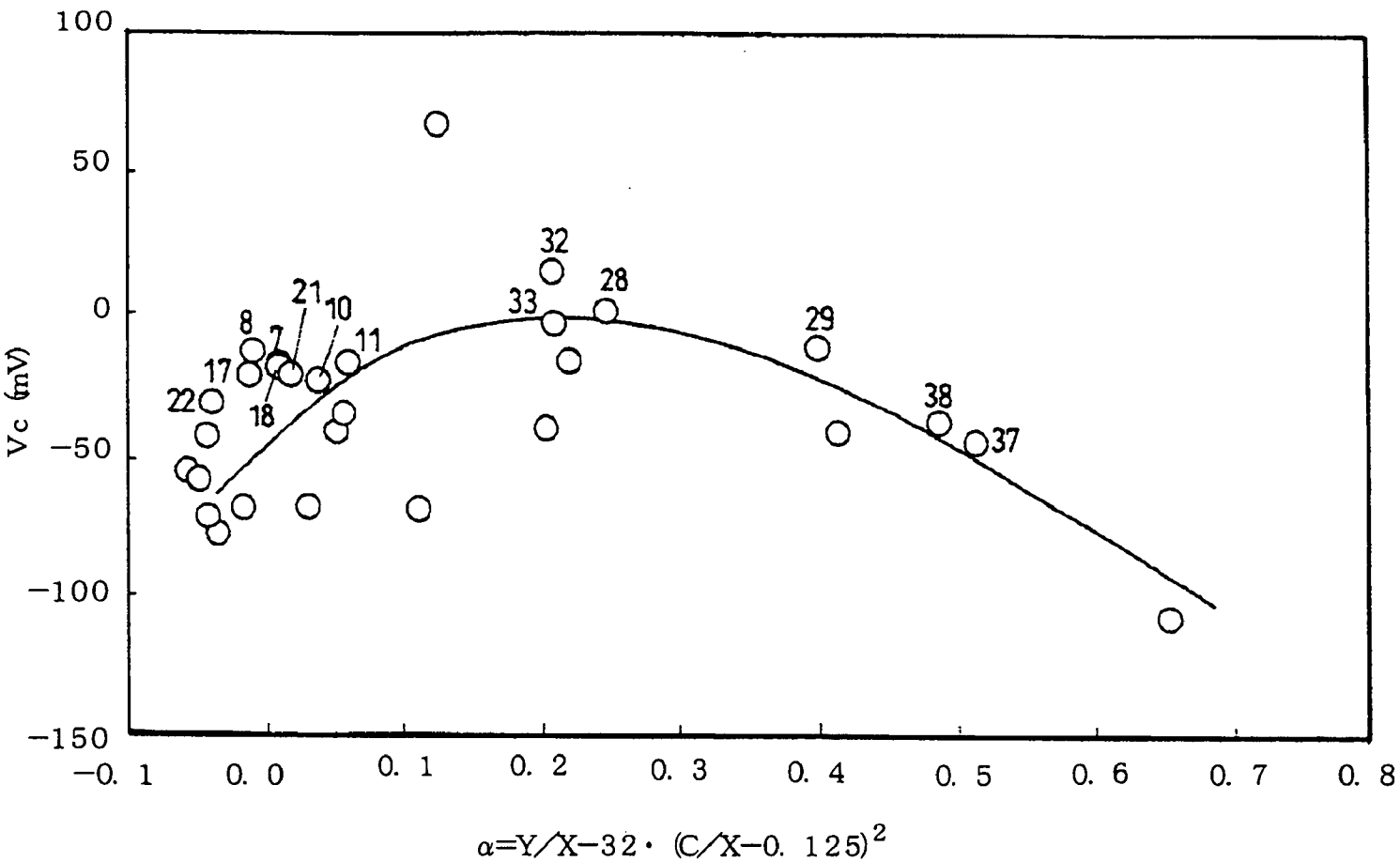
FIG. 12 is a graph showing a relation between a pitting potential and α in Example 4.

A test piece was prepared in the shape of a disc whose size is 18 mm in diameter and 2 mm in thickness. The test piece was polished with sand papers up to No. 800 and subjected to magnetic annealing at 950° for 2 hr in a vacuum. Thereafter, a pitting potential Vc in mV was measured on the test piece in a 3.5% NaCl aqueous solution at 30° C. FIG. 12 shows a relation between a pitting potential and $\alpha$. The measuring results are shown in Tables 9 and 10.

6) Evaluation of Tool Wear

Cutting test was performed using an NCl a the equipped with a cemented carbide (JIS:M10) chip as a cutting tool according to the conditions listed below, and thereafter the amount of wear of the tool (μm) was measured.

Cutting speed: 100 m/min;
Depth of cutting per revolution: 1 mm;
Feed rate per revolution: 0.15 mm;
Cutting oil: oil-base; and
Cutting time: 90 min.

7) Evaluation of Oxidation of Oxidative Mass Gain

Oxidative mass gain (mg/cm$^2$) was measured after the test pieces were kept at 1000° C. for 40 hours.

As can be found from Tables 9 and 10, and FIG. 10, very excellent magnetic characteristics are shown: at $0.047 \leqq \alpha \leqq 0.07$, Hc<1.0 A/cm and B1>2.5 KG. The magnetic characteristics changes rapidly in the vicinity of $\alpha=0.07$ and gradually in the range of $0.07<\alpha \leqq 0.45$. The magnetic characteristics in relatively good ranges of 1.0<Hc<1.5 A/cm and 1.0<B1<2.0 KG are retained in the range of $0.07<\alpha \leqq 0.45$. While the magnetic characteristics again starts growing larger from a point in the vicinity of $\alpha=0.45$, the magnetic characteristics show 1.4<Hc<2.5 A/cm and 0.4<B1<1.0 KG in the range of $0.45<\alpha \leqq 0.70$, which falls in the ranges usable practically as electromagnetic stainless steel.

Moreover, as can be clear from Tables 9 and 10, and FIG. 11, while machinability does not show a correlation with $\alpha$ as clear as magnetic characteristics have, a relatively good machinability was obtained in the range of $|\alpha|<0.70$ showing a boring time in the range of 14 to 17 sec, and excellent cold workability in the same range of $0.047 \leqq \alpha \leqq 0.70$ was obtained showing a cracking threshold working ratio in the range of 80 to 86%. The machinability and cracking threshold working ratio each show a large fluctuation between a values adjacent to each other, which occurs probably due to a difference in content of Si, Mn and Cr as one of causes. In the range of $0.07<\alpha\leqq0.45$, relatively good machinability was obtained showing a boring time in the range of 13 to 17 sec, and relative good cold workability was obtained showing a cracking threshold working ratio in the range of 75 to 85%. On the other hand, in the range of $0.45<\alpha\leqq0.70$, while cold workability at a high working ratio is hard showing a cracking threshold working ratio being 76% or less, excellent machinability was obtained showing a boring time in the range of 10 to 16 sec.

Specimens Nos. 8, 10, 19, 21, 30 and 32 including Pb as a component each have a short boring time compared with specimens of inventive steel of the present invention with respective $\alpha$ values close to those of the specimens including Pb. Further, specimens Nos. 8, 9 to 11, 19 to 22 and 30 to 33 including B and/or REM as a component each have a large cracking threshold working ratio compared with specimens of inventive steel of the present invention with respective $\alpha$ values close to those of the specimens including B and/or REM.

As can be clear from Tables 9 and 10, and FIG. 12 (where high Cr stainless steel with an extremely high Vc and low Cr stainless steel with a very low Vc are excluded), in the range of $0.047\leqq\alpha\leqq0.07$, Vc is in the range of $-80<Vc<0$ in mV and good corrosion resistivity is shown. In the range of $0.07<\alpha\leqq0.45$, Vc is in the range of $-50<Vc<70$ in mV and better corrosion resistivity is shown. While Vc decreases further in the range of $0.45<\alpha\leqq0.70$, Vc is considered to be practically useful as far as $Vc>-150$ mV.

Specimens Nos. 6, 7, 10, 11, 17, 18, 21, 22, 28, 29, 32 and 33 including Ni, Cu, Mo, Nb and V, which improve corrosion resistivity, have high Vc compared with specimens of inventive steel of the present invention with respective $\alpha$ values close to the specimens including Ni, Cu, Mo, Nb and V. Further, specimens Nos. 27 and 38 including an element which improves corrosion resistivity keep Vc of the same order as those of specimens of inventive steel of the present invention with respective $\alpha$ values smaller than the specimens including the corrosion resistivity improving element.

Of the inventive steels, specimens Nos. 3, 25 and 36 classified into group (A) are found to be extremely small in the amount of tool wear. On the contrary, other specimens classified into group (B) are found to be extremely small in the oxidative mass gain. This is obvious from comparison with comparative example Nos. 48 to 50.

Specimens Nos. 39 to 50 of comparative steels are outside the scope of the fourth selection inventive steel, as shown in FIG. 1. When comparing the inventive steel of the present invention with the fourth selection inventive steel, it is found that all the specimens of the inventive steel each show a cracking threshold working ratio of 72% or less and therefore, the fourth selection inventive steel is superior in cold workability. Further, when specimens of both kinds with respective $\alpha$ values close to each other are compared with each other, it is found that the fourth selection inventive steel is more excellent than the inventive steel in magnetic characteristics and corrosion resistivity. Further, when comparing specimens Nos. 39 to 42 of the inventive steel with specimens of the fourth selection inventive steel, it is found that the fourth selection inventive steel is better than the inventive steel in machinability. When comparing inventive steels of specimens Nos. 43 and 44 and fourth selection inventive steels, it is found that while both kinds of steel show almost the same level of machinability, the fourth selection inventive steels are better than the inventive steels in the other characteristics and when comparing inventive steels of specimens Nos. 45 to 47 with fourth selection inventive steels, it is found that the fourth selection inventive steels have better magnetic characteristics and better corrosion resistivity.

Figure 13:
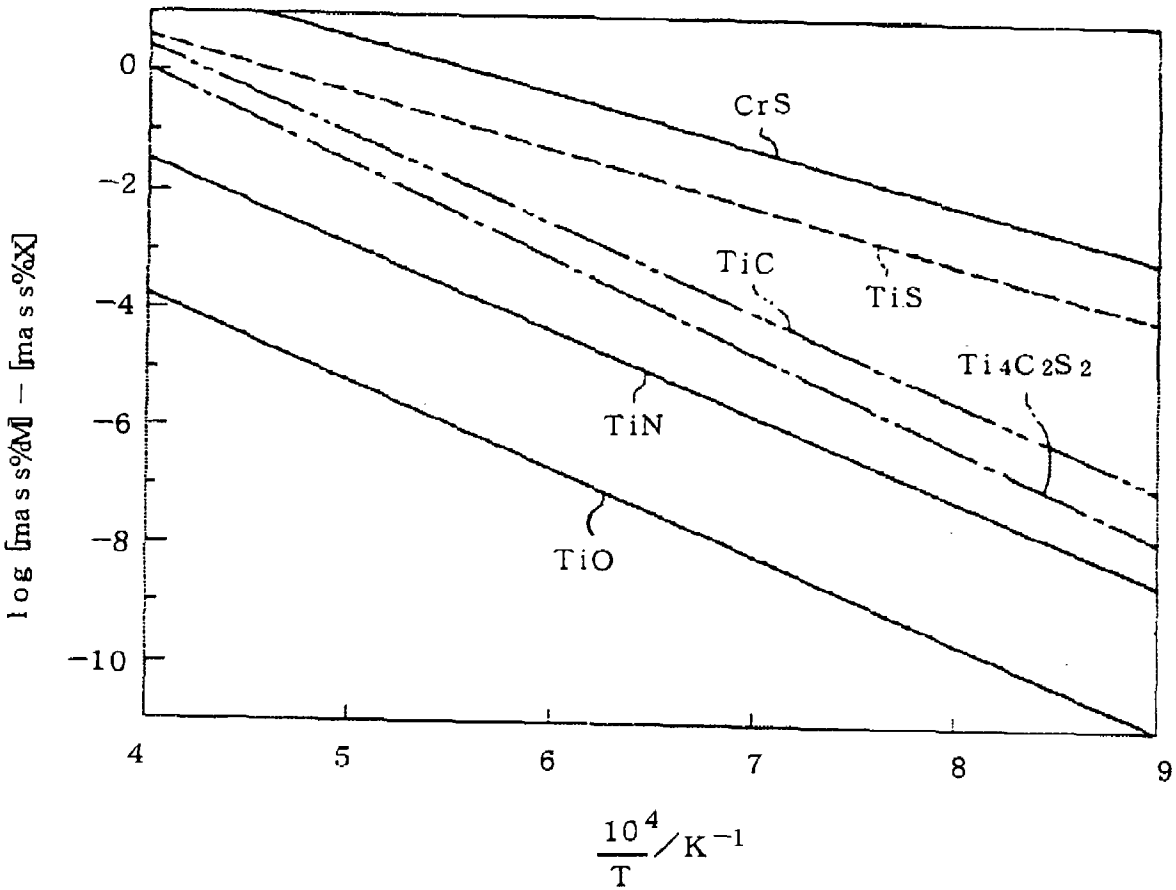
FIG. 13 is a graph showing dependencies of solubility products on temperature of components of TiO, TiN, $Ti_4C_2S_2$, TiC, TiS and CrS in γ-Fe.

FIG. 13 shows dependencies of solubility products on temperature of compounds of TiO, TiN, $Ti_4C_2S_2$, TiC, TiS and CrS in $\gamma$-Fe (an austenitic phase). Since Zr has a chemical property analogous to Ti, and Se and Te have a chemical property analogous to S, it is considered that compounds are formed in the descending order of priority of (Ti,Zr)O>(Ti, Zr)N>$(Ti,Zr)_4C_2$(S,Se,Te)>(Ti,Zr)C>(Ti,Zr)(S,Se,Te)>Cr(S,Se,Te). Further, it was confirmed that the above described compounds were present in steel by X-ray analysis.

Figure 17:
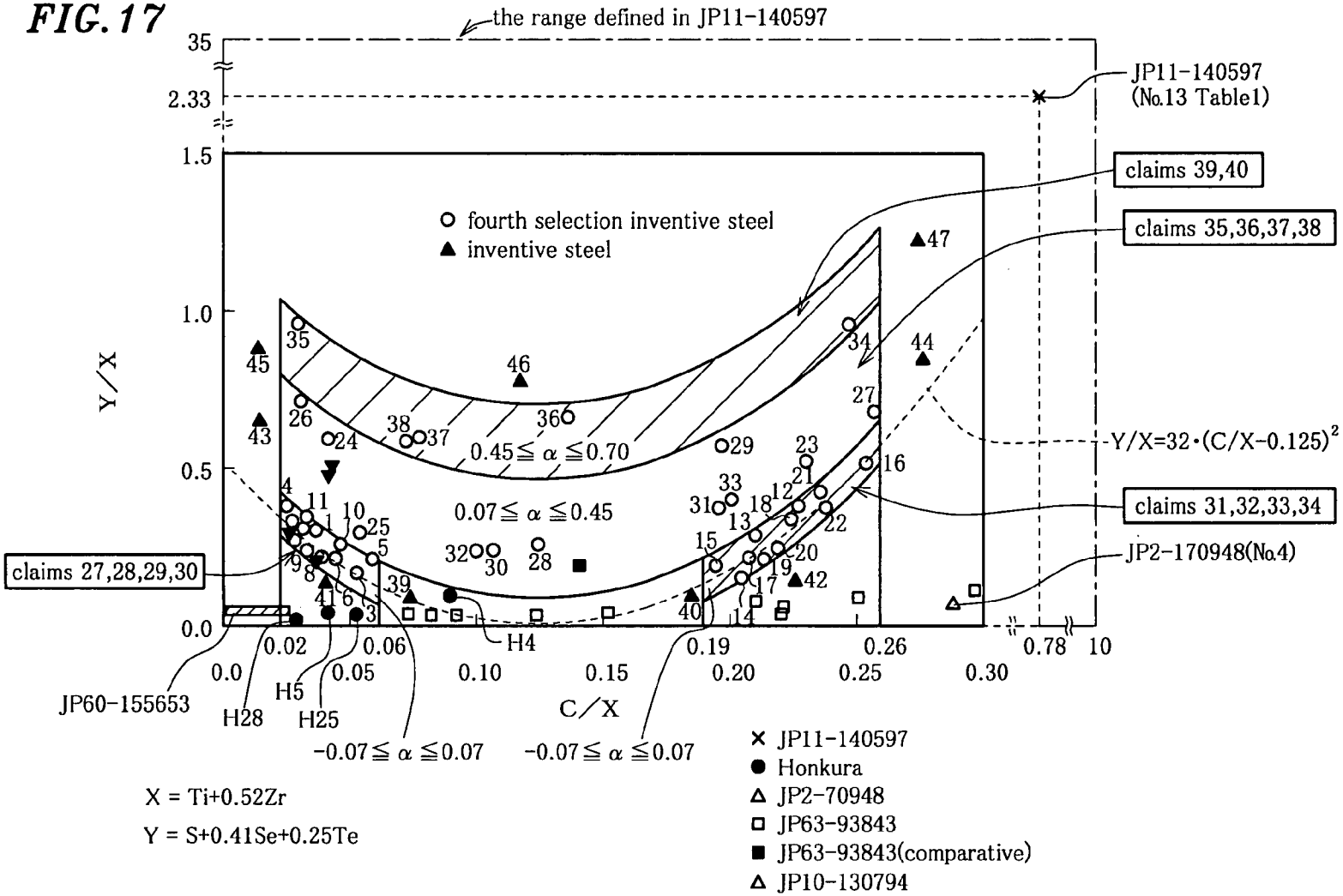
FIG. 17 is a graph showing compositional regions of the present invention constituted as electromagnetic stainless alloy with alloy compositions in prior arts.

The prior arts publications, i.e., JP60-155653 ('653), JP11-140597 ('597), JP10-130794 ('794), Honkura, JP2-170948 ('948), and JP63-93843 ('843) seems to disclose alloy composition having composition overlapping for several elements. Table 21 presents the electromagnetic stainless steel of this invention in contrast to these publications. FIG. 17 shows the composition ranges specified in the electromagnetic stainless steel of this invention, in which the axis of abscissas denotes C/X and the axis of ordinates represents Y/X, by using X and Y defined in the claims. The alloy compositions presented in the publications are plotted in the diagram.

The alloy composition presented in '794 (indicated by solid wedge mark) seems to belong to the range of the electromagnetic stainless steel of this invention. However, corresponding alloy compositions in Table 1 of '794 (inventive steel 11, 13,14, 15) all contains Pb of more than 0.17 mass %, which is much exceeds the upper limit of Pb in the electromagnetic stainless steel of this invention, i.e., 0.01 mass %. As is shown in Table 7-10, the alloy compositions defined in the electromagnetic stainless steel of this invention exhibit excellent machinability despite of the limited Pb content less than 0.01 mass %.

On the other hand, the alloy compositions in the publications are all outside of the scope of the electromagnetic stainless steel of this invention, presented in FIG. 17 by the hatching area. Table 22 extracts the alloy compositions belonging to the hatching area across the composition boundary and alloy compositions outside of the region, from the data of Tables 7 to 10 attached to the specification, and arranges alternately so that those similar in matrix composition can be compared with each other. The compositions in the electromagnetic stainless steel of this invention are notably excellent, as compared with the compositions outside of the region, in the value of B1 (magnetic flux density inmagnetic field of 1 Oe) which shows the initial magnetization start-up characteristic, an important index for magnetic, especially, soft magnetic material. Besides, the limit processing rate is also high, and an obvious difference is noted in cold. processability. Further, the pit generation potential is also high, and the corrosion resistance is excellent. Thus, in the limited composition ranges of the electromagnetic stainless steel of this invention, marked effects are achieved in magnetic property, cold processability and corrosion resistance, and these effects are not mentioned in any one of the publications.

Therefore, the electromagnetic stainless steel of this invention achieves, in a composition range more limited than in the publications, evident and unpredictable effects not disclosed in these publications.

Example 5

(Fe,Ni) Based Alloy (Corresponding to the Fifth Selection Invention)

A free cutting alloy of the present invention constituted with Ni based alloy used as (Fe,Ni) based electromagnetic material and (Fe,Ni) based heat resisting material (the fifth selection invention) was prepared in the following way to be applied to tests: First, Test alloy of various compositions in mass % shown in Tables 11, 12 and 13, which is 7 kg blocks, were molten in a high frequency furnace in an Ar stream to be formed into ingots of 80 mm in diameter. Then, the ingots were processed in hot forging at a temperature in the range of 950 to 1100° C. into rods having a circle section, 24 mm in diameter. Thereafter, the rods were machined to a diameter of 23 mm, followed by cold rolling into a diameter of 22 mm, to obtain test alloys.

Figure 14:
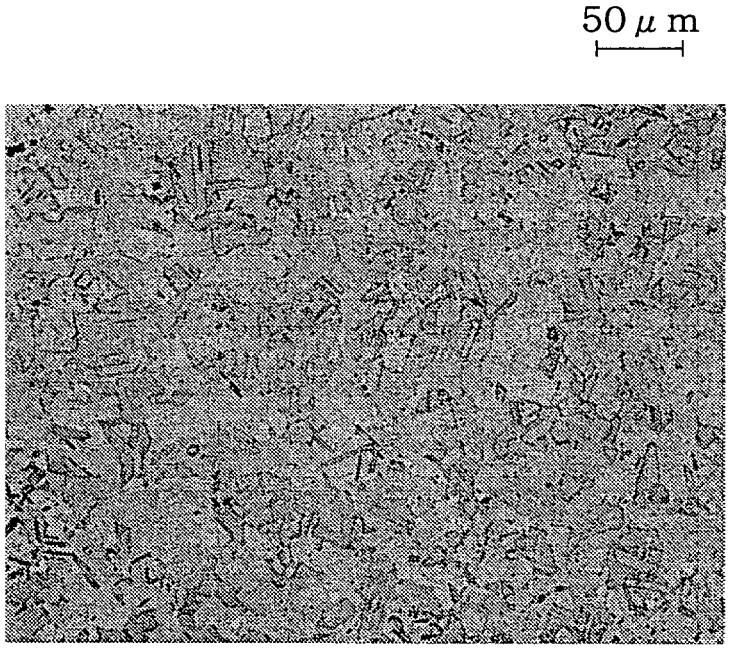
FIG. 14 is an optical microphotograph of a fifth selection inventive steel specimen No. 30 in Example 5.

Further, identification of inclusions in the structure was performed by a method similar to Example 1. While main inclusion in inventive steel of the present invention was $(Ti,Zr)_4(S,Se)C_2$, inclusions such as (Ti,Zr)S and $(Ti,Zr)S_3$ were locally recognized. A trace of (Mn,Cr)S was recognized in each of specimens Nos. 2, 14, 19, 29, 36, 39, 49 and 55, all having a high Mn content. An optical microphotograph of a specimen No. 30 of a third selection inventive alloy is shown in FIG. 14.

Thus obtained Ni based alloys of the compositions were evaluated on not only hot workability and machinability, but also characteristics required of Ni alloy among magnetic characteristics, a thermal expansion coefficient and an elastic constant. Evaluation methods for respective characteristics are as follows:

1) Hot Workability Test

Figure 15:
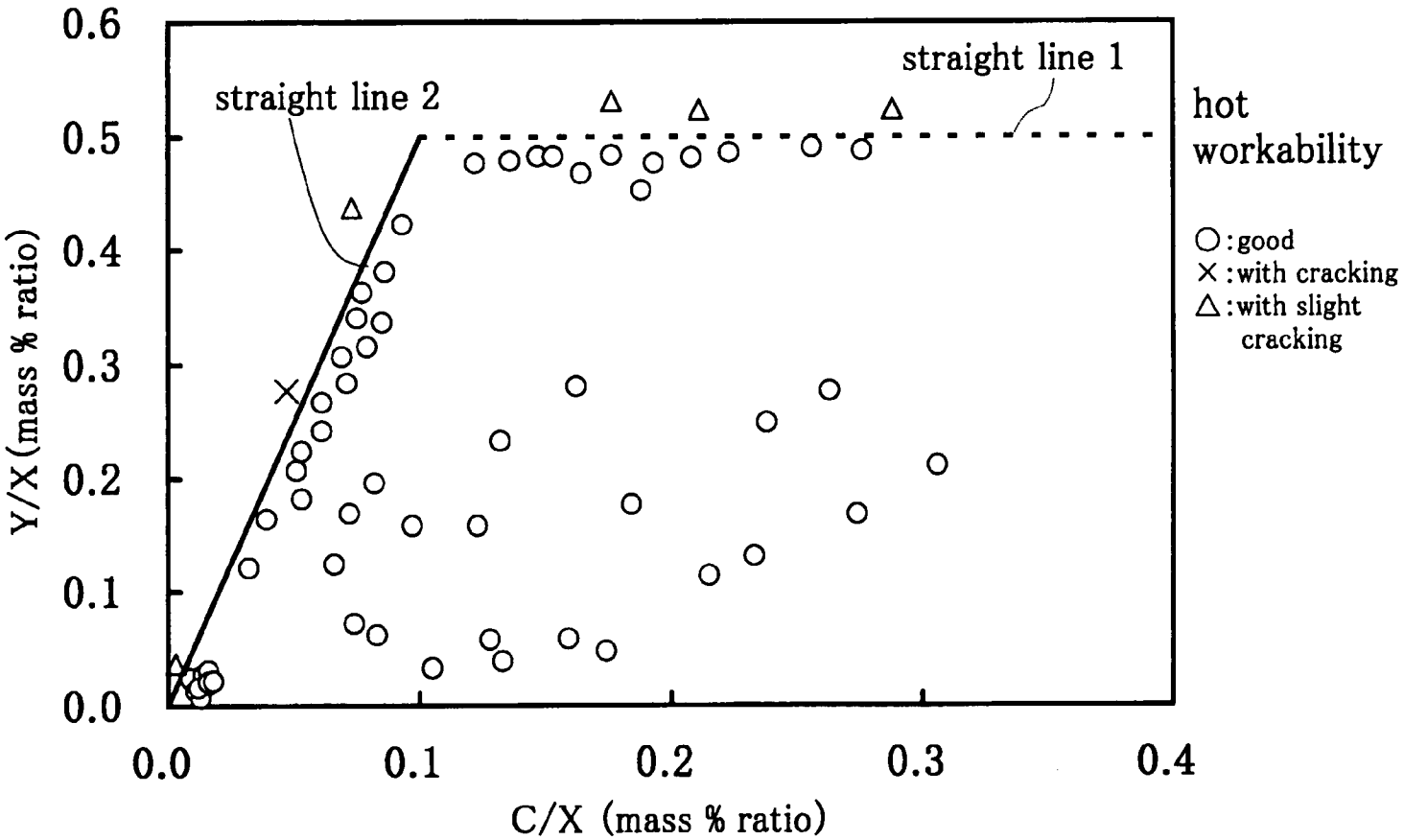
FIG. 15 is a graph showing a relation between a range of parameters of X and Y and evaluation results on hot workability in Example 5.

Evaluation of hot workability was effected based on visual observation of whether or not defects such as cracks occur in hot forging. (○) indicates that substantially no defect occurred in hot forging, (x) indicates that large scale cracks were recognized in hot forging and Δ indicates that so small cracks as to be removed by a grinder occurred in hot forging. A relation between the ranges of the parameters of X and Y defined by the formulae (1) and (2) and evaluation results of hot workability is shown in FIG. 15.

2) Machinability

Machinability was evaluated as follows: a SKH 51 drill of 5 mm in diameter was used on a test piece of steel for machining at a number of revolution of 915 rpm under a load of 415 N on a cutting edge thereof and a time in sec consumed for boring a hole of 10 mm in depth on steel was measured. Machinability was evaluated by a length of the time. A relation between a parameter Y in mass % and a boring time is shown FIG. 16.

3) Magnetic Characteristics

Test pieces each in the shape of a ring, of 10 mm in outer diameter, 4.5 mm in inner diameter and 5 mm in thickness were prepared for measurement of magnetic characteristics. A test piece received magnetic annealing at 1000° C. and thereafter, direct current magnetic characteristics including a magnetic flux density, a maximum magnetic permeability and a direct current coercive force were measured by a B-H loop tracer: a magnetic flux density B1 (T) under a magnetic field of 1 Oe, a magnetic flux density B5 (T) under a magnetic field of 5 Oe, and a magnetic flux density B10 (T) under a magnetic field of 10 Oe, a maximum magnetic permeability(μm) and a direct current coercive force Hc (A/cm).

4) Thermal Expansion Coefficient

Test alloy pieces each were prepared in a procedure in which cold-worked rods were each shaped into a cylinder of 5 mm in diameter and 50 mm in height and thereafter, processed in a solution treatment at 1000° C., followed by rapid cooling. After the rapid cooling, an alloy cylinder as an intermediate was subjected to an aging heat treatment at temperatures from 580 to 590° C. into a final test alloy piece. Young's modulus was measured on the test alloy pieces at temperatures ranging from 20 to 100° C. using a free resonance elastic modulus tester. The results are shown in Tables 14 and 15.

Data of evaluations of hot workability are indicated by plotting of the marks ○,Δ and X. A straight line 1 is a boundary line (Y=0.5 X) of the condition formula (2) and a straight line 2 is a boundary line ($0.2Y=W_C$) of the condition formula (3). In the prior art, it was considered that when Ni was included in a large content, hot workability was extremely deteriorated if S was added as a free cutting element. However, when comparing specimens Nos. 1 to 20 of fifth selection inventive alloys of compositions shown in Tables 11, 12 and 13 with specimens Nos. 71 to 75 of inventive alloys of the present invention and specimens Nos. 66 to 70 of comparative alloy, it is found that the fifth selection inventive alloy has hot workability better than the comparative alloys and the inventive alloys of the present invention have, regardless of a magnitude of each of contents of additive elements Si, Mn, Al and Mo, each in the range of 1% or lower. This is considered because, in such conditions, since a percent of inclusions of carbo-sulfide based $(Ti,Zr)_4C_2(S,Se,Te)_2$ especially stable among sulfide based inclusions is large, formation of (Mn,Cr,Ni)S being a cause for hot-work cracking is controlled. This mechanism was confirmed by actual analysis on components of the inclusions. That is, it is found that machinability is improved in the inventive alloy of the present invention and moreover, not only machinability but also hot workability are improved in the fifth selection inventive alloy.

Judging from Tables 14 and 15, it is found that while magnetic characteristics of specimens Nos. 9 to 12 of fifth selection inventive alloys with Permalloy B as a base component are almost not deteriorated, machinability is improved by a great margin when compared with the characteristics of Permalloy B alloy shown as a specimen No. 60 of a comparative alloy. While thermal expansion coefficients of specimens Nos. 5 to 8 of fifth selection inventive alloys with low expansion alloy of specimen No. 59 of a comparative alloy similar to Invar alloy as a base composition are also almost not deteriorated, machinability thereof is greatly improved. That is, the fifth selection inventive alloy of the present invention to which Ti and Zr, and S, Se and Te are added so as to satisfy the condition formulae (1) to (3) has no reduction in hot workability and furthermore, almost no deterioration in functional performances inherited from the base alloy.

It is found that in specimens Nos. 17 to 26 of fifth selection inventive alloys, an effect of improving machinability can be attained even if Cr is added with 12 mass % as the upper limit. For example, specimens Nos. 20 to 23 of fifth selection inventive alloys with specimen No. 61 of a comparative alloy, as a base composition, which is a constant-modulus alloy whose elastic characteristics are constant in the vicinity of room temperature, has not only good hot workability, but also greatly increased machinability, and in addition, a temperature coefficient of a Young's modulus is almost not affected either, thereby enabling use as constant modulus alloy in a proper manner.

It is found that in specimens Nos. 27 to 36 of fifth selection inventive alloys, even when Co is added with 18% as the upper limit, good hot workability and the effect of improving machinability can be obtained. Thermal coefficients of specimens Nos. 30 to 33 of fifth selection inventive alloys with a glass sealing agent of a comparative alloy as a base composition receive almost no influence either but the specimens Nos. 30 to 33 improve machinability by a great margin. In such a way, even when Co is added in the range of 18% or less, none of the effects of the present invention changes and the fifth selection inventive alloy can be preferably used as Invar alloy excellent in machinability. The effect to contain Cr or Co can be exerted when both elements are co-existent as well.

Figure 16:
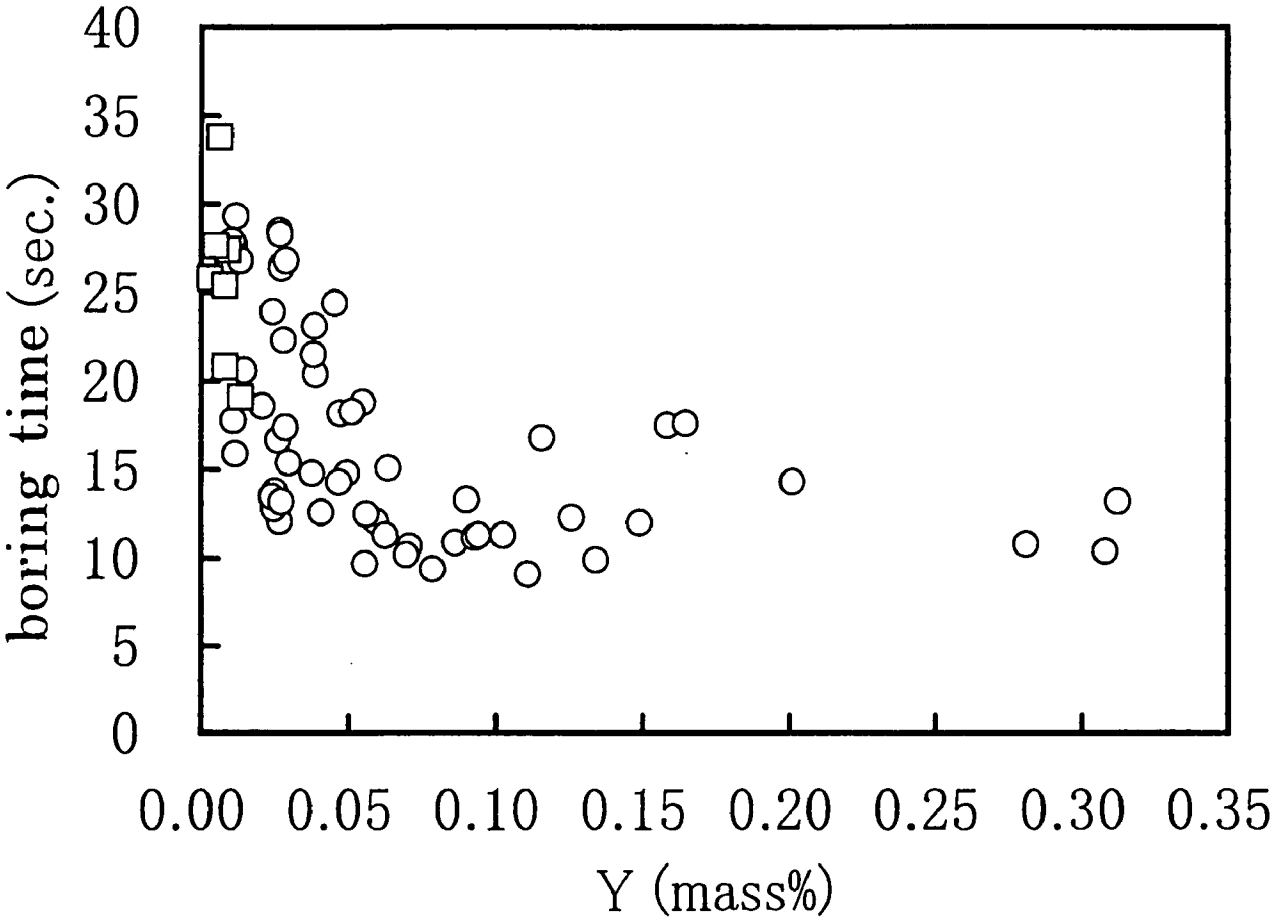
FIG. 16 is a graph showing a relation between a drill boring time and Y in mass % of an alloy in Example 5.

FIG. 16 is a graph obtained by plotting a drill boring time on alloy in Example 5 against Y in mass %. As can be seen in the graph, when Y is less than 0.01 mass %, it is seen that a boring time tends to accelerate its increase.

While some of Examples are shown above on a free cutting alloy, the examples are shown for illustrative purposes only and the present invention can be performed in other embodiments having modifications based on knowledge of those skilled in the art without departing from the spirit or scope of the following claims.

The present invention can be applied to not only Fe based alloy shown in Examples, but other alloy requiring machinability. For example, The present invention can be applied to Ni based alloy, Co based alloy, Ti based alloy, Cu based alloy, or the like as well and when applied to these kinds of alloy, a (Ti, Zr) based compound are preferably formed in the alloy structure by substituting (Ti,Zr)C and (S,Se,Te) for part of the alloy composition.

The prior arts publications, i.e., JP60-155653 ('653), JP11-140597 ('597), JP10-130794 ('794), Honkura, JP2-170948 ('948), and JP63-93843 ('843) seem to disclose alloy composition having composition overlapping for several elements. Table 23 presents the (Fe,Ni) based alloy of this invention in contrast to these publications. In the (Fe,Ni) based alloy of this invention, meanwhile, the content of S (Se, Te) is amended to 0.014 mass % or more. Specifically, in the (Fe,Ni) based alloy of this invention, the content of S (Se, Te) is defined at 0.014 mass % or more, but as shown in Table 23, it is 0.012 mass % or less in '653. In other publications, the content of Ni in far smaller than in the (Fe,Ni) based alloy of this invention, and above all the alloy system is different from that of the present invention.

Table 24 extracts the compositions of S (Se, Te) content of 0.014 mass % or more and those of less than 0.014 mass %, from the data of Tables 11 to 15 attached to the specification, and arranges alternately so that those similar in matrix composition can be compared with each other. As clear from this table, when the (Se, Te) content is 0.014 mass % or more, the boring time is notably shortened, and the cutting performance is extremely excellent.

Thus, the (Fe,Ni) based alloy of this invention achieves, in a composition range more limited than in the publications, evident and unpredictable effects not disclosed in these publications.

TABLE 1

| | C | Si | Mn | P | Cu | Ni | Cr | N | O | Ti | Zr | S | Se | note | Ws/ ($W_{Ti}$ + 0.52$W_{Zr}$) | ($W_{Ti}$ + 0.52 $W_{Zr}$)/ Wc | Ws/Wc |
|---|---|---|---|---|---|---|---|---|---|---|---|---|---|---|---|---|---|
| first selection inventive steel | | | | | | | | | | | | | | | | | |
| 1 | 0.029 | 0.22 | 0.05 | 0.01 | 0.05 | 0.05 | 16.7 | 0.006 | 0.004 | 0.58 | — | 0.21 | — | — | 0.36 | 20.00 | 7.24 |
| 2 | 0.149 | 0.18 | 0.28 | 0.01 | 0.19 | 0.13 | 19.3 | 0.016 | 0.006 | 1.15 | — | 0.33 | 0.13 | — | 0.29 | 7.72 | 2.21 |
| 3 | 0.103 | 0.52 | 0.35 | 0.02 | 0.45 | 0.83 | 20.5 | 0.009 | 0.002 | 0.52 | 0.61 | 0.28 | — | 0.8Mo | 0.33 | 8.13 | 2.72 |
| 4 | 0.021 | 0.33 | 0.55 | 0.02 | 0.22 | 0.63 | 28.3 | 0.007 | 0.008 | 0.14 | — | 0.05 | — | 0.16Pb | 0.36 | 6.67 | 2.38 |
| 5 | 0.159 | 0.22 | 0.29 | 0.01 | 1.17 | 0.04 | 20.2 | 0.007 | 0.009 | 1.01 | 0.52 | 0.42 | — | 1.8Mo, 0.02Te | 0.33 | 8.05 | 2.64 |
| 6 | 0.111 | 0.87 | 0.52 | 0.02 | 0.13 | 0.65 | 18.5 | 0.004 | 0.001 | 1.05 | — | 0.34 | — | 2.2W, 0.001BMg | 0.32 | 9.46 | 3.06 |
| 7 | 0.095 | 0.26 | 1.79 | 0.01 | 0.11 | 0.33 | 21.4 | 0.004 | 0.005 | 0.89 | — | 0.25 | 0.11 | 0.11Bl, 0.0027Ca | 0.28 | 9.37 | 2.63 |
| 8 | 0.072 | 0.32 | 0.43 | 0.02 | 0.25 | 1.21 | 24.3 | 0.008 | 0.005 | 0.77 | — | 0.25 | — | 0.0033B | 0.32 | 10.69 | 3.47 |
| 9 | 0.216 | 0.28 | 0.18 | 0.02 | 0.25 | 0.25 | 19.2 | 0.013 | 0.009 | 1.65 | — | 0.47 | 0.18 | 0.11Ta, 0.0025 REM | 0.28 | 7.64 | 2.18 |
| 10 | 0.100 | 0.14 | 0.33 | 0.02 | 0.22 | 0.23 | 19.0 | 0.007 | 0.009 | 0.85 | — | 0.28 | — | 0.23Nb | 0.33 | 8.50 | 2.80 |
| 11 | 0.094 | 0.36 | 0.85 | 0.01 | 0.54 | 0.13 | 15.2 | 0.003 | 0.011 | 0.94 | — | 0.31 | — | 2.8Mo, 0.25Hf, 0.0022B | 0.33 | 10.00 | 3.30 |
| 12 | 0.133 | 0.29 | 0.33 | 0.02 | 0.42 | 0.32 | 22.2 | 0.002 | 0.004 | 1.16 | — | 0.38 | — | 1.5Co | 0.33 | 8.72 | 2.86 |
| 13 | 0.075 | 0.49 | 0.41 | 0.03 | 0.31 | 0.11 | 17.9 | 0.012 | 0.007 | 0.68 | — | 0.22 | — | 0.17Pb, 0.03Te, 2.2Mo | 0.32 | 9.07 | 2.93 |
| 14 | 0.096 | 0.24 | 0.67 | 0.02 | 0.08 | 0.54 | 20.2 | 0.008 | 0.006 | 0.82 | — | 0.28 | — | 0.26Pb | 0.34 | 8.54 | 2.92 |
| comparative steel | | | | | | | | | | | | | | | | | |
| 15 | 0.002 | 0.29 | 0.05 | 0.02 | 0.15 | 0.24 | 16.5 | 0.008 | 0.003 | — * | — | — * | — | — | — | — | — |
| 16 | 0.002 | 0.19 | 0.88 | 0.02 | 0.17 | 0.19 | 17.2 | 0.018 | 0.002 | — * | — | 0.21 | — | — | ∞ | — | 105.00 |
| 17 | 0.016 | 0.23 | 0.29 | 0.02 | 0.18 | 0.25 | 19.1 | 0.009 | 0.005 | — * | — | 0.32 | — | — | ∞ | — | 20.00 |
| 18 | 0.019 | 0.33 | 1.06 | 0.01 | 0.25 | 0.24 | 18.9 | 0.011 | 0.012 | — * | — | 0.42 | — | 0.38Pb, 0.15Te | ∞ | — | 22.11 |
| 19 | 0.014 | 0.47 | 0.54 | 0.03 | 0.19 | 0.18 | 16.7 | 0.018 | 0.013 | 0.28 | — | 0.005 | — | — | 0.51 | 20.00 | 0.36 |
| 20 | 0.018 | 0.21 | 0.32 | 0.01 | 0.32 | 0.43 | 19.7 | 0.021 | 0.017 | 0.41 | — | 0.23 | — | — | 2.33 | 22.78 | 12.78 |
| 21 | 0.034 | 0.32 | 0.29 | 0.02 | 0.28 | 0.32 | 18.3 | 0.012 | 0.011 | 0.11 | — | 0.16 | — | — | 1.45 | 3.24 | 4.71 |
| 22 | 0.087 | 0.08 | 0.76 | 0.04 | 0.22 | 0.38 | 20.9 | 0.009 | 0.009 | 0.08 | — | 0.33 | — | — | 4.13 | 0.92 | 3.79 |

TABLE 1-continued

| | C | Si | Mn | P | Cu | Ni | Cr | N | O | Ti | Zr | S | Se | note | Ws/ ($W_{Ti}$ + 0.52$W_{Zr}$) | ($W_{Ti}$ + 0.52 $W_{Zr}$)/ Wc | Ws/Wc |
|---|---|---|---|---|---|---|---|---|---|---|---|---|---|---|---|---|---|
| 23 | 0.009 | 0.18 | 0.59 | 0.02 | 0.43 | 0.21 | 23.2 | 0.011 | 0.008 | 0.12 | — | 0.28 | — | — | 2.33 | 13.33 | 31.11 |
| 24 | 0.017 | 0.42 | 0.91 | 0.01 | 0.14 | 0.19 | 19.2 | 0.016 | 0.012 | 0.09 | — | 0.13 | — | — | 1.44 | 5.29 | 7.65 |

* indicates "outside the scope of the present invention."

TABLE 2

| | hot workability | cutting resistance [N] | finished surface roughness [μm] | chip shape | Wos [mass %] | tool ware loss [μm] |
|---|---|---|---|---|---|---|
| first selection inventive steel | | | | | | |
| 1 | ○ | 24.5 | 1.12 | G | 0.005 | 140 |
| 2 | ○ | 21.9 | 0.95 | G | 0.014 | 132 |
| 3 | ○ | 23.8 | 1.09 | G | 0.017 | 129 |
| 4 | ○ | 25.8 | 1.35 | G | 0.009 | 112 |
| 5 | ○ | 19.5 | 0.81 | G | 0.011 | 110 |
| 6 | ○ | 21.8 | 0.99 | G | 0.017 | 101 |
| 7 | ○ | 19.4 | 0.83 | G | 0.031 | 109 |
| 8 | ○ | 25.9 | 1.32 | G | 0.019 | 148 |
| 9 | ○ | 20.0 | 0.86 | G | 0.011 | 98 |
| 10 | ○ | 23.4 | 1.15 | G | 0.018 | 136 |
| 11 | ○ | 23.6 | 1.09 | G | 0.023 | 141 |
| 12 | ○ | 21.6 | 1.00 | G | 0.014 | 102 |
| 13 | ○ | 19.8 | 0.78 | G | 0.013 | 118 |
| 14 | ○ | 20.5 | 0.90 | G | 0.015 | 124 |
| comparative steel | | | | | | |
| 15 | ○ | 35.4 | 1.87 | B | 0.002 | 312 |
| 16 | ○ | 26.3 | 1.41 | G | 0.062 | 223 |
| 17 | ○ | 26.1 | 1.36 | G | 0.017 | 261 |
| 18 | X | — | — | — | 0.052 | 231 |
| 19 | ○ | 28.8 | 1.87 | B | 0.004 | 271 |
| 20 | ○ | 31.1 | 1.04 | G | 0.031 | 167 |
| 21 | ○ | 30.8 | 1.54 | B | 0.028 | 181 |
| 22 | ○ | 22.1 | 1.96 | B | 0.079 | 221 |
| 23 | ○ | 23.4 | 1.88 | G | 0.086 | 177 |
| 24 | ○ | 21.9 | 1.94 | G | 0.089 | 191 |

* indicates "outside the scope of the present invention."

TABLE 3

| | C | Si | Mn | P | Cu | Ni | Cr | N | O | Ti | Zr | S | Se | note | formula A | formula B |
|---|---|---|---|---|---|---|---|---|---|---|---|---|---|---|---|---|
| second selection inventive steel | | | | | | | | | | | | | | | | |
| 1 | 0.23 | 0.38 | 0.23 | 0.01 | 0.08 | 0.09 | 12.9 | 0.001 | 0.004 | 0.37 | — | 0.12 | — | — | ○ | ○ |
| 2 | 0.25 | 0.49 | 0.33 | 0.02 | 0.05 | 0.22 | 14.1 | 0.003 | 0.005 | 0.88 | — | 0.31 | 0.05 | — | ○ | ○ |
| 3 | 0.53 | 0.53 | 0.29 | 0.02 | 0.06 | 0.17 | 13.4 | 0.005 | 0.002 | 1.00 | — | 0.34 | — | — | ○ | ○ |
| 4 | 0.81 | 0.42 | 0.24 | 0.01 | 0.02 | 0.08 | 13.3 | 0.003 | 0.002 | 0.91 | — | 0.31 | — | — | ○ | ○ |
| 5 | 1.16 | 0.12 | 0.22 | 0.01 | 0.02 | 0.02 | 14.1 | 0.002 | 0.003 | 0.89 | — | 0.35 | — | — | ○ | ○ |
| 6 | 0.38 | 0.11 | 0.10 | 0.02 | 0.23 | 0.12 | 11.4 | 0.002 | 0.003 | 1.77 | — | 0.58 | — | 0.4Mo | ○ | ○ |
| 7 | 0.43 | 0.65 | 0.26 | 0.01 | 0.05 | 0.06 | 13.6 | 0.015 | 0.005 | 2.22 | — | 0.72 | — | 0.9W | ○ | ○ |
| 8 | 0.31 | 1.03 | 0.31 | 0.01 | 0.04 | 0.04 | 10.5 | 0.003 | 0.004 | 0.63 | 0.53 | 0.31 | — | 0.5Mo | ○ | ○ |
| 9 | 0.35 | 0.11 | 1.16 | 0.02 | 0.02 | 0.01 | 11.2 | 0.002 | 0.004 | 0.84 | — | 0.23 | 0.11 | 0.8Mo | ○ | ○ |
| 10 | 0.45 | 0.35 | 0.32 | 0.01 | 0.82 | 0.22 | 13.1 | 0.009 | 0.006 | 0.91 | — | 0.29 | — | 0.0025Ca | ○ | ○ |
| 11 | 0.66 | 0.24 | 0.34 | 0.02 | 0.18 | 0.23 | 15.2 | 0.004 | 0.007 | 0.88 | — | 0.25 | 0.15 | 0.0019B | ○ | ○ |
| 12 | 0.19 | 0.45 | 0.52 | 0.02 | 0.35 | 0.11 | 13.6 | 0.001 | 0.004 | 0.10 | — | 0.03 | — | 0.18Pb | ○ | ○ |
| 13 | 0.50 | 0.32 | 0.24 | 0.01 | 0.08 | 0.11 | 9.5 | 0.002 | 0.012 | 0.68 | — | 0.23 | — | 1.6Mo | ○ | ○ |
| 14 | 0.42 | 0.25 | 0.25 | 0.03 | 0.16 | 0.32 | 13.8 | 0.007 | 0.004 | 0.75 | 0.42 | 0.33 | — | 0.11Bi, 0.0015Mg | ○ | ○ |
| 15 | 0.48 | 0.15 | 0.31 | 0.02 | 0.24 | 1.23 | 13.4 | 0.004 | 0.005 | 0.88 | — | 0.22 | 0.22 | 1.8Co, 0.0022REM | ○ | ○ |
| 16 | 0.32 | 0.26 | 0.39 | 0.02 | 0.42 | 0.19 | 12.8 | 0.009 | 0.006 | 0.65 | 0.12 | 0.18 | 0.15 | 0.03Te, 0.12Nb | ○ | ○ |

TABLE 3-continued

| | C | Si | Mn | P | Cu | Ni | Cr | N | O | Ti | Zr | S | Se | note | formula A | formula B |
|---|---|---|---|---|---|---|---|---|---|---|---|---|---|---|---|---|
| 17 | 0.42 | 0.43 | 0.32 | 0.02 | 0.15 | 0.32 | 12.9 | 0.003 | 0.006 | 0.91 | — | 0.31 | — | 0.21V, 0.05Pb | ○ | ○ |
| 18 | 0.52 | 0.52 | 0.51 | 0.02 | 0.13 | 0.22 | 12.8 | 0.004 | 0.002 | 0.75 | — | 0.23 | 0.12 | 0.30Hf, 0.0034B | ○ | ○ |
| 19 | 0.38 | 0.39 | 0.25 | 0.01 | 0.03 | 0.29 | 12.6 | 0.004 | 0.005 | 0.72 | — | 0.25 | — | 0.15Ta, 0.02Bi | ○ | ○ |
| comparative steel | | | | | | | | | | | | | | | | |
| 20 | 0.14 | 0.45 | 0.72 | 0.02 | 0.15 | 0.19 | 12.5 | 0.009 | 0.006 | — | — | — | — | — | — | — |
| 21 | 0.13 | 0.38 | 0.96 | 0.02 | 0.09 | 0.16 | 12.8 | 0.006 | 0.005 | — | — | 0.27 | — | — | — | — |
| 22 | 0.34 | 0.45 | 0.62 | 0.02 | 0.11 | 0.22 | 13.2 | 0.008 | 0.007 | — | — | 0.24 | — | — | — | — |
| 23 | 1.04 | 0.51 | 1.03 | 0.02 | 0.05 | 0.12 | 16.2 | 0.004 | 0.003 | — | — | 0.22 | — | — | — | — |
| 24 | 0.34 | 0.12 | 0.32 | 0.03 | 0.19 | 0.15 | 12.5 | 0.018 | 0.008 | 0.13 | — | 0.01 | — | — | ○ | ○ |
| 25 | 0.58 | 0.28 | 0.18 | 0.02 | 0.32 | 0.23 | 11.8 | 0.011 | 0.005 | 0.28 | — | 0.02 | — | — | ○ | ○ |
| 26 | 0.12 | 0.41 | 0.24 | 0.02 | 0.27 | 0.41 | 13.2 | 0.013 | 0.011 | 0.43 | — | 0.15 | — | — | ○ | ○ |
| 27 | 0.11 | 0.73 | 0.19 | 0.01 | 0.53 | 0.59 | 12.1 | 0.009 | 0.018 | 0.19 | — | 0.02 | — | | ○ | ○ |
| 28 | 0.05 | 0.21 | 0.83 | 0.03 | 0.63 | 0.31 | 12.9 | 0.017 | 0.009 | 0.02 | — | 0.23 | — | | X | ○ |
| 29 | 0.11 | 0.39 | 0.47 | 0.03 | 0.21 | 0.32 | 12.8 | 0.008 | 0.011 | 0.08 | — | 0.01 | — | | ○ | ○ |
| 30 | 0.42 | 0.63 | 0.51 | 0.01 | 0.32 | 0.44 | 14.1 | 0.012 | 0.007 | 0.05 | — | 0.01 | — | | ○ | ○ |
| 31 | 0.17 | 0.51 | 0.44 | 0.02 | 0.37 | 0.33 | 13.1 | 0.018 | 0.01 | 0.09 | — | 0.01 | — | | ○ | ○ |
| 32 | 0.14 | 0.22 | 0.31 | 0.02 | 0.23 | 0.21 | 11.2 | 0.008 | 0.008 | 0.03 | — | 0.01 | — | | ○ | ○ |

TABLE 4

| | hardness [HRC] | tool ware loss[μm] | finished surface roughness [μm] | chip shape | corrosion resistivity | out-gas resistivity |
|---|---|---|---|---|---|---|
| second selection inventive steel | | | | | | |
| 1 | 35 | 390 | 1.21 | G | A | 0.008 |
| 2 | 32 | 305 | 0.93 | G | A | 0.014 |
| 3 | 54 | 315 | 0.97 | G | A | 0.013 |
| 4 | 59 | 355 | 0.85 | G | A | 0.017 |
| 5 | 61 | 370 | 0.88 | G | A | 0.015 |
| 6 | 32 | 275 | 0.81 | G | A | 0.019 |
| 7 | 33 | 255 | 0.75 | G | A | 0.022 |
| 8 | 38 | 300 | 0.90 | G | A | 0.011 |
| 9 | 45 | 310 | 0.95 | G | A | 0.022 |
| 10 | 50 | 325 | 1.02 | G | A | 0.012 |
| 11 | 57 | 330.0 | 1.05 | G | A | 0.014 |
| 12 | 34 | 325.0 | 1.20 | G | A | 0.005 |
| 13 | 55 | 340.0 | 0.98 | G | A | 0.018 |
| 14 | 44 | 305 | 1.06 | G | A | 0.018 |
| 15 | 54 | 335 | 1.00 | G | A | 0.015 |
| 16 | 37 | 305 | 1.05 | G | A | 0.009 |
| 17 | 47 | 310 | 1.08 | G | A | 0.020 |

TABLE 4-continued

| | hardness [HRC] | tool ware loss[μm] | finished surface roughness [μm] | chip shape | corrosion resistivity | out-gas resistivity |
|---|---|---|---|---|---|---|
| 18 | 55 | 330 | 0.92 | G | A | 0.015 |
| 19 | 45 | 300 | 0.95 | G | A | 0.013 |
| comparative steel | | | | | | |
| 20 | 36 | >500 | 2.07 | B | A | 0.004 |
| 21 | 35 | 320 | 1.65 | G | C | 0.063 |
| 22 | 54 | 340 | 1.72 | G | C | 0.048 |
| 23 | 61 | 395 | 1.57 | G | C | 0.071 |
| 24 | 38 | 495 | 1.95 | B | A | 0.004 |
| 25 | 48 | 550 | 1.77 | B | A | 0.006 |
| 26 | 27 | 350 | 1.23 | G | A | 0.018 |
| 27 | 25 | 455 | 2.08 | B | A | 0.005 |
| 28 | 22 | 320 | 1.87 | G | C | 0.073 |
| 29 | 23 | 425 | 1.91 | B | A | 0.003 |
| 30 | 45 | 400 | 1.79 | B | A | 0.004 |
| 31 | 28 | 410 | 2.13 | B | A | 0.003 |
| 32 | 26 | 430 | 2.31 | B | A | 0.004 |

TABLE 5

| | C | Ni | Cr | Ti | Zr | S | Se | Si | Mn | P | O | N | note | Ti + 0.52Zr | main phase |
|---|---|---|---|---|---|---|---|---|---|---|---|---|---|---|---|
| third selection inventive steel | | | | | | | | | | | | | | | |
| 1 | 0.075 | 9.8 | 18.8 | 0.61 | | 0.21 | | 0.19 | 0.28 | 0.025 | 0.003 | 0.007 | | 0.61 | A |
| 2 | 0.118 | 12.2 | 20.5 | 0.96 | | 0.32 | | 0.28 | 0.39 | 0.013 | 0.007 | 0.004 | 0.8Cu | 0.96 | |
| 3 | 0.175 | 11.9 | 19.4 | 1.31 | | 0.44 | | 0.15 | 0.57 | 0.018 | 0.003 | 0.007 | | 1.31 | |
| 4 | 0.262 | 8.5 | 18.1 | 2.13 | | 0.68 | | 0.31 | 0.32 | 0.008 | 0.003 | 0.009 | | 2.13 | |
| 5 | 0.118 | 7.9 | 17.8 | 0.98 | | 0.30 | | 0.31 | 0.42 | 0.019 | 0.003 | 0.008 | 1.3Mo | 0.98 | |
| 6 | 0.171 | 10.4 | 17.9 | 1.28 | | 0.45 | | 0.33 | 0.12 | 0.033 | 0.004 | 0.011 | 0.4Cu, 0.4Mo | 1.28 | |

TABLE 5-continued

| | C | Ni | Cr | Ti | Zr | S | Se | Si | Mn | P | O | N | note | Ti + 0.52Zr | main phase |
|---|---|---|---|---|---|---|---|---|---|---|---|---|---|---|---|
| 7 | 0.121 | 8.7 | 17.8 | 1.02 | | 0.31 | | 0.21 | 0.30 | 0.028 | 0.004 | 0.014 | 2.8Cu | 1.02 | |
| 8 | 0.169 | 19.2 | 24.2 | 1.05 | 0.42 | 0.28 | | 0.61 | 0.18 | 0.042 | 0.001 | 0.019 | | 1.27 | |
| 9 | 0.062 | 18.6 | 24.5 | 0.55 | 0.24 | 0.19 | | 0.32 | 1.68 | 0.007 | 0.002 | 0.024 | 0.4Cu, 5.8Mo, 0.0029B | 0.67 | |
| 10 | 0.122 | 35.9 | 30.2 | 1.01 | | 0.32 | | 0.29 | 1.23 | 0.005 | 0.005 | 0.007 | 1.2Co, 0.0018Ca | 1.01 | |
| 11 | 0.265 | 12.4 | 17.8 | 2.09 | | 0.57 | 0.22 | 0.49 | 0.38 | 0.029 | 0.004 | 0.012 | 2.2Mo, 0.13Pb, 0.0015Mg | 2.09 | |
| 12 | 0.048 | 41.9 | 15.6 | 0.52 | 0.24 | 0.18 | 0.07 | 0.32 | 0.37 | 0.015 | 0.013 | 0.039 | 5.2Mo, 4.7W, 0.0031REM | 0.64 | |
| 13 | 0.141 | 20.4 | 24.2 | 1.14 | | 0.38 | 0.06 | 0.72 | 2.44 | 0.002 | 0.002 | 0.004 | 0.08Bi, 0.15Nb | 1.14 | |
| 14 | 0.071 | 15.2 | 22.9 | 0.51 | | 0.33 | | 0.08 | 0.88 | 0.019 | 0.005 | 0.009 | 1.9W, 0.03Te, 0.0031B | 0.51 | |
| 15 | 0.032 | 10.9 | 20.2 | 0.18 | | 0.07 | | 0.61 | 0.34 | 0.011 | 0.002 | 0.009 | 0.21Pb, 0.14V | 0.18 | |
| 16 | 0.092 | 15.3 | 19.1 | 0.88 | | 0.34 | | 2.17 | 0.21 | 0.028 | 0.004 | 0.012 | 0.0022Ca, 0.22Ta | 0.88 | |
| 17 | 0.155 | 7.9 | 17.2 | 1.11 | | 0.41 | | 0.04 | 0.19 | 0.011 | 0.002 | 0.021 | 1.8Cu, 0.17Hf | 1.11 | |
| 18 | 0.089 | 6.2 | 17.1 | 0.59 | | 0.19 | | 0.32 | 0.63 | 0.019 | 0.002 | 0.012 | 0.25Pb | 0.59 | |
| comparative steel | | | | | | | | | | | | | | | |
| 19 | 0.05 | 8.1 | 18.2 | | | 0.01 | | 0.42 | 1.33 | 0.028 | 0.008 | 0.025 | | 0.00 | |
| 20 | 0.03 | 8.6 | 18.5 | | | 0.33 | | 0.29 | 1.93 | 0.018 | 0.012 | 0.033 | | 0.00 | |
| 21 | 0.03 | 12.3 | 17.8 | | | 0.33 | | 0.45 | 0.22 | 0.018 | 0.007 | 0.018 | 2.1Mo | 0.00 | |
| 22 | 0.021 | 8.2 | 25.8 | 0.15 | | 0.05 | | 0.41 | 0.50 | 0.025 | 0.004 | 0.004 | 3.2Mo, 1.1W, 0.0012Mg | 0.15 | F + A |
| inventive steel | | | | | | | | | | | | | | | |
| 23 | 0.024 | 4.2 | 22.8 | 0.17 | | 0.06 | | 0.32 | 0.41 | 0.016 | 0.003 | 0.009 | 2.2Mo, 0.0011Ca | 0.17 | |
| 24 | 0.042 | 4.2 | 16.2 | 0.22 | | 0.08 | | 0.25 | 0.93 | 0.022 | 0.005 | 0.012 | 3.1Cu | 0.22 | M + A |
| 25 | 0.111 | 2.11 | 16.4 | 0.51 | | 0.18 | | 0.33 | 0.54 | 0.016 | 0.006 | 0.009 | | 0.51 | |
| 26 | 0.055 | 5.33 | 15.8 | 0.52 | | 0.15 | | 0.27 | 0.64 | 0.025 | 0.005 | 0.006 | | 0.52 | |
| comparative steel | | | | | | | | | | | | | | | |
| 27 | 0.018 | 7.9 | 25.4 | | | 0.001 | | 0.23 | 0.88 | 0.013 | 0.005 | 0.21 | 2.8Mo | 0.00 | |
| 28 | 0.06 | 2.02 | 16.3 | | | 0.005 | | 0.61 | 0.29 | 0.019 | 0.009 | 0.013 | | 0.00 | |
| 29 | 0.03 | 5.03 | 16.2 | | | 0.004 | | 0.31 | 0.78 | 0.023 | 0.007 | 0.007 | | 0.00 | |

TABLE 6

| | hot workability | cutting resistance | finished surface roughness | chip shape | corrosion resistivity | out-gas resistivity | threshold compressive strain |
|---|---|---|---|---|---|---|---|
| third selection inventive steel | | | | | | | |
| 1 | ○ | 33.6 | 2.05 | G | A | 0.008 | 1.9 |
| 2 | ○ | 31.2 | 1.92 | G | A | 0.017 | 1.9 |
| 3 | ○ | 30.9 | 1.84 | G | A | 0.025 | 1.8 |
| 4 | ○ | 25.2 | 1.95 | G | A | 0.024 | 1.7 |
| 5 | ○ | 31.9 | 1.91 | G | A | 0.019 | 1.9 |
| 6 | ○ | 29.4 | 1.81 | G | A | 0.004 | 1.8 |
| 7 | ○ | 29.8 | 1.88 | G | A | 0.015 | 2.0 |
| 8 | ○ | 32.7 | 1.99 | G | A | 0.009 | |
| 9 | ○ | 36.2 | 2.21 | G | A | 0.030 | |
| 10 | ○ | 30.5 | 2.16 | G | A | 0.027 | |
| 11 | ○ | 24.3 | 1.99 | G | A | 0.021 | |
| 12 | ○ | 37.6 | 2.13 | G | A | 0.018 | |
| 13 | ○ | 28.9 | 1.91 | G | A | 0.034 | |
| 14 | ○ | 29.0 | 1.96 | G | A | 0.029 | |
| 15 | ○ | 32.6 | 2.02 | G | A | 0.003 | |
| 16 | ○ | 33.3 | 2.00 | G | A | 0.007 | |
| 17 | ○ | 31.1 | 1.85 | G | A | 0.011 | |
| 18 | ○ | 26.8 | 1.90 | G | A | 0.022 | |
| comparative steel | | | | | | | |
| 19 | ○ | 42.5 | 2.46 | B | A | 0.004 | 2.1 |
| 20 | ○ | 31.5 | 1.95 | G | C | 0.062 | 1.3 |
| 21 | ○ | 35.2 | 2.02 | G | A | 0.014 | 1.3 |
| 22 | Δ | 39.7 | 2.35 | G | A | 0.003 | |

TABLE 6-continued

| | hot workability | cutting resistance | finished surface roughness | chip shape | corrosion resistivity | out-gas resistivity | threshold compressive strain |
|---|---|---|---|---|---|---|---|
| inventive steel | | | | | | | |
| 23 | ○ | 38.0 | 2.22 | G | A | 0.004 | |
| 24 | ○ | 38.0 | 2.11 | G | A | 0.004 | |
| 25 | ○ | 36.4 | 2.08 | G | A | 0.014 | |
| 26 | ○ | 35.9 | 1.95 | G | A | 0.010 | |
| comparative steel | | | | | | | |
| 27 | ○ | 47.2 | 2.88 | B | A | <0.001 | |
| 28 | ○ | 45.0 | 2.91 | B | A | 0.003 | |
| 29 | ○ | 45.5 | 2.77 | B | A | 0.003 | |

TABLE 7

| No. | C | Si | Mn | P | S | Se | Te | Cr | Al | Ti | Zr | note 1 | note 2 | α | C/X | X/Y | group |
|---|---|---|---|---|---|---|---|---|---|---|---|---|---|---|---|---|---|
| fourth selection inventive steel | | | | | | | | | | | | | | | | | |
| 1 | 0.016 | 0.02 | 1.92 | 0.011 | 0.144 | — | — | 24.21 | 4.75 | 0.484 | — | — | — | 0.033 | 0.034 | 0.298 | B |
| 2 | 0.006 | 0.41 | 0.38 | 0.009 | 0.060 | — | — | 5.75 | 0.92 | 0.213 | — | — | — | −0.032 | 0.026 | 0.282 | B |
| 3 | 0.003 | 2.87 | 0.18 | 0.008 | 0.009 | — | — | 15.25 | 0.02 | 0.058 | — | — | — | −0.015 | 0.051 | 0.160 | A |
| 4 | 0.005 | 0.77 | 0.21 | 0.008 | 0.090 | — | — | 13.21 | 0.28 | 0.235 | — | — | — | 0.052 | 0.023 | 0.385 | B |
| 5 | 0.014 | 0.79 | 0.19 | 0.010 | 0.049 | — | — | 13.01 | 0.29 | 0.239 | — | — | — | 0.057 | 0.057 | 0.205 | B |
| 6 | 0.009 | 0.78 | 0.19 | 0.008 | 0.048 | — | — | 13.05 | 0.30 | 0.225 | — | Ni: 1.82<br>Nb: 0.87 | — | −0.009 | 0.042 | 0.211 | B |
| 7 | 0.006 | 0.77 | 0.18 | 0.009 | 0.070 | 0.011 | 0.008 | 13.11 | 0.31 | 0.227 | 0.008 | Cu: 1.92<br>Mo: 1.80<br>V: 0.93 | — | 0.010 | 0.025 | 0.330 | B |
| 8 | 0.008 | 0.79 | 0.19 | 0.009 | 0.050 | — | — | 13.15 | 0.29 | 0.235 | — | — | Pb: 0.12<br>B: 0.008 | −0.041 | 0.036 | 0.212 | B |
| 9 | 0.007 | 0.78 | 0.20 | 0.007 | 0.050 | 0.010 | 0.009 | 13.22 | 0.32 | 0.233 | 0.007 | — | REM: 0.08 | −0.047 | 0.031 | 0.236 | B |
| 10 | 0.010 | 0.79 | 0.20 | 0.007 | 0.057 | — | — | 13.07 | 0.28 | 0.227 | — | Ni: 1.85<br>Nb: 0.86 | Pb: 0.13<br>B: 0.009 | 0.039 | 0.044 | 0.249 | B |
| 11 | 0.007 | 0.78 | 0.19 | 0.009 | 0.070 | 0.012 | 0.010 | 13.08 | 0.29 | 0.221 | 0.008 | Cu: 1.91<br>Mo: 1.79<br>V: 0.93 | REM: 0.07 | 0.060 | 0.031 | 0.343 | B |
| 12 | 0.110 | 0.03 | 1.94 | 0.010 | 0.180 | — | — | 24.36 | 4.81 | 0.484 | — | — | — | 0.033 | 0.228 | 0.372 | B |
| 13 | 0.045 | 0.43 | 0.36 | 0.007 | 0.060 | — | — | 5.32 | 0.89 | 0.213 | — | — | — | 0.043 | 0.211 | 0.282 | B |
| 15 | 0.047 | 0.79 | 0.20 | 0.009 | 0.045 | — | — | 12.95 | 0.31 | 0.241 | — | — | — | 0.031 | 0.195 | 0.188 | B |
| 16 | 0.061 | 0.78 | 0.21 | 0.008 | 0.113 | 0.015 | 0.009 | 12.98 | 0.28 | 0.234 | 0.012 | — | — | −0.033 | 0.255 | 0.508 | B |
| 17 | 0.047 | 0.81 | 0.20 | 0.009 | 0.047 | — | — | 13.01 | 0.29 | 0.225 | — | NI: 1.84<br>Nb: 0.85 | — | −0.011 | 0.208 | 0.209 | B |
| 18 | 0.052 | 0.79 | 0.19 | 0.009 | 0.070 | 0.011 | 0.008 | 13.06 | 0.33 | 0.227 | 0.008 | Cu: 1.93<br>Mo: 1.86<br>V: 0.91 | — | 0.010 | 0.225 | 0.330 | B |
| 19 | 0.050 | 0.80 | 0.21 | 0.008 | 0.050 | — | — | 13.09 | 0.30 | 0.235 | — | — | Pb: 0.11<br>B: 0.007 | −0.041 | 0.214 | 0.212 | B |
| 20 | 0.052 | 0.81 | 0.22 | 0.007 | 0.050 | 0.010 | 0.009 | 13.15 | 0.29 | 0.233 | 0.007 | — | REM: 0.09 | −0.047 | 0.219 | 0.236 | B |
| 21 | 0.054 | 0.77 | 0.21 | 0.009 | 0.094 | — | — | 12.98 | 0.31 | 0.227 | — | Ni: 1.87<br>Nb: 0.88 | Pb: 0.13<br>B: 0.008 | 0.020 | 0.236 | 0.414 | B |
| 22 | 0.054 | 0.79 | 0.18 | 0.008 | 0.076 | 0.012 | 0.010 | 13.03 | 0.32 | 0.221 | 0.008 | Cu: 1.94<br>Mo: 1.83<br>V: 0.94 | REM: 0.08 | −0.039 | 0.238 | 0.370 | B |
| 23 | 0.105 | 0.02 | 1.94 | 0.008 | 0.235 | — | — | 23.92 | 4.50 | 0.455 | — | — | — | 0.158 | 0.231 | 0.518 | B |
| 24 | 0.008 | 0.38 | 0.41 | 0.012 | 0.125 | — | — | 5.95 | 0.88 | 0.211 | — | — | — | 0.357 | 0.039 | 0.594 | B |

TABLE 8

| No. | C | Si | Mn | P | S | Se | Te | Cr | Al | Ti | Zr | note 1 | note 2 | α | C/X | X/Y | group |
|---|---|---|---|---|---|---|---|---|---|---|---|---|---|---|---|---|---|
| fourth selection inventive steel | | | | | | | | | | | | | | | | | |
| 25 | 0.003 | 2.91 | 0.19 | 0.009 | 0.017 | — | — | 15.04 | 0.02 | 0.058 | — | — | — | 0.126 | 0.052 | 0.297 | A |
| 26 | 0.006 | 0.76 | 0.20 | 0.008 | 0.147 | — | — | 13.05 | 0.28 | 0.205 | — | — | — | 0.415 | 0.028 | 0.716 | B |
| 27 | 0.052 | 0.77 | 0.22 | 0.009 | 0.126 | 0.013 | 0.011 | 13.01 | 0.29 | 0.196 | 0.009 | — | — | 0.111 | 0.257 | 0.669 | B |
| 28 | 0.026 | 0.79 | 0.20 | 0.009 | 0.052 | — | — | 13.07 | 0.31 | 0.210 | — | NI: 1.86<br>V: 0.85 | — | 0.249 | 0.123 | 0.249 | B |
| 29 | 0.042 | 0.78 | 0.21 | 0.010 | 0.114 | 0.010 | 0.008 | 12.97 | 0.30 | 0.205 | 0.011 | Cu: 1.89<br>Mo: 1.91<br>V: 0.91 | — | 0.401 | 0.197 | 0.567 | B |
| 30 | 0.022 | 0.78 | 0.20 | 0.012 | 0.049 | — | — | 12.96 | 0.31 | 0.209 | — | — | Pb: 0.13<br>B: 0.007 | 0.221 | 0.105 | 0.234 | B |
| 31 | 0.040 | 0.77 | 0.20 | 0.009 | 0.069 | 0.009 | 0.009 | 13.03 | 0.29 | 0.200 | 0.009 | — | REM: 0.07 | 0.205 | 0.196 | 0.366 | B |
| 32 | 0.020 | 0.78 | 0.21 | 0.009 | 0.047 | — | — | 13.10 | 0.30 | 0.201 | — | Ni: 1.85<br>Nb: 0.87 | Pb: 0.12<br>B: 0.009 | 0.209 | 0.098 | 0.232 | B |
| 33 | 0.040 | 0.79 | 0.19 | 0.007 | 0.072 | 0.011 | 0.009 | 13.16 | 0.29 | 0.193 | 0.010 | Cu: 1.89<br>Mo: 1.93<br>V0.93 | REM: 0.08 | 0.211 | 0.201 | 0.396 | B |
| 34 | 0.119 | 0.02 | 1.91 | 0.008 | 0.465 | — | — | 23.50 | 4.85 | 0.480 | — | — | — | 0.493 | 0.247 | 0.969 | B |
| 35 | 0.005 | 0.42 | 0.37 | 0.009 | 0.181 | — | — | 5.87 | 0.93 | 0.185 | — | — | — | 0.670 | 0.027 | 0.977 | B |
| 36 | 0.008 | 2.88 | 0.19 | 0.010 | 0.035 | 0.009 | 0.003 | 14.45 | 0.02 | 0.056 | 0.011 | — | — | 0.655 | 0.135 | 0.658 | A |
| 37 | 0.014 | 0.77 | 0.20 | 0.009 | 0.107 | | | 13.18 | 0.28 | 0.181 | — | Ni: 1.83<br>Nb: 0.88 | — | 0.516 | 0.076 | 0.593 | B |
| 38 | 0.013 | 0.79 | 0.21 | 0.008 | 0.099 | 0.008 | 0.009 | 13.21 | 0.29 | 0.174 | 0.010 | Cu: 1.88<br>Mo: 1.93<br>V: 0.89 | — | 0.488 | 0.070 | 0.585 | B |
| comparative steel | | | | | | | | | | | | | | | | | |
| 39 | 0.013 | 0.81 | 0.22 | 0.010 | 0.018 | — | — | 13.45 | 0.33 | 0.180 | — | — | — | 0.007 | 0.071 | 0.100 | — |
| 40 | 0.039 | 0.79 | 0.21 | 0.009 | 0.021 | — | — | 13.21 | 0.31 | 0.213 | — | — | — | −0.015 | 0.185 | 0.100 | — |
| 41 | 0.020 | 0.78 | 0.20 | 0.007 | 0.009 | — | — | 13.11 | 0.29 | 0.065 | — | NI: 1.83 | — | −0.105 | 0.038 | 0.137 | — |
| 42 | 0.035 | 0.76 | 0.19 | 0.009 | 0.023 | — | — | 13.09 | 0.28 | 0.155 | — | Cu: 1.81 | — | −0.175 | 0.226 | 0.151 | — |
| 43 | 0.003 | 0.80 | 0.20 | 0.011 | 0.151 | — | — | 13.04 | 0.31 | 0.230 | — | Mo: 1.89 | — | 0.248 | 0.012 | 0.657 | — |
| 44 | 0.096 | 0.79 | 0.20 | 0.009 | 0.297 | — | — | 13.01 | 0.30 | 0.345 | — | V: 0.84 | — | 0.121 | 0.277 | 0.860 | — |
| 45 | 0.005 | 0.77 | 0.21 | 0.007 | 0.421 | — | — | 13.08 | 0.29 | 0.457 | 0.020 | Nb: 0.83 | — | 0.485 | 0.011 | 0.901 | — |
| 46 | 0.022 | 0.78 | 0.18 | 0.009 | 0.149 | — | — | 12.98 | 0.30 | 0.189 | — | Ni: 1.86 | B: 0.008 | 0.783 | 0.115 | 0.756 | — |
| 47 | 0.051 | 0.78 | 0.21 | 0.008 | 0.233 | — | — | 13.17 | 0.31 | 0.187 | — | — | Pb: 0.11 | 0.527 | 0.275 | 1.247 | — |
| 48 | 0.020 | 0.030 | 0.050 | 0.020 | 0.010 | — | — | 13.20 | 0.02 | — | — | Ni: 0.5<br>Cu: 0.08 | — | — | — | — | — |
| 49 | 0.030 | 0.120 | 0.880 | 0.020 | 0.020 | — | — | 12.90 | 0.02 | — | — | — | — | — | — | — | — |
| 50 | 0.080 | 0.260 | 1.200 | 0.020 | 0.180 | — | — | 15.10 | 0.05 | — | — | — | — | — | — | — | — |

TABLE 9

| No. | magnetic characteristics $B_1$ (KG) | $B_{10}$ (KG) | Hc (A/cm) | electric resistivity (μ - Ω cm) | machinability boring time (sec) | cold workability threshold working ratio (%) | corrosion resistivity pitting potential (mV) | group |
|---|---|---|---|---|---|---|---|---|
| fourth selection inventive steel | | | | | | | | |
| 1 | 3.55 | 12.38 | 0.97 | 133 | 16.3 | 75 | 338 | B |
| 2 | 3.75 | 12.55 | 0.99 | 67 | 15.6 | 83 | −315 | B |
| 3 | 3.87 | 12.58 | 0.75 | 85 | 16.3 | 71 | −68 | A |
| 4 | 3.53 | 12.48 | 0.85 | 68 | 16.8 | 83 | −40 | B |
| 5 | 3.19 | 12.46 | 0.87 | 68 | 16.6 | 84 | −34 | B |
| 6 | 3.75 | 12.60 | 0.84 | 81 | 16.5 | 81 | −13 | B |
| 7 | 3.72 | 12.62 | 0.80 | 82 | 16.1 | 79 | −15 | B |

TABLE 9-continued

| No. | magnetic characteristics $B_1$ (KG) | $B_{10}$ (KG) | Hc (A/cm) | electric resistivity (μ - Ω cm) | machinability boring time (sec) | cold workability threshold working ratio (%) | corrosion resistivity pitting potential (mV) | group |
|---|---|---|---|---|---|---|---|---|
| 8 | 3.67 | 12.47 | 0.86 | 68 | 14.8 | 85 | −42 | B |
| 9 | 3.64 | 12.53 | 0.88 | 67 | 16.7 | 81 | −58 | B |
| 10 | 3.65 | 12.47 | 0.91 | 81 | 14.6 | 85 | −23 | B |
| 11 | 3.05 | 12.42 | 0.93 | 76 | 16.4 | 83 | −17 | B |
| 12 | 3.51 | 11.30 | 0.81 | 130 | 15.8 | 73 | 363 | B |
| 13 | 3.58 | 12.41 | 0.94 | 83 | 15.3 | 80 | −331 | B |
| 15 | 3.77 | 12.59 | 0.81 | 69 | 15.6 | 83 | −68 | B |
| 16 | 3.71 | 12.53 | 0.83 | 69 | 14.6 | 82 | −78 | B |
| 17 | 3.73 | 12.56 | 0.78 | 72 | 15.2 | 80 | −21 | B |
| 18 | 3.73 | 12.60 | 0.85 | 86 | 15.6 | 80 | −18 | B |
| 19 | 3.62 | 12.52 | 0.89 | 81 | 14.2 | 81 | −71 | B |
| 20 | 3.61 | 12.49 | 0.87 | 69 | 16.2 | 86 | −57 | B |
| 21 | 3.75 | 12.53 | 0.95 | 73 | 14.1 | 82 | −20 | B |
| 22 | 3.68 | 12.55 | 0.89 | 86 | 15.0 | 84 | −31 | B |
| 23 | 1.18 | 12.28 | 1.24 | 129 | 14.8 | 77 | 381 | B |
| 24 | 1.05 | 11.94 | 1.47 | 67 | 15.7 | 76 | −298 | B |

TABLE 10

| No. | magnetic characteristics $B_1$ (KG) | $B_{10}$ (KG) | Hc (A/cm) | electric resistivity (μ - Ω cm) | machinability boring time (sec) | cold workability threshold working ratio (%) | corrosion resistivity pitting potential (mV) | group |
|---|---|---|---|---|---|---|---|---|
| fourth selection inventive steel | | | | | | | | |
| 25 | 1.23 | 12.35 | 1.33 | 84 | 16.5 | 80 | 68 | A |
| 26 | 1.03 | 11.86 | 1.49 | 68 | 14.2 | 77 | −39 | B |
| 27 | 1.27 | 12.37 | 1.27 | 69 | 13.9 | 80 | −68 | B |
| 28 | 1.13 | 12.12 | 1.34 | 83 | 15.8 | 76 | 2 | B |
| 29 | 1.02 | 11.88 | 1.41 | 87 | 14.1 | 77 | −11 | B |
| 30 | 1.14 | 12.16 | 1.31 | 68 | 14.1 | 80 | −15 | B |
| 31 | 1.16 | 12.20 | 1.30 | 68 | 15.4 | 79 | 38 | B |
| 32 | 1.14 | 12.18 | 1.32 | 82 | 14.3 | 82 | 16 | B |
| 33 | 1.15 | 12.18 | 1.32 | 86 | 15.5 | 79 | −3 | B |
| 34 | 0.98 | 11.72 | 1.45 | 134 | 10.5 | 78 | 334 | B |
| 35 | 0.74 | 11.36 | 2.23 | 69 | 10.9 | 71 | −335 | B |
| 36 | 0.81 | 11.35 | 2.08 | 84 | 13.8 | 72 | −107 | A |
| 37 | 0.98 | 11.67 | 1.51 | 82 | 14.8 | 76 | −42 | B |
| 38 | 1.00 | 11.72 | 1.49 | 86 | 15.3 | 77 | −36 | B |
| comparative steel | | | | | | | | |
| 39 | 1.31 | 12.47 | 1.13 | 68 | 17.3 | 71 | −69 | — |
| 40 | 0.95 | 12.38 | 1.61 | 80 | 18.5 | 68 | −78 | — |
| 41 | 1.84 | 12.43 | 1.58 | 81 | 17.4 | 72 | −60 | — |
| 42 | 0.83 | 12.24 | 1.69 | 77 | 17.8 | 66 | −98 | — |
| 43 | 0.62 | 12.10 | 1.78 | 78 | 15.6 | 62 | −72 | — |
| 44 | 0.55 | 12.34 | 1.84 | 73 | 10.5 | 69 | −93 | — |
| 45 | 0.39 | 11.71 | 2.62 | 72 | 12.4 | 63 | −132 | — |
| 46 | 0.35 | 11.15 | 2.88 | 79 | 12.5 | 65 | −155 | — |
| 47 | 0.37 | 11.64 | 2.83 | 71 | 9.6 | 68 | −178 | — |
| 48 | 0.12 | 10.62 | 3.70 | 13 | 41.0 | 78 | 41 | — |
| 49 | 0.08 | 9.83 | 4.80 | 19 | 38.0 | 76 | 38 | — |
| 50 | 0.14 | 10.22 | 4.60 | 21 | 13.0 | 61 | −270 | — |

TABLE 11

| | C | Si | Mn | P | S | Se | Te | Ni | Cr | Co | Mo | Cu | Al | Ti | Zr | X | Y | C/X | Y/X | remark |
|---|---|---|---|---|---|---|---|---|---|---|---|---|---|---|---|---|---|---|---|---|
| 1 | 0.015 | 0.08 | 0.23 | 0.003 | 0.026 | 0.000 | 0.000 | 20.68 | 0.05 | 0.03 | 0.00 | 0.02 | 0.932 | 0.053 | 0.000 | 0.053 | 0.026 | 0.276 | 0.488 | fifth |
| 2 | 0.031 | 0.08 | 0.92 | 0.004 | 0.099 | 0.008 | 0.000 | 20.81 | 0.03 | 0.03 | 0.00 | 0.02 | 0.004 | 0.206 | 0.011 | 0.212 | 0.102 | 0.147 | 0.483 | selec- |

TABLE 11-continued

| | C | Si | Mn | P | S | Se | Te | Ni | Cr | Co | Mo | Cu | Al | Ti | Zr | X | Y | C/X | Y/X | remark |
|---|---|---|---|---|---|---|---|---|---|---|---|---|---|---|---|---|---|---|---|---|
| 3 | 0.018 | 0.10 | 0.39 | 0.006 | 0.085 | 0.000 | 0.006 | 20.34 | 0.04 | 0.04 | 0.00 | 0.03 | 0.003 | 0.221 | 0.031 | 0.237 | 0.086 | 0.077 | 0.363 | tion |
| 4 | 0.026 | 0.95 | 0.48 | 0.003 | 0.066 | 0.006 | 0.007 | 20.08 | 0.03 | 0.03 | 0.00 | 0.01 | 0.003 | 2.889 | 0.103 | 2.943 | 0.071 | 0.009 | 0.024 | inven- |
| 5 | 0.010 | 0.09 | 0.51 | 0.002 | 0.037 | 0.000 | 0.008 | 35.89 | 0.04 | 0.02 | 0.00 | 0.02 | 0.002 | 0.187 | 0.000 | 0.187 | 0.039 | 0.051 | 0.207 | tive |
| 6 | 0.016 | 0.14 | 0.48 | 0.001 | 0.034 | 0.009 | 0.000 | 36.13 | 0.02 | 0.02 | 0.00 | 0.03 | 0.003 | 0.187 | 0.013 | 0.194 | 0.038 | 0.082 | 0.196 | alloy |
| 7 | 0.292 | 0.12 | 0.45 | 0.003 | 0.195 | 0.010 | 0.008 | 36.21 | 0.03 | 0.03 | 0.00 | 0.02 | 0.003 | 0.935 | 0.034 | 0.953 | 0.201 | 0.306 | 0.211 | |
| 8 | 0.015 | 0.11 | 0.52 | 0.002 | 0.011 | 0.000 | 0.000 | 36.44 | 0.03 | 0.02 | 0.00 | 0.02 | 0.002 | 0.124 | 0.112 | 0.182 | 0.011 | 0.083 | 0.062 | |
| 9 | 0.006 | 0.13 | 0.39 | 0.005 | 0.021 | 0.012 | 0.000 | 45.64 | 0.01 | 0.03 | 0.00 | 0.03 | 0.013 | 0.155 | 0.011 | 0.161 | 0.026 | 0.039 | 0.164 | |
| 10 | 0.015 | 0.16 | 0.38 | 0.004 | 0.021 | 0.000 | 0.013 | 45.78 | 0.02 | 0.03 | 0.00 | 0.02 | 0.016 | 0.147 | 0.012 | 0.153 | 0.024 | 0.097 | 0.158 | |
| 11 | 0.043 | 0.15 | 0.43 | 0.004 | 0.020 | 0.010 | 0.009 | 46.26 | 0.01 | 0.04 | 0.00 | 0.01 | 0.013 | 0.152 | 0.011 | 0.158 | 0.027 | 0.274 | 0.168 | |
| 12 | 0.012 | 0.11 | 0.42 | 0.003 | 0.007 | 0.011 | 0.000 | 46.31 | 0.03 | 0.02 | 0.00 | 0.02 | 0.017 | 0.156 | 0.013 | 0.163 | 0.012 | 0.074 | 0.072 | |
| 13 | 0.015 | 0.10 | 0.37 | 0.005 | 0.025 | 0.000 | 0.013 | 81.78 | 0.03 | 0.03 | 0.00 | 0.03 | 0.912 | 0.058 | 0.000 | 0.058 | 0.028 | 0.256 | 0.491 | |
| 14 | 0.038 | 0.08 | 0.93 | 0.002 | 0.146 | 0.008 | 0.000 | 81.36 | 0.04 | 0.03 | 0.00 | 0.02 | 0.012 | 0.306 | 0.011 | 0.312 | 0.149 | 0.122 | 0.477 | |
| 15 | 0.028 | 0.96 | 0.59 | 0.005 | 0.123 | 0.000 | 0.012 | 81.41 | 0.05 | 0.04 | 0.00 | 0.01 | 0.014 | 0.278 | 0.036 | 0.297 | 0.126 | 0.093 | 0.423 | |
| 16 | 0.026 | 0.07 | 0.68 | 0.004 | 0.045 | 0.011 | 0.000 | 81.33 | 0.02 | 0.02 | 0.00 | 0.02 | 0.011 | 2.867 | 0.084 | 2.911 | 0.049 | 0.009 | 0.017 | |
| 17 | 0.011 | 0.09 | 0.47 | 0.003 | 0.027 | 0.000 | 0.009 | 20.46 | 11.32 | 0.03 | 0.00 | 0.02 | 0.920 | 0.061 | 0.000 | 0.061 | 0.030 | 0.176 | 0.484 | |
| 18 | 0.021 | 0.92 | 0.41 | 0.004 | 0.086 | 0.012 | 0.008 | 20.17 | 11.67 | 0.03 | 0.00 | 0.01 | 0.013 | 0.290 | 0.023 | 0.302 | 0.093 | 0.069 | 0.307 | |
| 19 | 0.032 | 0.08 | 0.93 | 0.003 | 0.031 | 0.014 | 0.005 | 20.58 | 11.46 | 0.02 | 0.00 | 0.02 | 0.016 | 2.839 | 0.096 | 2.889 | 0.038 | 0.011 | 0.013 | |
| 20 | 0.007 | 0.53 | 0.46 | 0.004 | 0.027 | 0.000 | 0.000 | 42.08 | 5.21 | 0.03 | 0.00 | 0.03 | 0.512 | 2.719 | 0.007 | 0.223 | 0.027 | 0.032 | 0.121 | |
| 21 | 0.014 | 0.56 | 0.48 | 0.002 | 0.025 | 0.000 | 0.007 | 41.63 | 5.56 | 0.02 | 0.00 | 0.02 | 0.503 | 2.715 | 0.005 | 0.218 | 0.027 | 0.066 | 0.124 | |
| 22 | 0.298 | 0.51 | 0.44 | 0.003 | 0.152 | 0.011 | 0.006 | 42.13 | 5.14 | 0.04 | 0.00 | 0.01 | 0.523 | 3.885 | 0.005 | 1.388 | 0.158 | 0.215 | 0.114 | |
| 23 | 0.029 | 0.59 | 0.47 | 0.003 | 0.010 | 0.005 | 0.003 | 41.88 | 5.33 | 0.03 | 0.00 | 0.02 | 0.516 | 2.726 | 0.006 | 0.229 | 0.013 | 0.128 | 0.058 | |
| 24 | 0.010 | 0.21 | 0.39 | 0.005 | 0.022 | 0.005 | 0.005 | 76.51 | 11.21 | 0.03 | 0.00 | 0.01 | 0.965 | 0.052 | 0.000 | 0.052 | 0.025 | 0.193 | 0.477 | |
| 25 | 0.021 | 0.93 | 0.41 | 0.004 | 0.088 | 0.009 | 0.008 | 73.63 | 11.74 | 0.02 | 0.00 | 0.03 | 0.017 | 0.344 | 0.015 | 0.352 | 0.094 | 0.061 | 0.267 | |
| 26 | 0.038 | 0.28 | 0.96 | 0.005 | 0.015 | 0.010 | 0.008 | 81.08 | 4.36 | 0.03 | 0.00 | 0.02 | 0.015 | 2.872 | 0.138 | 2.944 | 0.021 | 0.013 | 0.007 | |

TABLE 12

| | C | Si | Mn | P | S | Se | Te | Ni | Cr | Co | Mo | Cu | Al | Ti | Zr | X | Y | C/X | Y/X | remark |
|---|---|---|---|---|---|---|---|---|---|---|---|---|---|---|---|---|---|---|---|---|
| 27 | 0.011 | 0.07 | 0.31 | 0.004 | 0.025 | 0.000 | 0.008 | 20.41 | 0.04 | 17.55 | 0.00 | 0.02 | 0.941 | 0.055 | 0.000 | 0.055 | 0.027 | 0.208 | 0.482 | fifth |
| 28 | 0.025 | 0.94 | 0.38 | 0.005 | 0.106 | 0.008 | 0.007 | 20.58 | 0.03 | 17.34 | 0.00 | 0.04 | 0.013 | 0.284 | 0.014 | 0.291 | 0.111 | 0.086 | 0.381 | selec- |
| 29 | 0.041 | 0.08 | 0.92 | 0.004 | 0.074 | 0.011 | 0.000 | 20.38 | 0.06 | 17.73 | 0.00 | 0.03 | 0.005 | 2.848 | 0.110 | 2.905 | 0.078 | 0.014 | 0.027 | tion |
| 30 | 0.012 | 0.12 | 0.23 | 0.005 | 0.032 | 0.000 | 0.000 | 32.42 | 0.02 | 5.41 | 0.00 | 0.03 | 0.004 | 0.214 | 0.000 | 0.214 | 0.032 | 0.058 | 0.151 | inven- |
| 31 | 0.031 | 0.14 | 0.19 | 0.004 | 0.052 | 0.005 | 0.005 | 32.04 | 0.02 | 5.24 | 0.00 | 0.02 | 0.003 | 0.233 | 0.009 | 0.238 | 0.055 | 0.132 | 0.233 | tive |
| 32 | 0.294 | 0.10 | 0.21 | 0.003 | 0.302 | 0.009 | 0.011 | 32.13 | 0.01 | 5.57 | 0.00 | 0.02 | 0.003 | 1.230 | 0.013 | 1.237 | 0.308 | 0.238 | 0.249 | alloy |
| 33 | 0.037 | 0.13 | 0.20 | 0.005 | 0.005 | 0.009 | 0.010 | 32.26 | 0.03 | 5.63 | 0.00 | 0.03 | 0.004 | 0.272 | 0.012 | 0.278 | 0.011 | 0.133 | 0.039 | |
| 34 | 0.010 | 0.15 | 0.31 | 0.006 | 0.022 | 0.000 | 0.008 | 70.43 | 0.03 | 17.58 | 0.00 | 0.02 | 0.937 | 0.054 | 0.000 | 0.054 | 0.024 | 0.188 | 0.453 | |
| 35 | 0.029 | 0.94 | 0.42 | 0.004 | 0.109 | 0.008 | 0.012 | 81.71 | 0.02 | 5.73 | 0.00 | 0.04 | 0.005 | 0.332 | 0.022 | 0.343 | 0.116 | 0.085 | 0.337 | |
| 36 | 0.046 | 0.18 | 0.91 | 0.005 | 0.051 | 0.009 | 0.000 | 81.76 | 0.03 | 2.76 | 0.00 | 0.02 | 0.004 | 2.392 | 0.936 | 2.879 | 0.055 | 0.016 | 0.019 | |
| 37 | 0.008 | 0.09 | 0.38 | 0.005 | 0.019 | 0.007 | 0.008 | 20.63 | 0.03 | 0.04 | 2.84 | 6.63 | 0.911 | 0.051 | 0.000 | 0.051 | 0.024 | 0.164 | 0.468 | |
| 38 | 0.033 | 0.96 | 0.31 | 0.004 | 0.129 | 0.007 | 0.008 | 20.51 | 0.03 | 0.04 | 6.87 | 1.55 | 0.006 | 0.410 | 0.027 | 0.424 | 0.134 | 0.079 | 0.316 | |
| 39 | 0.035 | 0.07 | 0.92 | 0.006 | 0.042 | 0.006 | 0.007 | 20.22 | 0.02 | 0.03 | 0.00 | 0.03 | 0.014 | 2.807 | 0.206 | 2.914 | 0.047 | 0.012 | 0.016 | |
| 40 | 0.012 | 0.08 | 0.52 | 0.004 | 0.042 | 0.012 | 0.000 | 78.28 | 0.03 | 0.04 | 4.58 | 3.48 | 0.967 | 0.160 | 0.012 | 0.166 | 0.047 | 0.071 | 0.284 | |
| 41 | 0.026 | 0.06 | 0.50 | 0.003 | 0.043 | 0.006 | 0.000 | 78.14 | 0.04 | 0.03 | 4.58 | 3.59 | 0.003 | 0.156 | 0.010 | 0.161 | 0.045 | 0.162 | 0.281 | |
| 42 | 0.296 | 0.07 | 0.51 | 0.003 | 0.307 | 0.007 | 0.009 | 77.94 | 0.04 | 0.04 | 4.46 | 3.51 | 0.004 | 1.121 | 0.011 | 1.127 | 0.312 | 0.263 | 0.277 | |
| 43 | 0.028 | 0.05 | 0.50 | 0.003 | 0.010 | 0.000 | 0.000 | 78.36 | 0.05 | 0.04 | 4.51 | 3.46 | 0.005 | 0.169 | 0.011 | 0.175 | 0.010 | 0.159 | 0.059 | |
| 44 | 0.013 | 0.16 | 0.28 | 0.005 | 0.026 | 0.000 | 0.009 | 81.13 | 0.05 | 0.04 | 2.01 | 4.42 | 0.941 | 0.059 | 0.000 | 0.059 | 0.029 | 0.223 | 0.486 | |
| 45 | 0.010 | 0.91 | 0.31 | 0.006 | 0.036 | 0.007 | 0.008 | 81.59 | 0.03 | 0.03 | 3.58 | 2.33 | 0.017 | 0.176 | 0.012 | 0.182 | 0.041 | 0.053 | 0.224 | |
| 46 | 0.046 | 0.06 | 0.93 | 0.005 | 0.087 | 0.008 | 0.000 | 81.35 | 0.05 | 0.04 | 0.00 | 0.02 | 0.012 | 2.804 | 0.189 | 2.902 | 0.090 | 0.016 | 0.031 | |
| 47 | 0.009 | 0.07 | 0.33 | 0.005 | 0.023 | 0.010 | 0.000 | 20.24 | 0.03 | 17.71 | 0.00 | 0.02 | 0.928 | 0.056 | 0.000 | 0.056 | 0.027 | 0.153 | 0.483 | |
| 48 | 0.015 | 0.97 | 0.31 | 0.004 | 0.067 | 0.000 | 0.011 | 20.38 | 11.83 | 0.05 | 0.00 | 0.03 | 0.011 | 0.195 | 0.018 | 0.204 | 0.070 | 0.075 | 0.341 | |
| 49 | 0.024 | 0.07 | 0.96 | 0.003 | 0.050 | 0.010 | 0.009 | 20.54 | 0.04 | 0.02 | 6.51 | 0.03 | 0.014 | 0.320 | 0.021 | 0.331 | 0.056 | 0.072 | 0.169 | |
| 50 | 0.292 | 0.08 | 0.29 | 0.004 | 0.277 | 0.007 | 0.006 | 20.49 | 0.03 | 0.03 | 0.00 | 6.92 | 0.008 | 1.578 | 0.020 | 1.588 | 0.281 | 0.184 | 0.177 | |
| 51 | 0.037 | 0.07 | 0.30 | 0.006 | 0.011 | 0.000 | 0.000 | 20.55 | 0.05 | 0.02 | 0.00 | 0.05 | 0.011 | 0.338 | 0.019 | 0.348 | 0.011 | 0.105 | 0.033 | |
| 52 | 0.047 | 0.20 | 0.23 | 0.004 | 0.062 | 0.000 | 0.000 | 20.16 | 0.02 | 0.03 | 0.00 | 0.04 | 0.018 | 2.885 | 0.157 | 2.967 | 0.062 | 0.016 | 0.021 | |

TABLE 13

| | C | Si | Mn | P | S | Se | Te | Ni | Cr | Co | Mo | Cu | Al | Ti | Zr | X | Y | C/X | Y/X | remark |
|---|---|---|---|---|---|---|---|---|---|---|---|---|---|---|---|---|---|---|---|---|
| 53 | 0.008 | 0.21 | 0.23 | 0.004 | 0.028 | 0.000 | 0.000 | 81.01 | 0.03 | 7.43 | 0.00 | 0.04 | 0.905 | 0.058 | 0.000 | 0.058 | 0.028 | 0.136 | 0.479 | fifth |
| 54 | 0.011 | 0.91 | 0.37 | 0.005 | 0.035 | 0.008 | 0.000 | 81.43 | 0.04 | 6.89 | 0.00 | 0.04 | 0.013 | 0.205 | 0.011 | 0.211 | 0.038 | 0.053 | 0.182 | selec- |
| 55 | 0.040 | 0.15 | 0.97 | 0.004 | 0.049 | 0.000 | 0.009 | 81.27 | 0.03 | 0.03 | 6.72 | 0.03 | 0.010 | 0.317 | 0.011 | 0.323 | 0.051 | 0.123 | 0.158 | tion |
| 56 | 0.293 | 0.31 | 0.42 | 0.006 | 0.160 | 0.007 | 0.008 | 81.62 | 1.44 | 1.39 | 1.24 | 2.91 | 0.021 | 1.249 | 0.013 | 1.256 | 0.165 | 0.233 | 0.131 | inven- |
| 57 | 0.053 | 0.06 | 0.44 | 0.005 | 0.014 | 0.000 | 0.000 | 81.35 | 0.05 | 0.03 | 0.00 | 0.03 | 0.012 | 0.296 | 0.012 | 0.302 | 0.014 | 0.174 | 0.048 | tive |
| 58 | 0.052 | 0.07 | 0.31 | 0.004 | 0.063 | 0.000 | 0.000 | 81.53 | 0.02 | 0.05 | 0.00 | 0.03 | 0.011 | 2.848 | 0.056 | 2.877 | 0.063 | 0.018 | 0.022 | alloy |
| 59 | 0.005 | 0.16 | 0.48 | 0.005 | 0.009 | 0.000 | 0.000 | 36.27 | 0.03 | 0.02 | 0.00 | 0.02 | 0.009 | 0.198 | 0.011 | 0.204 | 0.009 | 0.103 | 0.044 | com- |
| 60 | 0.006 | 0.06 | 0.39 | 0.006 | 0.003 | 0.000 | 0.000 | 46.58 | 0.03 | 0.03 | 0.00 | 0.03 | 0.012 | 0.005 | 0.000 | 0.005 | 0.003 | 1.602 | 0.603 | para- |
| 61 | 0.005 | 0.52 | 0.41 | 0.006 | 0.005 | 0.000 | 0.000 | 42.18 | 5.12 | 0.03 | 0.00 | 0.03 | 0.511 | 2.325 | 0.301 | 2.482 | 0.005 | 0.004 | 0.002 | tive |
| 62 | 0.007 | 0.21 | 0.24 | 0.007 | 0.013 | 0.000 | 0.000 | 32.31 | 0.03 | 5.04 | 0.00 | 0.02 | 0.009 | 0.030 | 0.000 | 0.030 | 0.013 | 0.167 | 0.445 | alloy |

TABLE 13-continued

| | C | Si | Mn | P | S | Se | Te | Ni | Cr | Co | Mo | Cu | Al | Ti | Zr | X | Y | C/X | Y/X | remark |
|---|---|---|---|---|---|---|---|---|---|---|---|---|---|---|---|---|---|---|---|---|
| 63 | 0.008 | 0.05 | 0.52 | 0.006 | 0.006 | 0.000 | 0.000 | 78.13 | 0.02 | 0.03 | 4.51 | 3.42 | 0.008 | 0.181 | 0.013 | 0.188 | 0.006 | 0.956 | 0.033 | |
| 64 | 0.006 | 0.03 | 0.41 | 0.007 | 0.008 | 0.000 | 0.000 | 21.03 | 0.02 | 0.02 | 0.00 | 0.01 | 0.080 | 0.211 | 0.000 | 0.211 | 0.008 | 0.882 | 0.038 | |
| 65 | 0.007 | 0.04 | 0.42 | 0.005 | 0.008 | 0.000 | 0.000 | 81.32 | 0.03 | 0.04 | 0.00 | 0.02 | 0.009 | 0.188 | 0.014 | 0.195 | 0.008 | 0.901 | 0.041 | |
| 66 | 0.023 | 0.08 | 0.49 | 0.003 | 2.284 | 0.008 | 0.000 | 35.89 | 0.03 | 0.02 | 0.00 | 0.02 | 0.003 | 0.836 | 0.000 | 0.836 | 2.287 | 0.028 | 2.736 | |
| 67 | 0.022 | 0.14 | 0.41 | 0.006 | 2.262 | 0.012 | 0.000 | 45.84 | 0.02 | 0.02 | 0.00 | 0.04 | 0.011 | 0.944 | 0.010 | 0.949 | 2.267 | 0.023 | 2.389 | |
| 68 | 0.059 | 0.51 | 0.48 | 0.005 | 0.433 | 0.000 | 0.000 | 42.07 | 5.17 | 0.03 | 0.00 | 0.02 | 0.508 | 3.673 | 0.000 | 3.673 | 0.433 | 0.016 | 0.118 | |
| 69 | 0.130 | 0.11 | 0.25 | 0.004 | 2.272 | 0.000 | 0.000 | 32.35 | 0.02 | 5.35 | 0.00 | 0.02 | 0.007 | 3.712 | 0.000 | 3.712 | 2.272 | 0.035 | 0.612 | |
| 70 | 0.007 | 0.07 | 0.51 | 0.003 | 0.044 | 0.000 | 0.000 | 78.05 | 0.04 | 0.03 | 4.51 | 3.52 | 0.007 | 0.158 | 0.000 | 0.158 | 0.044 | 0.047 | 0.277 | inven- |
| 71 | 0.021 | 0.91 | 0.55 | 0.004 | 0.123 | 0.000 | 0.000 | 81.23 | 0.03 | 0.03 | 0.00 | 0.02 | 0.012 | 0.281 | 0.000 | 0.281 | 0.123 | 0.073 | 0.438 | tive |
| 72 | 0.012 | 0.06 | 0.35 | 0.003 | 0.030 | 0.000 | 0.000 | 20.15 | 0.03 | 17.21 | 0.00 | 0.02 | 0.884 | 0.058 | 0.000 | 0.058 | 0.030 | 0.211 | 0.523 | alloy |
| 73 | 0.011 | 0.07 | 0.49 | 0.004 | 0.034 | 0.000 | 0.000 | 20.29 | 11.58 | 0.03 | 0.00 | 0.02 | 0.957 | 0.064 | 0.000 | 0.064 | 0.034 | 0.176 | 0.531 | |
| 74 | 0.016 | 0.09 | 0.25 | 0.003 | 0.030 | 0.000 | 0.000 | 20.77 | 0.04 | 0.02 | 0.00 | 0.03 | 0.912 | 0.057 | 0.000 | 0.057 | 0.030 | 0.288 | 0.524 | |
| 75 | 0.009 | 0.08 | 0.91 | 0.004 | 0.109 | 0.000 | 0.000 | 81.15 | 0.04 | 0.03 | 0.00 | 0.03 | 0.014 | 2.953 | 0.000 | 2.953 | 0.109 | 0.003 | 0.037 | |

TABLE 14

| | (hot warkability) | (machinability) boring time (sec) | thermal expansion coefficient ($\times 10^{-7}$/K) | temperature coefficient ? of Young's modulus ($10^{-5}$/K) | magnetic characteristics B1 (T) | B5 (T) | B10 (T) | μm (T) | Hc (A/cm) | remark |
|---|---|---|---|---|---|---|---|---|---|---|
| 1 | ○ | 16.7 | — | — | — | — | — | — | — | fifth |
| 2 | ○ | 11.3 | — | — | — | — | — | — | — | selection |
| 3 | ○ | 10.9 | — | — | — | — | — | — | — | inventive |
| 4 | ○ | 10.7 | — | — | — | — | — | — | — | alloy |
| 5 | ○ | 20.4 | 7.57 | — | — | — | — | — | — | |
| 6 | ○ | 21.5 | 7.21 | — | — | — | — | — | — | |
| 7 | ○ | 14.3 | 7.86 | — | — | — | — | — | — | |
| 8 | ○ | 27.7 | 8.22 | — | — | — | — | — | — | |
| 9 | ○ | 28.5 | — | — | 1.05 | 1.30 | 1.39 | 26,100 | 0.14 | |
| 10 | ○ | 23.9 | — | — | 0.99 | 1.25 | 1.36 | 25,900 | 0.16 | |
| 11 | ○ | 28.3 | — | — | 0.92 | 1.19 | 1.31 | 23,500 | 0.17 | |
| 12 | ○ | 29.3 | — | — | 0.95 | 1.21 | 1.33 | 24,500 | 0.15 | |
| 13 | ○ | 17.4 | — | — | — | — | — | — | — | |
| 14 | ○ | 12.0 | — | — | — | — | — | — | — | |
| 15 | ○ | 12.3 | — | — | — | — | — | — | — | |
| 16 | ○ | 14.8 | — | — | — | — | — | — | — | |
| 17 | ○ | 15.4 | — | — | — | — | — | — | — | |
| 18 | ○ | 11.2 | — | — | — | — | — | — | — | |
| 19 | ○ | 14.8 | — | — | — | — | — | — | — | |
| 20 | ○ | 26.5 | — | ±1 | — | — | — | — | — | |
| 21 | ○ | 26.4 | — | ±1 | — | — | — | — | — | |
| 22 | ○ | 17.5 | — | ±1 | — | — | — | — | — | |
| 23 | ○ | 26.8 | — | ±1 | — | — | — | — | — | |
| 24 | ○ | 13.8 | — | — | — | — | — | — | — | |
| 25 | ○ | 11.3 | — | — | — | — | — | — | — | |
| 26 | ○ | 18.6 | — | — | — | — | — | — | — | |
| 27 | ○ | 12.1 | — | — | — | — | — | — | — | |
| 28 | ○ | 9.1 | — | — | — | — | — | — | — | |
| 29 | ○ | 9.4 | — | — | — | — | — | — | — | |
| 30 | ○ | 12.1 | 4.92 | — | — | — | — | — | — | |
| 31 | ○ | 9.7 | 4.35 | — | — | — | — | — | — | |
| 32 | ○ | 10.4 | 5.03 | — | — | — | — | — | — | |
| 33 | ○ | 17.8 | 4.55 | — | — | — | — | — | — | |
| 34 | ○ | 12.8 | — | — | — | — | — | — | — | |
| 35 | ○ | 16.8 | — | — | — | — | — | — | — | |
| 36 | ○ | 18.8 | — | — | — | — | — | — | — | |
| 37 | ○ | 13.5 | — | — | — | — | — | — | — | |
| 38 | ○ | 9.9 | — | — | — | — | — | — | — | |
| 39 | ○ | 14.3 | — | — | — | — | — | — | — | |
| 40 | ○ | 18.2 | — | — | — | — | — | 124,000 | 0.015 | |

TABLE 15

| | (hot warkability) | (machinability) boring time (sec) | thermal expansion coefficient ($\times 10^{-7}$/K) | temperature coefficient ? of Young's modulus ($10^{-5}$/K) | magnetic characteristics B1 (T) | B5 (T) | B10 (T) | μm (T) | Hc (A/cm) | remark |
|---|---|---|---|---|---|---|---|---|---|---|
| 41 | ○ | 24.4 | — | — | — | — | — | 121,000 | 0.013 | fifth |
| 42 | ○ | 13.2 | — | — | — | — | — | 112,000 | 0.017 | selection |
| 43 | ○ | 27.9 | — | — | — | — | — | 120,000 | 0.014 | inventive |
| 44 | ○ | 26.8 | — | — | — | — | — | — | — | alloy |
| 45 | ○ | 12.6 | — | — | — | — | — | — | — | |
| 46 | ○ | 13.3 | — | — | — | — | — | — | — | |
| 47 | ○ | 13.2 | — | — | — | — | — | — | — | |
| 48 | ○ | 10.2 | — | — | — | — | — | — | — | |
| 49 | ○ | 12.5 | — | — | — | — | — | — | — | |
| 50 | ○ | 10.8 | — | — | — | — | — | — | — | |
| 51 | ○ | 15.9 | — | — | — | — | — | — | — | |
| 52 | ○ | 11.3 | — | — | — | — | — | — | — | |
| 53 | ○ | 22.3 | — | — | — | — | — | — | — | |
| 54 | ○ | 23.1 | — | — | — | — | — | — | — | |
| 55 | ○ | 18.3 | — | — | — | — | — | — | — | |
| 56 | ○ | 17.6 | — | — | — | — | — | — | — | |
| 57 | ○ | 20.6 | — | — | — | — | — | — | — | |
| 58 | ○ | 15.1 | — | — | — | — | — | — | — | |
| 59 | ○ | 27.4 | 7.76 | — | — | — | — | — | — | comparative |
| 60 | ○ | 25.8 | — | — | 1.13 | 1.35 | 1.42 | 28,300 | 0.12 | alloy |
| 61 | ○ | 27.6 | — | ±1 | — | — | — | — | — | |
| 62 | ○ | 19.1 | 4.21 | — | — | — | — | — | — | |
| 63 | ○ | 33.8 | — | — | — | — | — | 12,600 | 0.013 | |
| 64 | ○ | 20.8 | — | — | — | — | — | — | — | |
| 65 | ○ | 25.4 | — | — | — | — | — | — | — | |
| 66 | X | — | — | — | — | — | — | — | — | |
| 67 | X | — | — | — | — | — | — | — | — | |
| 68 | X | — | — | — | — | — | — | — | — | |
| 69 | X | — | — | — | — | — | — | — | — | |
| 70 | X | — | — | — | — | — | — | — | — | |
| 71 | Δ | 11.8 | — | — | — | — | — | — | — | inventive |
| 72 | Δ | 12.7 | — | — | — | — | — | — | — | alloy |
| 73 | Δ | 15.3 | — | — | — | — | — | — | — | |
| 74 | Δ | 16.8 | — | — | — | — | — | — | — | |
| 75 | Δ | 12.9 | — | — | — | — | — | — | — | |

TABLE 16

| | JP11-140597 | JP10-130794 | first selection inventional steel |
|---|---|---|---|
| C | ~0.1 wt % | ~0.03 | 0.021~0.4 wt % |
| Si | ~2.0 wt % | ~2.0 | — |
| Mn | ~2.0 wt % | ~2.0 | — |
| Cr | 19~25 wt % | 16~25 | 12~35 wt % |
| S (Se) | 0.20~0.35 wt % | ~0.50 | 0.01~1 wt % |

TABLE 16-continued

| | JP11-140597 | JP10-130794 | first selection inventional steel |
|---|---|---|---|
| Ti (Zr) | 0.01~0.50 wt % | ~1.0 | 0.14~3.5 wt % |
| S + Se | more than C (No. 13 Table 1) | more than C | more than C |
| Ws | 2.33 (more than 0.45) | | not more than 0.45 |
| $\frac{W_{Ti} + 0.52W_{Zr}}{}$ | No. 13 (Table 1) | | |

TABLE 17

| | second selection inventive steel | JP60-155653 | JP11-140597 | Honkura | JP2-170948 | JP63-93843 |
|---|---|---|---|---|---|---|
| Ti + Zr(X) | 0.03~3.5 | 1.5~3 | 0.01~0.5 | 0.05~0.35 | ~3.0 | 0.02~2 |
| C | more than 0.19 | ~0.15$^{\Delta}$ | ~0.1$^{\Delta}$ | ~0.015$^{\Delta}$ | ~0.015$^{\Delta}$ | ~0.08$^{\Delta}$ |
| S, Se, Te(Y) | 0.01~1.0S 0.01~0.8Se | ~0.015 | 0.2~0.35 | ~0.05 | ~0.015 | ~0.015 |
| C/X | 0.125~1.5/X | 0~0.037$^{\Delta}$ | 0~0.78 | 0~0.3 | 0~0.088$^{\Delta}$ | 0~0.25 |
| C/Y | 0.375~1.5/Y | 0~1.15 | 0~0.5 | 0~0.3$^{\Delta}$ | 0~1.6 | 0~3.67 |

$^{\Delta}$the range does not overlap with claim 55–63

TABLE 18

| | third selection inventive steel | JP60-155653 |
|---|---|---|
| Ni | 2~50 | 20~30 |
| Cr | 12~50 | 10~20 |
| Fe | 5~86.95 | bal. |
| C | 0.024~0.4 | ~0.15 |
| Ti + 0.52Zr | 0.03~3.5 | 1.5~3 |

TABLE 18-continued

| | third selection inventive steel | JP60-155653 |
|---|---|---|
| S | 0.01~1 | ~0.015 |
| Se | 0.01~0.8 | — |
| S + Se | more than C [Δ] | less than C (Table 1) [Δ] |

[Δ]: the range does not overlap with JP60-155653

TABLE 19

| | C | Ni | Cr | Ti | Zr | S | Se | Si | Mn | P | O | N | note | Ti + 0.52Zr |
|---|---|---|---|---|---|---|---|---|---|---|---|---|---|---|
| third selection inventive steel | | | | | | | | | | | | | | |
| 1 | 0.075 | 9.8 | 18.8 | 0.61 | | 0.21 | | 0.19 | 0.28 | 0.025 | 0.003 | 0.007 | | 0.61 |
| 1' | 0.083 | 9.6 | 18.9 | 0.63 | | 0.06 | | 0.22 | 0.31 | 0.026 | 0.005 | 0.006 | | 0.63 |
| 2 | 0.118 | 12.2 | 20.5 | 0.96 | | 0.32 | | 0.28 | 0.39 | 0.013 | 0.007 | 0.004 | 0.8Cu | 0.96 |
| 2' | 0.096 | 12.2 | 20.2 | 0.83 | | 0.01 | | 0.22 | 0.32 | 0.021 | 0.006 | 0.005 | 0.8Cu | 0.83 |
| 4 | 0.262 | 8.5 | 18.1 | 2.13 | | 0.68 | | 0.31 | 0.32 | 0.008 | 0.003 | 0.009 | | 2.13 |
| 4' | 0.255 | 8.8 | 18.2 | 2.43 | | 0.21 | | 0.35 | 0.35 | 0.012 | 0.005 | 0.006 | | 2.43 |
| 5 | 0.118 | 7.9 | 17.8 | 0.98 | | 0.30 | | 0.31 | 0.42 | 0.019 | 0.003 | 0.008 | 1.3Mo | 0.98 |
| 5' | 0.102 | 7.8 | 17.8 | 0.59 | | 0.07 | | 0.30 | 0.41 | 0.019 | 0.004 | 0.006 | 1.3Mo | 0.59 |
| 7 | 0.121 | 8.7 | 17.8 | 1.02 | | 0.31 | | 0.21 | 0.30 | 0.028 | 0.004 | 0.014 | 2.8Cu | 1.02 |
| 7' | 0.133 | 9.0 | 18.3 | 0.99 | | 0.13 | | 0.25 | 0.30 | 0.027 | 0.005 | 0.009 | 2.6Cu | 0.99 |
| 8 | 0.169 | 19.2 | 24.2 | 1.05 | 0.42 | 0.28 | | 0.61 | 0.18 | 0.042 | 0.001 | 0.019 | | 1.27 |
| 8' | 0.175 | 19.8 | 23.7 | 0.95 | 0.58 | 0.14 | | 0.55 | 0.21 | 0.033 | 0.003 | 0.012 | | 1.25 |
| 9 | 0.062 | 18.6 | 24.5 | 0.55 | 0.24 | 0.19 | | 0.32 | 1.68 | 0.007 | 0.002 | 0.024 | 0.4Cu, 5.8Mo, 0.0029B | 0.67 |
| 9' | 0.056 | 18.6 | 24.3 | 0.51 | 0.18 | 0.03 | | 0.32 | 1.42 | 0.011 | 0.003 | 0.021 | 0.6Cu, 5.7Mo, 0.0012B | 0.60 |
| 10 | 0.122 | 35.9 | 30.2 | 1.01 | | 0.32 | | 0.29 | 1.23 | 0.005 | 0.005 | 0.007 | 1.2Co, 0.0018Ca | 1.01 |
| 10' | 0.123 | 34.4 | 28.6 | 0.83 | | 0.09 | | 0.25 | 1.08 | 0.009 | 0.004 | 0.009 | 1.2Co, 0.0032Ca | 0.83 |
| 15 | 0.032 | 10.9 | 20.2 | 0.18 | | 0.07 | | 0.61 | 0.34 | 0.011 | 0.002 | 0.009 | 0.21Pb, 0.14V | 0.18 |
| 15' | 0.075 | 10.6 | 20.9 | 0.23 | | 0.05 | | 0.58 | 0.28 | 0.021 | 0.005 | 0.006 | 0.24Pb, 0.12V | 0.23 |
| 16 | 0.092 | 15.3 | 19.1 | 0.88 | | 0.34 | | 2.17 | 0.21 | 0.028 | 0.004 | 0.012 | 0.0022Ca, 0.22Ta | 0.88 |
| 16' | 0.103 | 14.2 | 19.5 | 0.82 | | 0.06 | | 1.83 | 0.35 | 0.023 | 0.006 | 0.008 | 0.0015Ca, 0.05Ta | 0.82 |

The dashed sample numbers indicate comparative examples.

TABLE 20

| | hot workability | cutting resistance | finished surface roughness | chip shape | corrosion resistivity | out-gas resistivity | threshold compressive strain |
|---|---|---|---|---|---|---|---|
| third selection inventive steel | | | | | | | |
| 1 | ○ | 33.6 | 2.05 | E | A | 0.008 | 1.9 |
| 1' | ○ | 41.5 | 3.21 | E | A | 0.004 | 1.5 |
| 2 | ○ | 31.2 | 1.92 | E | A | 0.017 | 1.9 |
| 2' | ○ | — | — | — | A | 0.003 | 1.5 |
| 4 | ○ | 25.2 | 1.95 | E | A | 0.024 | 1.7 |
| 4' | ○ | — | — | — | A | 0.007 | 1.3 |
| 5 | ○ | 31.9 | 1.91 | E | A | 0.019 | 1.9 |
| 5' | ○ | 38.5 | 2.64 | E | A | 0.008 | 1.5 |
| 7 | ○ | 29.8 | 1.88 | E | A | 0.015 | 2.0 |
| 7' | ○ | 42.2 | 2.92 | E | A | 0.010 | 1.4 |
| 8 | ○ | 32.7 | 1.99 | E | A | 0.009 | |
| 8' | ○ | 40.4 | 3.00 | E | A | 0.004 | |
| 9 | ○ | 36.2 | 2.21 | E | A | 0.030 | |
| 9' | ○ | 43.5 | 2.88 | B | A | 0.006 | |
| 10 | ○ | 30.5 | 2.16 | E | A | 0.027 | |
| 10' | ○ | 40.2 | 3.11 | E | A | 0.009 | |
| 15 | ○ | 32.6 | 2.02 | E | A | 0.003 | |
| 15' | ○ | 35.3 | 2.58 | G | A | 0.004 | |
| 16 | ○ | 33.3 | 2.00 | E | A | 0.007 | |
| 16' | ○ | 39.5 | 3.06 | E | A | 0.004 | |

The dashed sample numbers indicate comparative examples.

TABLE 21

| | fourth selection inventive steel | JP11-140597 | JP10-130794 | Honkura (USP4, 969, 963) | JP2-170948 | JP63-93843 | JP60-155653 |
|---|---|---|---|---|---|---|---|
| Si | 0.01~3 | ~2.0 | ~2.0 | ~2.0 | ~0.10 | 0.1~3.0 | ~1.5 |
| Mn | ~2.0 | ~2.0 | ~2.0 | ~0.35 | ~0.30 | ~0.5 | ~2.0 |
| Cr | 5~25 | 19~25 | 16~25 | 8~13 | 4~20 | 8~18 | 10~20 |
| Al | 0.01~5 | 0.01~0.5 | — | ~0.02 | 0.03~0.2 | ~0.5 | 0.1~0.5 |
| Ti + Zr(X) | 0.05~0.5 | 0.01~0.5 (0.09 No. 13 Tab. 1) | ~1.0 | 0.05~0.35 | ~3.0 | 0.02~2 | 1.5~3 |
| C | 0.02X~0.06X 0.19X~0.26X | ~0.1 (0.07 No. 13 Tab. 1) | ~0.03 | ~0.015 | ~0.015 | ~0.08 | ~0.15 |
| S, Se, Te(Y) | see FIG. 1 | 0.2~0.35 (0.21 No. 13 Tab. 1) | ~0.50 | ~0.05 | ~0.015 | ~0.015 | ~0.015 |
| C/X | see FIG. 1 | 0~10 (0.33 No. 13 Tab. 1) | 0.025~0.041 | 0~0.3 | 0~0.28 | 0~0.29 | 0~0.1 |
| Y/X | see FIG. 1 | 0.4~35 (2.33 No. 13 Tab. 1) | 0.34~0.51 | 0~1 | 0~0.08 | 0~0.12 | 0~0.01 |

TABLE 22

| No. | $B_1$ | $B_{10}$ | Hc | μ | b.t(sec) | t.w.r(%) | p.p(mV) |
|---|---|---|---|---|---|---|---|
| 35 | 0.7 | 11.36 | 2.23 | 69 | 10.9 | 71 | −33.5 |
| 45* | 0.39$^{\Delta}$ | 11.71 | 2.62 | 72 | 12.4 | 63 | −13.2 |
| 15 | 3.77 | 12.59 | 0.81 | 69 | 15.6 | 83 | −68 |
| 40* | 0.95$^{\Delta}$ | 12.38 | 1.61 | 80 | 18.5 | 68$^{\Delta}$ | −78$^{\Delta}$ |
| 20 | 3.61 | 12.49 | 0.87 | 69 | 16.2 | 86 | −57 |
| 42* | 0.83$^{\Delta}$ | 12.24 | 1.69 | 77 | 17.8 | 66$^{\Delta}$ | −98$^{\Delta}$ |
| 34 | 0.98 | 11.67 | 1.51 | 82 | 14.8 | 76 | −42 |
| 47* | 0.37$^{\Delta}$ | 11.64 | 2.83 | 71 | 9.6 | 68$^{\Delta}$ | −178$^{\Delta}$ |
| 36 | 0.81 | 11.35 | 2.08 | 84 | 13.8 | 72 | −107 |
| 46* | 0.35$^{\Delta}$ | 11.15 | 2.88 | 79 | 12.5 | 65$^{\Delta}$ | −155$^{\Delta}$ |

*inventive steel(comparative reference for fourth selection inventive steel)

TABLE 23

| | fifth selection inventive steel | JP60-155653 | JP11-140597 | Honkura | JP2-170948 | JP63-93843 |
|---|---|---|---|---|---|---|
| Ni | 20~82 | 20~30 | 0.1~4.0$^{\Delta}$ | ~0.5$^{\Delta}$ | ~3.0$^{\Delta}$ | No discloswe$^{\Delta}$ |
| Ti + Zr(x) | 0.05~3 | 1.5~3 | 0.01~0.5 | 0.05~0.35 | ~3.0 | 0.02~2 |
| S, Se, Te(Y) | 0.014~0.5x | 0.002~0.012$^{\Delta}$ | 0.2~0.35$^{\Delta}$ | ~0.05 | ~0.015 | ~0.015 |
| C | 0.2Y~0.3 | 0~0.15 | ~0.1 | ~0.015 | ~0.015 | ~0.08 |
| Si | ~1.0 | ~1.5 | ~2.0 | ~0.2 | ~0.10 | 0.1~3.0 |
| Mn | ~1.0 | ~2 | ~2.0 | ~0.35 | ~0.30 | ~0.5 |
| Al | ~1.0 | 0.1~0.5 | 0.01~0.5 | ~0.02 | 0.03~0.2 | ~0.5 |

$^{\Delta}$the range does not overlap with claim 41–44

TABLE 24

| No. | Ni | Ti | C | S | hot workability | boring time |
|---|---|---|---|---|---|---|
| 30 | 32.42 | 0.214 | 0.012 | 0.032 | ○ | 12.1 |
| 59$^{\Delta}$ | 36.27 | 0.198 | 0.005 | 0.009 | ○ | 27.4$^{\Delta}$ |
| 31 | 32.04 | 0.233 | 0.031 | 0.052 | ○ | 9.7 |
| 62$^{\Delta}$ | 32.31 | 0.030 | 0.007 | 0.013 | ○ | 19.1$^{\Delta}$ |
| 40 | 78.28 | 0.160 | 0.012 | 0.042 | ○ | 18.2 |
| 63$^{\Delta}$ | 78.13 | 0.181 | 0.008 | 0.006 | ○ | 33.8$^{\Delta}$ |
| 48 | 20.38 | 0.195 | 0.015 | 0.067 | ○ | 10.2 |
| 64$^{\Delta}$ | 21.03 | 0.211 | 0.006 | 0.008 | ○ | 20.8$^{\Delta}$ |
| 45 | 81.59 | 0.176 | 0.010 | 0.036 | ○ | 12.6 |
| 65$^{\Delta}$ | 81.32 | 0.180 | 0.007 | 0.008 | ○ | 25.4$^{\Delta}$ |

TABLE 24-continued

| No. | Ni | Ti | C | S | hot workability | boring time |
|---|---|---|---|---|---|---|
| 32 | 32.13 | 1.230 | 0.294 | 0.302 | ○ | 10.4 |
| 66$^{\Delta}$ | 35.89 | 0.836 | 0.023 | 2.284 | X | —$^{\Delta}$ |

$^{\Delta}$comparative reference for fifth selection inventive steel.

What is claimed is:

1. Free cutting alloy constituted as ferrite containing stainless steel containing:

2 mass % or lower, including zero, Ni; 12 to 35 mass % Cr; and 0.021 to 0.4 mass % C;

one or more of Ti and Zr such that $W_{Ti}+0.52W_{Zr}=0.14$ to 3.5 mass %, wherein $W_{Ti}$ and $W_{Zr}$ denote respective contents in mass % of Ti and Zr; and one or more of S and Se in the respective ranges of 0.01 to 1 mass % for S and 0.01 to 0.8 mass % for Se so that a total content in mass % of S and Se is set to a value higher than two times a C content in mass %;

wherein S content is determined such that a value of $W_S/(W_{Ti}+0.52W_{Zr})$ is 0.45 or less, wherein $W_S$ denotes a S content;

wherein $(W_{Ti}+0.52W_{Zr})/W_c=6.7$ to 20, wherein $W_c$ donates content in mass % of C;

and wherein a (Ti,Zr) based compound containing one or more of Ti and Zr as a metal element component, C being an indispensable element as a bonding component with the metal element component, and one or more of S, Se and Te is dispersed in a matrix metal phase.

2. Free cutting alloy according to claim 1, the $W_{so}$ value of which is less than 0.035 mass % when the following test is performed: an alloy test piece is prepared so as to have the shape of a rectangular prism in size of 15 mm in length, 25 mm in width and 3 mm in thickness with the entire surface being polished with No. 400 emery paper; a silver foil in size of 10 mm in length, 5 mm in width and 0.1 mm in thickness with a purity of 99.9% or higher as a S getter and 0.5 cc of pure water are sealed in a vessel of an inner volume of 250 cc together with said test piece; a temperature in said vessel is raised to 85° C. and said temperature is then kept there for 20 hr; and thereafter, a S content $W_{SO}$ in mass % in said silver foil piece is analyzed.

3. Free cutting alloy according to claim 1, containing 2 mass % or lower Si; 2 mass % or lower Mn; 2 mass % or lower Cu; and 2 mass % or lower Co.

4. Free cutting alloy according to claim 1, containing one or more of Mo and W in the respective ranges of 0.1 to 4 mass % for Mo and 0.1 to 3 mass % for W.

5. Free cutting alloy according to claim 1, containing: 0.05 mass % or lower P; and 0.03 mass % O; and 0.05 mass % or lower N.

6. Free cutting alloy according to claim 1, containing one or more of Te, Bi and Pb in the respective ranges of 0.005 to 0.1 mass % for Te; 0.01 to 0.2 mass % for Bi; and 0.01 to 0.3 mass % for Pb.

7. Free cutting alloy according to claim 1, containing one or more selected from the group consisting of Ca, Mg, B and metal elements classified as Group 3A in the periodic table of elements in the range of 0.0005 to 0.01 mass % for one element or as a total content of more than one elements combined.

8. Free cutting alloy according to claim 1, containing one or more selected from the group consisting of Nb, V, Ta and Hf each of which is in a range of 0.01 to 0.5 mass %.

9. Free cutting alloy constituted as martensite containing stainless steel containing:

2 mass % or lower, including zero, Ni; 9 to 17 mass % Cr; 0.03 mass % or lower O; 0.05 mass % or lower N;

one or more of Ti and Zr such that $W_{Ti}+0.52W_{Zr}=0.10$ to 3.5 mass %, wherein $W_{Ti}$ and $W_{Zr}$ denote respective contents in mass % of Ti and Zr; and one or more of S and Se in the respective ranges of 0.03 to 1 mass % for S and 0.01 to 0.8 mass % for Se;

and 0.19 mass % or more of C so as to satisfy the following formulae:

$$0.375(W_S+0.4W_{Se})<W_C\leqq 1.5 \quad \text{(Formula A)}$$

$$0.125(W_{Ti}+0.52W_{Zr})<W_C\leqq 1.5 \quad \text{(Formula B)},$$

wherein $W_{Ti}$, $W_{Zr}$ $W_C$, $W_S$ and $W_{Se}$ denote respective contents of Ti, Zr, C, S and Se, all in mass %;

and wherein a (Ti,Zr) based compound containing one or more of Ti and Zr as a metal element component, C being an indispensable element as a bonding component with the metal element component, and one or more of S, Se and Te is dispersed in a matrix metal phase.

10. Free cutting alloy according to claim 9 whose S content is determined such that a value of $W_S/(W_{Ti}+0.52W_{Zr})$ is 0.45 or less, wherein $W_S$ denotes a S content.

11. Free cutting alloy according to claim 10, the $W_{so}$ value of which is less than 0.035 mass % when the following test is performed: an alloy test piece is prepared so as to have the shape of a rectangular prism in size of 15 mm in length, 25 mm in width and 3 mm in thickness with the entire surface being polished with No. 400 emery paper; a silver foil in size of 10 mm in length, 5 mm in width and 0.1 mm in thickness with a purity of 99.9% or higher as a S getter and 0.5 cc of pure water are sealed in a vessel of an inner volume of 250 cc together with said test piece; a temperature in said vessel is raised to 85° C. and said temperature is then kept there for 20 hr; and thereafter, a S content $W_{SO}$ in mass % in said silver foil piece is analyzed.

12. Free cutting alloy according to claim 9 further containing: 2 mass % or lower Si; 2 mass % or lower Mn; 2 mass % or lower Cu; and 2 mass % or lower Co.

13. Free cutting alloy according to claim 9 further containing one or more of Mo and W in the respective ranges of 0.1 to 4 mass % for Mo and 0.1 to 3 mass % for W.

14. Free cutting alloy according to claim 9 further containing: 0.05 mass % or lower P; and 0.03 mass % or lower O; and 0.05 mass % or lower N.

15. Free cutting alloy according to claim 9 further containing one or more of Te, Bi and Pb in the respective ranges of 0.005 to 0.1 mass % for Te; 0.01 to 0.2 mass % for Bi; and 0.01 to 0.3 mass % for Pb.

16. Free cutting alloy according to claim 9 further containing one or more selected from the group consisting of Ca, Mg, B and metal elements classified as Group 3A in the periodic table of elements in the range of 0.0005 to 0.01 mass % for one element or as a total content of more than one elements combined.

17. Free cutting alloy according to claim 9 further containing one or more selected from the group consisting of Nb, V, Ta and Hf each of which is in a range of 0.01 to 0.5 mass %.

18. Free cutting alloy containing 20 to 82 mass % Ni and the part except for Ni of which is mainly constituted by one or more of Fe and Cr further containing:

one or more of Ti and Zr so that X defined by the following formula 1 in the range satisfying a relation of $0.05\leqq X\leqq 3$;

one or more of S, Se and Te so that Y defined by the following formula 2 in the range satisfying a relation of $0.014\leqq Y\leqq 0.5\ X$;

C in the range satisfying a relation of $0.2Y\leqq W_C\leqq 0.3$, wherein when a Ti content is indicated by $W_{Ti}$ in mass %, a Zr content by $W_{Zr}$ in mass %, a C content by $W_C$ in mass %, a S content by $W_S$ in mass %, a Se content by $W_{Se}$ in mass % and a Te content by $W_{Te}$ in mass %, the following formulae 1 and 2 are given in order to define X and Y:

$$X(\text{mass }\%)=W_{Ti}+0.52W_{Zr} \quad \text{(formula 1)}$$

$$Y(\text{mass }\%)=W_S+0.41W_{Se}+0.25W_{Te} \quad \text{(formula 2)};$$

one or more of Si, Mn and Al in the respective ranges of 1 mass % for Si, 1 mass % for Mn and 1 mass % for Al;

wherein a (Ti,Zr) based compound containing one or more of Ti and Zr as a metal element component, C being an indispensable element as a bonding component with the metal element component, and one or more of S, Se and Te is dispersed in a matrix metal phase.

19. Free cutting alloy according to claim 18 further containing one or more of Mo and Cu in the respective ranges of 7 mass % or lower for Mo and 7 mass % or lower for Cu.

20. Free cutting alloy according to claim 18 further containing 12 mass % or lower Cr.

21. Free cutting alloy according to claim 18 further containing 18 mass % or lower Co.

* * * * *